US007367169B2

(12) United States Patent
Katsumata

(10) Patent No.: US 7,367,169 B2
(45) Date of Patent: May 6, 2008

(54) BANK NOTE BUNDLING MACHINE

(75) Inventor: Osami Katsumata, Himeji (JP)

(73) Assignee: Glory Kogyo Kabushiki Kaisha, Hyogo-Ken (JP)

( * ) Notice: Subject to any disclaimer, the term of this patent is extended or adjusted under 35 U.S.C. 154(b) by 20 days.

(21) Appl. No.: 10/523,821

(22) PCT Filed: Aug. 6, 2003

(86) PCT No.: PCT/JP03/10019

§ 371 (c)(1),
(2), (4) Date: Feb. 4, 2005

(87) PCT Pub. No.: WO2004/012997

PCT Pub. Date: Feb. 12, 2004

(65) Prior Publication Data

US 2005/0241270 A1 Nov. 3, 2005

(30) Foreign Application Priority Data

Aug. 6, 2002 (JP) ..... 2002-228314

(51) Int. Cl.
*B65B 57/02* (2006.01)
*B65B 13/04* (2006.01)
*B65B 61/26* (2006.01)

(52) U.S. Cl. ..... 53/64; 53/137.2; 53/589

(58) Field of Classification Search ..... 53/64, 53/52, 131.2, 131.5, 582, 137.2, 589
See application file for complete search history.

(56) References Cited

U.S. PATENT DOCUMENTS 4,938,009 A * 7/1990 Takami ..... 53/589

(Continued)

FOREIGN PATENT DOCUMENTS

JP 3041538 7/1997
JP 2002-080012 3/2002

OTHER PUBLICATIONS

International Preliminary Examination Report (PCT/IPEA/409) (translated) issued for PCT/JP2003/010019.

Notification of Transmittal of Copies of Translation of the International Preliminary Examination Report (PCT/IB/338) issued for PCT/JP2003/010019.

*Primary Examiner*—Thanh K. Truong
*Assistant Examiner*—John Paradiso
(74) *Attorney, Agent, or Firm*—Smith, Gambrell & Russell, LLP

(57) ABSTRACT

A common bundling tape (T) to be used for bundling bank notes of different denominations is held in a tape reel (14). A printing mechanism (21) is disposed on a tape feed passage (20) to print the bundling tape (T) with a mark indicating the denomination of bank notes. The printing mechanism (21) prints a mark indicating the denomination of bank notes of a bank note stack (P) on the substantially whole part of the outermost layer of the bundling tape bundling the bank notes when the bundling tape is fed. After winding the printed bundling tape (T) round the bank note stack (P), a tape carrying system (17) is reversed to take up a slack in the bundling tape (T) wound round the bank note stack (P) and tighten the bundling tape (T). Subsequently, a tape cutter (10) cuts off the bundling tape (T) not used for bundling the bank note stack (P) and heat-bonding member (13) heat-bonds together superposed leading and trailing end parts of the bundling tape (T) bundling the bank note stack (P). Then, the leading end of the bundling tape (T) for the next bundling process is moved backward to a print starting position to prepare for the next bundling process.

16 Claims, 17 Drawing Sheets

U.S. PATENT DOCUMENTS 5,121,682 A * 6/1992 Parker et al. ..... 100/26
5,600,934 A * 2/1997 van Rosendal et al. .... 53/139.1
5,890,423 A * 4/1999 Lih ..... 100/26
6,047,526 A * 4/2000 Draghetti ..... 53/443
6,474,041 B1 * 11/2002 Gambetti ..... 53/141
6,668,516 B2 * 12/2003 Sakaki et al. ..... 53/64
6,931,986 B1 * 8/2005 Liu et al. ..... 100/4
2002/0005026 A1 * 1/2002 Neri ..... 53/399
2002/0007616 A1 * 1/2002 Lamamy et al. ..... 53/399
2002/0069613 A1 * 6/2002 Panneri ..... 53/399
2002/0144489 A1 * 10/2002 Hoshino ..... 53/589

* cited by examiner

BANK NOTE BUNDLING MACHINE

TECHNICAL FIELD

The present invention relates to a bank note bundling machine for bundling a bank note stack of a predetermined number of bank notes with a bundling tape and for printing a color indicating the denomination of the bank note on the bundling tape.

BACKGROUND ART

The bank note bundling machine has been used for bundling a bank note stack of a predetermined number of bank notes, generally, one hundred bank notes, with a bundling tape, namely, a wrapper, in a bank note bundle.

The market using the bank note bundling machine trends in recent years toward identifying denominations of bank notes in bank note bundles by colors. To deal with such a trend, tape reels respectively holding bundling tapes of different colors, such as red, yellow, green and such, indicating denominations of bank notes are prepared. When bank notes of a denomination being bundled are changed for those of another denomination, the tape reel holding a bundling tape of a color indicating the former denomination is unloaded from a tape supply unit and the tape reel holding a bundling tape of another color indicating the latter denomination is loaded into the tape supply unit.

Thus the tape reel inevitably needs to be changed when the denomination of bank notes to be bundled is changed. Therefore, the bank note bundling machine is applicable without inconvenience to monetary fields where the denomination is not changed frequently. However, when the bank note bundling machine is applied to monetary fields where denomination is changed frequently, a troublesome tape changing operation needs to be performed frequently and much time is spent for changing the tape reels. Thus the bank note bundling machine has not yet been applied to practical uses in monetary fields where denomination is changed frequently.

The following measures have been devised.

A trial bank note bundling machine was fabricated and tested. A bundling tape capable of being commonly used for bundling bank notes of different denominations and not indicating any particular denomination was loaded into a tape supply unit of the bank note bundling machine. The bundling tape pulled out from the tape supply unit was fed along a tape feed passage to a bank note bundling unit. A printing mechanism capable of printing colors indicating different denominations on a bundling tape was placed on the tape feed passage to print the bundling tape with a color indicating the denomination of bank notes to be bundled by the bundling unit.

The bundling tape for bundling a bank note stack is extended such that a leading end part of the bundling tape projects forward from the terminal end of the tape feed passage in a predetermined phase of a bundling process. The leading end part of the bundling tape is gripped by a tape gripper disposed at a tape gripping position near the terminal end of the tape feed passage. The tape gripper gripping the leading end part of the bundling tape revolves round the bank note stack placed in the bundling unit. A tape feed means placed on the tape feed passage performs a forward feed operation to feed the bundling tape such that the bundling tape has a predetermined slack while the tape gripper is revolving round the bank note stack. Consequently, the bundling tape is wound loosely round the bank note stack. Subsequently, the tape feed means performs a reverse feed operation to wind the bundling tape fast round the bank note stack by taking up the slack.

As obvious from the foregoing description, the length of the bundling tape fed to the bundling unit is very long as compared with the length of the bundling tape needed to bundle the bank note stack.

Therefore, the trial bank note bundling machine prints a part of the bundling tape to be used for bundling bank notes of a denomination different from that of bank notes being presently bundled with a color indicating the denomination of the bank notes being bundled. Therefore, the unused leading part of the bundling tape printed with the color indicating the denomination of the bank notes bundled by the preceding bundling process must be cut off manually with a pair of scissors or the like and an unprinted leading part of the bundling tape needs to be set at the predetermined position on the tape feed passage.

Thus the trial bank note bundling machine requires additional work for cutting off the printed leading part of the bundling tape printed with the color indicating the denomination of the bank notes bundled in the preceding bundling process and for placing the unprinted leading part of the bundling tape at the predetermined position on the tape feed passage.

Even if bank notes of the same denomination are bundled successively, a leading part of the bundling tape printed with a color indicating the denomination of bank notes bundled in the preceding bundling process is printed again with the same color. Consequently, the bundling tape is liable to be printed unsatisfactorily with the color and such unsatisfactory printing spoils the aesthetic appearance of the bundle of bank notes.

DISCLOSURE OF THE INVENTION

The present invention has been made to print a denomination mark indicating the denomination of bank notes to be bundled precisely only on a part of a bundling tape of a length needed to bundle the bank notes, to eliminate a tape changing operation when the denomination of bank notes to be bundled is changed, to achieve a bank note bundling operation efficiently and to prevent perfectly failure in correctly indicating the denomination of bank notes to be bundled.

The present invention provides a bank note bundling machine comprising:

a bank note bundling unit including a bundling space into which a bank note stack is loaded, the bundling unit being configured to bundle the bank note stack loaded into the bundling space with a bundling tape;

a tape reel for holding the bundling tape in a wound state;

a tape feed unit having a tape feed passage, the tape feed unit being configured to feed the bundling tape pulled out from the tape reel to the bundling unit and to extend a part, pulled out at a predetermined time in a tape feed process, of the bundling tape with a leading end part of the bundling tape projecting into the bundling space of the bundling unit;

a tape winding unit provided with a movable tape gripper for gripping the leading end part of the bundling tape projecting from the terminal end of the tape feed passage into the bundling space at a tape gripping position, the tape winding unit being configured to wind the bundling tape round the bank note stack by moving the tape gripper gripping the leading end part of the bundling tape;

a tape carrying mechanism placed on the tape feed passage to perform a forward feed operation to feed the bundling tape forward such that the bundling tape wound round the bank note stack by the tape gripper has a predetermined slack and a reverse feed operation to reverse the bundling tape so that the slack in the bundling tape is taken up and the bundling tape is tightened; and a cutting-and-bonding unit placed in the bundling unit to cut off a trailing end of the tightened bundling tape and heat-bonding the leading end and the trailing end of the bundling tape, characterized in that the tape reel holds a common bundling tape to be used for bundling bank notes of different denominations, the bank note bundling machine further comprises:

a printing mechanism placed in the tape feed passage to print the bundling tape with a color indicating a denomination of bank notes to be bundled; and a controller controlling the tape carrying mechanism and the printing mechanism, and the controller executes:

(a) a first operation for setting the leading end of the bundling tape at a print starting position upstream of a terminal end of the tape feed passage in preparation for bundling the bank note stack loaded into the bundling space and advancing the leading end of the bundling tape upon a start of a bundling process from the print starting position to the tape gripping position in the bundling unit;

(b) a second operation for printing the bundling tape with the color indicating the denomination by the printing mechanism in a tape feed period in which the leading end of the bundling tape is advanced and/or the tape carrying mechanism is in the forward feed operation so that an outermost layer of the bundling tape bundling the bank notes is substantially wholly printable with the color; and (c) a third operation for moving the leading end of the following bundling tape, after cutting off the bundling tape, to the print starting position by the reverse feed operation of the tape carrying mechanism to prepare for the next bundling process.

The 'print start position' is a position where the leading end of the bundling tape is positioned at the start of a printing mode. When the tape is to be printed wholly with a color, the print starting position is near the printing mechanism. When only the outermost layer of the bundling tape bundling bank notes is to be printed with a color, the print starting position is at a predetermined distance from the printing mechanism on the lower side, namely, on the side of the bundling unit. The print starting position may be near the printing mechanism, and the printing mechanism may start its printing operation after the bundling tape has been fed for a predetermined period without printing color on the bundling tape such that only the outermost layer of the bundling tape bundling bank notes is colored. The 'tape gripping position' is a position where the tape gripper stops temporarily and the leading end of the bundling tape projecting into the bundling unit is positioned.

The present invention also provides a bank note bundling machine comprising:

a bank note bundling unit including a bundling space into which a bank note stack is manually loaded, the bundling unit being configured to bundle the bank note stack loaded into the bundling space with a bundling tape;

a tape reel for holding the bundling tape in a wound state;

a tape feed unit having a tape feed passage, the tape feed unit being configured to feed the bundling tape pulled out from the tape reel to the bundling unit and to extend a part, pulled out at a predetermined time in a tape feed process, of the bundling tape with a leading end part of the bundling tape projecting into the bundling space of the bundling unit;

a tape winding unit provided with a movable tape gripper for gripping the leading end part of the bundling tape projecting from the terminal end of the tape feed passage into the bundling space at a tape gripping position, the tape winding unit being configured to wind the bundling tape round the bank note stack by moving the tape gripper gripping the leading end part of the bundling tape;

a tape carrying mechanism placed on the tape feed passage to perform a forward feed operation to feed the bundling tape forward such that the bundling tape wound round the bank note stack by the tape gripper has a predetermined slack and a reverse feed operation to reverse the bundling tape so that the slack in the bundling tape is taken up and the bundling tape is tightened; and a cutting-and-bonding unit placed in the bundling unit to cut off a trailing end of the tightened bundling tape and heat-bonding the leading end and the trailing end of the bundling tape, characterized in that the tape reel holds a common bundling tape to be used for bundling bank notes of different denominations, the bank note bundling machine further comprises:

a printing mechanism placed in the tape feed passage to print the bundling tape with a color indicating a denomination of bank notes to be bundled;

a denomination input unit for inputting automatically or manually the denomination of bank notes to be bundled; and a controller controlling the tape carrying mechanism and the printing mechanism on the basis of the denomination input by the denomination input unit, and the controller executes:

(a) a first operation for placing the leading end of the bundling tape at a print starting position upstream of a terminal end of the tape feed passage in preparation for bundling the bank note stack loaded into the bundling space and advancing the leading end of the bundling tape upon a start of a bundling process from the print starting position to the tape gripping position in the bundling unit;

(b) a second operation for printing the bundling tape with the color indicating the denomination by the printing mechanism in a tape feed period in which the leading end of the bundling tape is advanced and/or the tape carrying mechanism is in the forward feed operation so that an outermost layer of the bundling tape bundling the bank notes is substantially wholly printable with the color; and (c) a third operation for moving the leading end of the following bundling tape, after cutting off the bundling tape, to the print starting position by the reverse feed operation of the tape carrying mechanism to prepare for the next bundling process.

The present invention also provides a bank note bundling machine comprising:

a bank note stacker for stacking a predetermined number of bank notes of a specific denomination in a bank note stack;

a bank note bundling unit including a bundling space into which the bank note stack is loaded from the stacker, the bundling unit being configured to bundle the bank note stack loaded into the bundling space with a bundling tape;

a bank note stack carrying mechanism for carrying a bank note stack prepared by stacking a predetermined number of bank notes in the stacker from the stacker to the bundling unit after the bundling unit has been set ready for a bank note bundling operation;

a tape reel for holding the bundling tape in a wound state;

a tape feed unit having a tape feed passage, the tape feed unit being configured to feed the bundling tape pulled out from the tape reel to the bundling unit and to extend a part, pulled out at a predetermined time in a tape feed process, of the bundling tape with a leading end part of the bundling tape projecting into the bundling space of the bundling unit;

a tape winding unit provided with a tape gripper rotatable about an axis, the tape gripper being configured to grip the leading end part of the bundling tape projecting from the terminal end of the tape feed passage into the bundling space at a tape gripping position, the tape winding unit being configured to wind the bundling tape round the bank note stack by rotating the tape gripper toward and stopping at a bank note stack setting position for allowing the bank note stack to be loaded into the bundling space and rotating the tape gripper so as to wind the bundling tape round the loaded bank note stack;

a tape carrying mechanism placed on the tape feed passage to perform a forward feed operation to feed the bundling tape forward such that the bundling tape wound round the bank note stack by the tape gripper has a predetermined slack and a reverse feed operation to reverse the bundling tape so that the slack in the bundling tape is taken up and the bundling tape is tightened;

a cutting-and-bonding unit placed in the bundling unit to cut off a trailing end of the tightened bundling tape and heat-bonding the leading end and the trailing end of the bundling tape, characterized in that the tape reel holds a common bundling tape to be used for bundling bank notes of different denominations, the bank note bundling machine further comprises:

a printing mechanism placed on the tape feed passage to print the bundling tape with a color indicating a denomination of bank notes to be bundled; and a controller controlling the tape carrying mechanism, the printing mechanism, the winding unit and the cutting-and-bonding unit, and the controller executes:

(a) a first operation for setting the leading end of the bundling tape at a print starting position upstream of a terminal end of the tape feed passage in preparation for bundling the bank note stack loaded into the bundling space and advancing the leading end of the bundling tape upon a start of a bundling process from the print starting position to the tape gripping position in the bundling unit;

(b) a second operation for printing the bundling tape with the color indicating the denomination by the printing mechanism in when the leading end of the bundling tape is advanced and/or when the tape feed unit is in the forward feed operation so that an outermost layer of the bundling tape bundling the bank note stack is substantially wholly printable with the color; and (c') a third operation for moving the leading end of the following bundling tape to the print starting position by the reverse feed operation of the tape carrying mechanism to prepare for the next bundling process, after rotating the tape gripper from the tape gripping position to the bank note setting position, loading the bank note stack into the bundling space, bundling the bank note stack with the bundling tape by the tape winding unit, tightening the bundling tape bundling the bank note stack and cutting off the tightened bundling tape.

In the bank note bundling machine of the present invention, the tape carrying mechanism may be any suitable carrying mechanism, such as a roller mechanism, a belt mechanism or a combination of a roller mechanism and a belt mechanism. The tape carrying mechanism may employ a reversible roller or may employ a forward feed roller interlocked with a drive shaft with a one-way clutch such that the forward feed roller does not rotate when the drive shaft rotates in the reverse direction and a reverse feed roller interlocked with a drive shaft with a one-way clutch such that the reverse feed roller does not rotate when the drive shaft rotates in the forward direction.

The present invention also provides a bank note bundling machine comprising:

a plurality of bank note stackers each for stacking a predetermined number of bank notes of a specific denomination in a bank note stack;

a bank note bundling unit including a bundling space into which the bank note stack is loaded from one of the stackers, the bundling unit being configured to bundle the bank note stack loaded into the bundling space with a bundling tape;

a bank note stack carrying mechanism for holding a bank note stack prepared by stacking a predetermined number of bank notes by at least one of the stackers and carrying the bank note stack from the stacker to the bundling unit after the bundling unit has been set ready for a bank note bundling operation;

a tape reel for holding the bundling tape in a wound state;

a tape feed unit having a tape feed passage, the tape feed unit being configured to feed the bundling tape pulled out from the tape reel to the bundling unit and to extend a part, pulled out at a predetermined time in a tape feed process, of the bundling tape with a leading end part of the bundling tape projecting into the bundling space of the bundling unit;

a tape winding unit provided with a tape gripper rotatable about an axis, the tape gripper being configured to grip the leading end part of the bundling tape projecting from the terminal end of the tape feed passage into the bundling space at a tape gripping position, the tape winding unit being configured to wind the bundling tape round the bank note stack by rotating the tape gripper toward and stopping at a bank note stack setting position for allowing the bank note stack to be loaded into the bundling space and rotating the tape gripper so as to wind the bundling tape round the loaded bank note stack;

a tape carrying mechanism placed on the tape feed passage to perform a forward feed operation to feed the bundling tape forward such that the bundling tape wound round the bank note stack by the tape gripper has a predetermined slack and a reverse feed operation to reverse the bundling tape so that the slack in the bundling tape is taken up and the bundling tape is tightened;

a cutting-and-bonding unit placed in the bundling unit to cut off a trailing end of the tightened bundling tape and heat-bonding the leading end and the trailing end of the bundling tape, characterized in that the tape reel holds a common bundling tape to be used for bundling bank notes of different denominations, the bank note bundling machine further comprises:

a printing mechanism placed in the tape feed passage to print the bundling tape with a color indicating a denomination of bank notes to be bundled, a controller controlling the tape carrying mechanism, the printing mechanism, the tape winding unit and the cutting-and-bonding unit, upon a completion of stacking a predetermined number of bank notes in at least one of the stackers and a setting of the bundling unit ready for bundling the bank note stack, and the controller executes:

(a) a first operation for setting the leading end of the bundling tape at a print starting position upstream of a terminal end of the tape feed passage in preparation for bundling the bank note stack loaded into the bundling space and advancing the leading end of the bundling tape upon a start of a bundling process from the print starting position to the tape gripping position in the bundling unit;

(b) a second operation for printing the bundling tape with the color indicating the denomination by the printing mechanism when the leading end of the bundling tape is advanced and/or when the tape feed unit is in the forward feed operation so that an outermost layer of the bundling tape bundling the bank note stack is substantially wholly printable with the color; and (c') a third operation for moving the leading end of the following bundling tape to the print starting position by the reverse feed operation of the tape carrying mechanism to prepare for the next bundling process, after rotating the tape gripper from the tape gripping position to the bank note setting position, loading the bank note stack into the bundling space, bundling the bank note stack with the bundling tape by the tape winding unit, tightening the bundling tape bundling the bank note stack and cutting off the tightened bundling tape.

In each of the foregoing bank note bundling machines of the present invention, the printing mechanism may comprise: a rotating disk rotatably supported opposite to one of opposite surfaces of the bundling tape extended along the tape feed passage; a plurality of color stamping rollers, respectively for printing the bundling tape with different colors, arranged on a common circle on and rotatably supported on the rotating disk; and an impression cylinder supported for movement toward and away from the tape feed passage, the impression cylinder being configured to press the bundling tape against one of the color stamping rollers disposed opposite to one of the surfaces of the bundling tape extended along the tape feed passage.

The printing mechanism may be an ink-jet printer. A denomination mark printed by the printing mechanism may be any suitable indication, such as a continuous color line, an intermittent color line, a character or a pattern.

The bank note bundling machine of the present invention prints a denomination mark indicating the denomination of the bank notes of a bank note stack to be bundled on the bundling tape immediately before bundling the bank note stack with the bundling tape. Therefore, the bundling tape does not need to be changed when the bank notes to be bundled is changed. Thus the present invention is applicable to a hand-feed bank note bundling machine to which bank note stacks are fed manually or an automatic bank note bundling machine capable of sorting bank notes of different denominations by denomination and counting the sorted bank notes. The bank note bundling machine of the present invention is capable of efficiently achieving operations for printing a denomination mark and bundling bank notes.

A denomination mark can be printed on only a length of a bundling tape sufficient for bundling a bank note stack when the bundling tape is used for bundling the bank note stack. Therefore, a denomination mark indicating the denomination of the bank notes bundled in the preceding bundling process will not be printed on the bundling tape to be used for bundling bank notes in the succeeding bundling process. Consequently, the denomination of the bank notes of a bundled bank note stack can be clearly indicated.

BEST MODE FOR CARRYING OUT THE INVENTION

Preferred embodiments of the present invention will be described with reference to the accompanying drawings.

Figure 1:
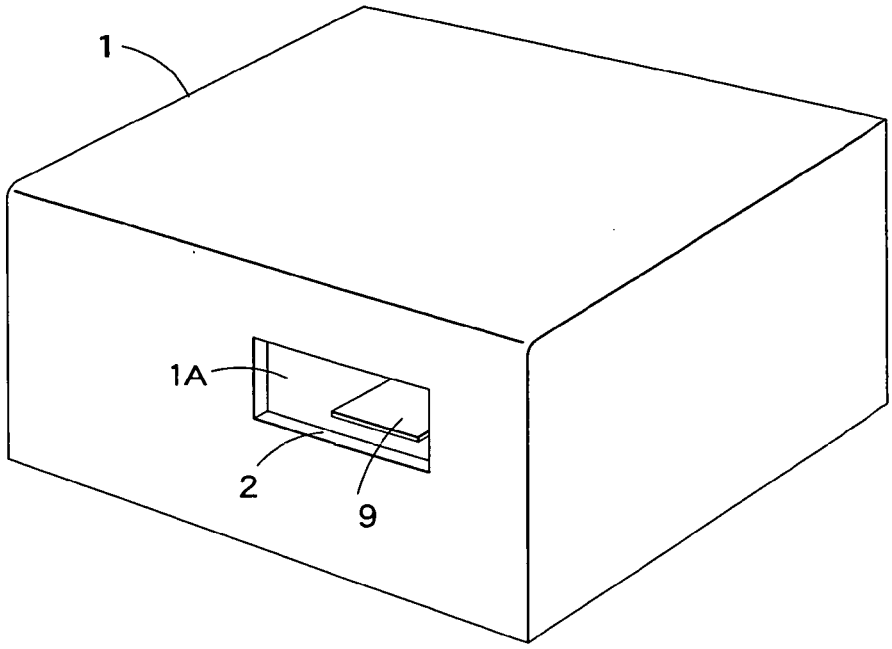
FIG. 1 is a perspective view of a bank note bundling machine in a first embodiment according to the present invention.
Figure 2:
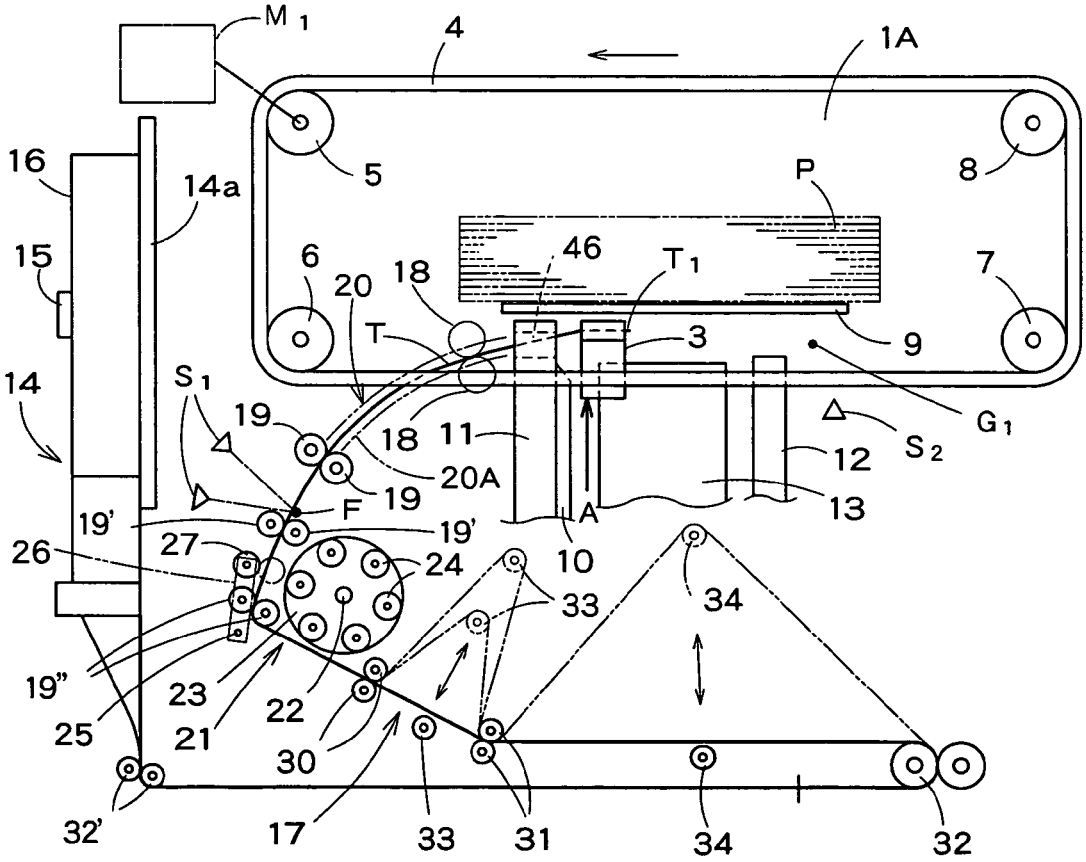
FIG. 2 is a schematic front elevation of a functional structure included in the bank note bundling machine shown in FIG. 1.

FIGS. 1 to 14 show a bank note bundling machine in a first embodiment according to the present invention. FIG. 1 is a perspective view of the bank note bundling machine and FIG. 2 is a schematic front elevation of a functional structure included in the bank note bundling machine. As shown in FIG. 1, a generally flat case 1 is provided with a laterally long opening 2. A bank note stack P to be bundled is inserted longitudinally through the opening 2 into the case 1 by hand.

A bank note bundling unit $G_1$ winds a bundling tape T round the bank note stack P. A tape gripper (hereinafter, referred to simply as "gripper") 3 grips an end part of a bundling tape T and winds the bundling tape T round the bank note stack P. A gripper turning mechanism for turning the gripper 3 includes an endless belt 4. The endless belt 4 is a time belt. The endless belt 4 is extended around four toothed pulleys 5, 6, 7 and 8 in the case 1 behind the opening 2. A reversible motor $M_1$ (one of motors $M_x$ shown in FIG. 15) operates for a forward drive operation to turn the endless belt 4 in the direction of the arrow shown in FIG. 2.

A support table 9 is disposed in a bundling space 1A surrounded by the endless belt 4. The bank note stack P is supported in a horizontal position on the support table 9 with the long side extended in a direction perpendicular to the paper in FIG. 2. The support table 9 is a thin metal plate, such as a stainless steel plate or the like and is one size smaller than the bank note stack P. The support table 9 is provided on its bottom with a stopper, not shown, for determining a longitudinal position for the bank note stack P with respect to a longitudinal direction on the support table 9, and a positioning plate, not shown, for determining a lateral position for the bank note stack P with respect to a lateral direction on the support table 9.

The gripper 3 for gripping an end part of the bundling tape T is supported on the endless belt 4. The gripper 3 is moved along a turning path surrounding the bundling space 1A.

The gripper 3, the endless belt 4 and a gripper operating mechanism for operating the gripper 3 constitute a tape winding unit.

Figure 3:
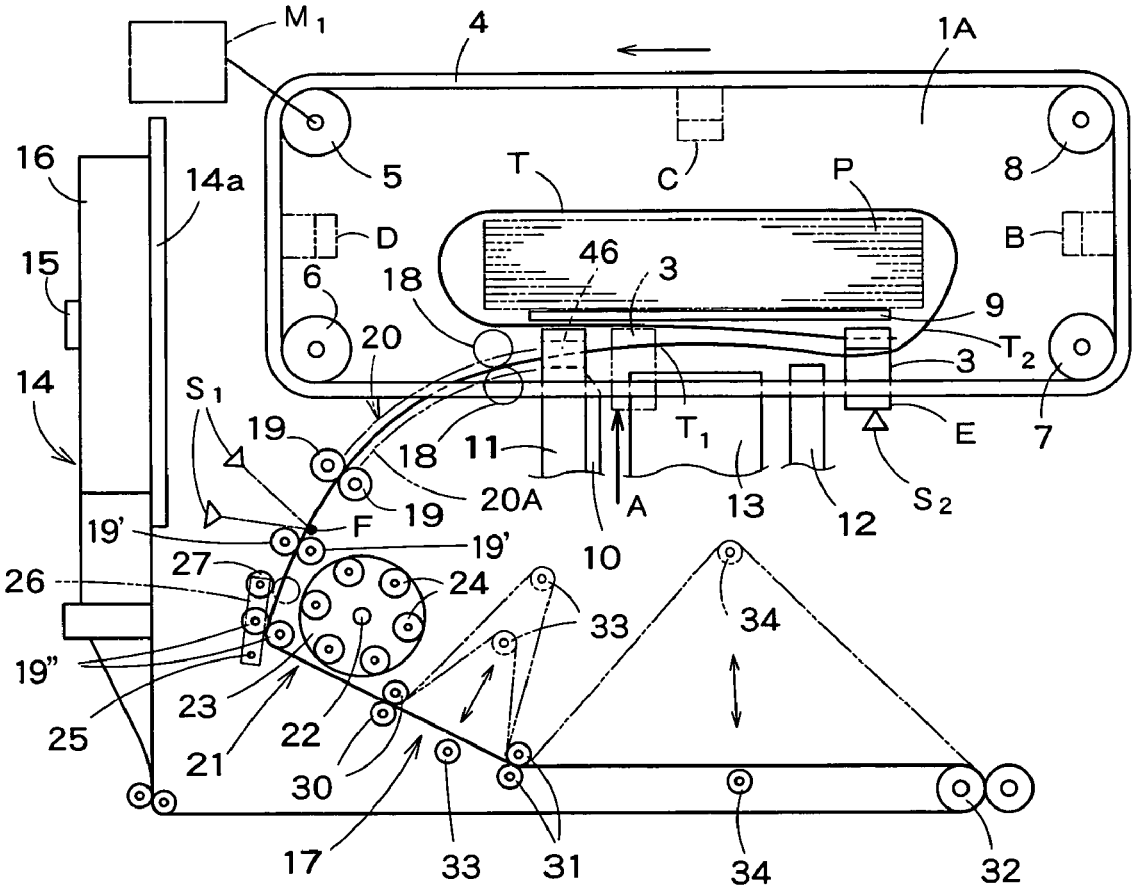
FIG. 3 is a schematic front elevation of the bank note bundling machine shown in FIG. 1 in a bank note bundling operation.

As typically shown in FIGS. 2 and 3, a first pressing member 11 and a second pressing member 12 movable toward and away from the lower surface of the support table 9 are disposed under the support table 9. The first pressing member 11 and the second pressing member 12 press two parts of the bundling tape T against the lower surface of the support table 9.

A tape cutter 10 is extended along a side surface of the first pressing member 11, and a heat-bonding member 13 is disposed between the tape cutter 10 and the second pressing member 12. The tape cutter 10 and the heat-bonding member 13 can be moved toward and away from the lower surface of the support table 9.

The bundling unit $G_1$ is thus constituted.

A tape reel 14 for sending out and tightening the bundling tape T is disposed on the outer side of the endless belt 4. The tape reel 14 includes a rotating plate supported for rotation, and a shaft 15 projecting from the center of the rotating plate 14*a*. The shaft 15 is fitted in a center hole formed in a tape reel 16 to support the tape reel 16 with its end surface in contact with the rotating plate 14*a*. A tape carrying system 17 provided with guide rollers feeds the bundling tape T unwound from the tape reel 16 to the gripper 3. A pair of rollers 18 disposed at the terminal end of a tape feed passage 20 delivers the leading end of the bundling tape T to the gripper 3 held at a predetermined position. The tape carrying system 17 and the tape feed passage 20 will be described later.

A printing mechanism 21 is disposed at a position corresponding to a middle section of the tape carrying system 17.

Figure 4:
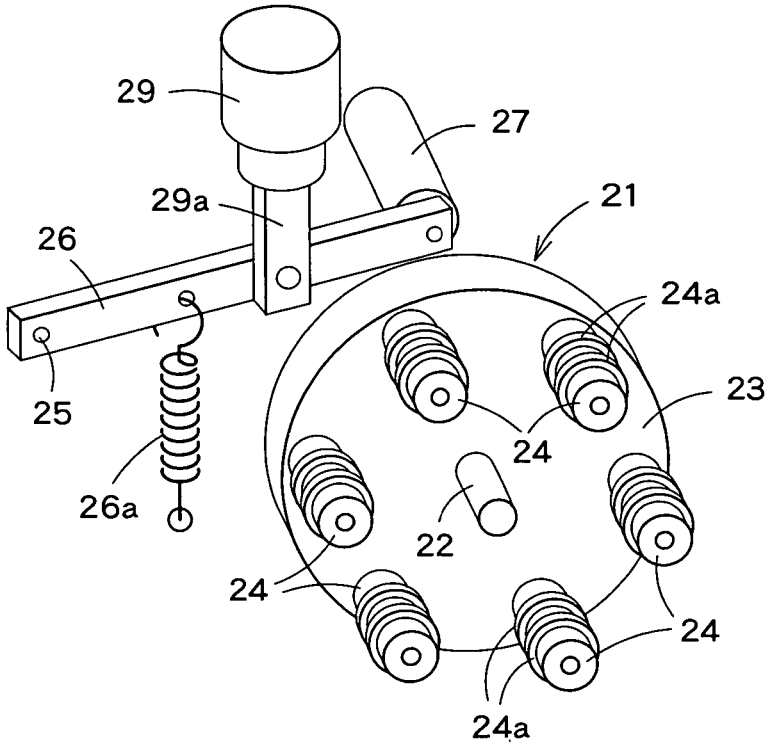
FIG. 4 is a perspective view of a printing mechanism included in the bank note bundling machine shown in FIG. 1.
Figure 5:
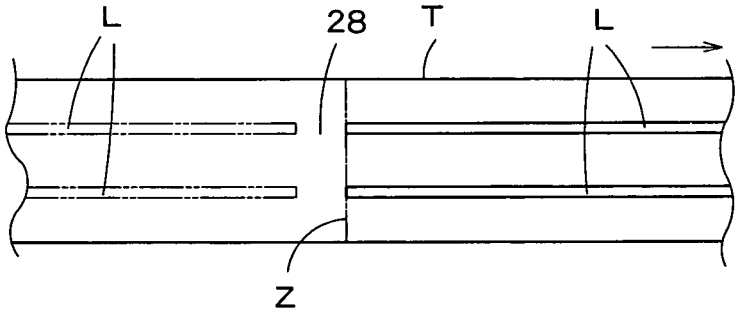
FIG. 5 a plan view of a bundling tape printed with a denomination mark by the printing mechanism shown in FIG. 4.

Referring to FIGS. 4 and 5, the printing mechanism 21 includes a rotating disk 23 supported for rotation on a shaft 22, a plurality color stamping rollers 24, six color stamping rollers 24 in this embodiment, respectively for printing different colors rotatably supported on one side surface of the rotating disk 22 at positions on a circle for revolution, an impression roller 27 for pressing the bundling tape T passing the middle section against one of the color stamping rollers 24 at a printing position, and a swing arm 26 supported for a swing motion on a shaft 25.

Each of the color stamping rollers has two annular ridges 24*a*. The bundling tape T is pressed against the color stamping roller 24 by the impression cylinder 27 to print the bundling tape T with two color lines L indicated by continuous lines in FIG. 5. After a length of the bundling tape T necessary for bundling one bank note stack P is printed with the two color lines L, the impression cylinder 27 is separated from the bundling tape T. Thus a blank 28 is formed between two preceding color lines L and two succeeding color lines L.

The bundling tape T is cut by the tape cutter 10 along a cutting line Z shown in FIG. 5 after the bundling tape T printed with the two color lines L has been wound tightly round the bank note stack R The leading end of the bundling tape T is at a position indicated by the line Z in the following bundling process. The line Z corresponds to the position of a sensor $S_1$. The two succeeding color lines L indicated by chain lines in FIG. 5 are printed backward from a position behind the leading end indicated by the line Z by a distance corresponding to the length of the blank 28. The length of the blank 28 corresponds to the distance between the sensor $S_1$ and the impression cylinder 27.

In this embodiment, a print terminating position, namely, the position indicated by the line Z, and a print starting position are spaced by the blank 28. The blank 28 does not cause any problem because the length of the bundling tape T wound round the bank note stack P is sufficient for winding the bundling tape T by 1.3 turns round the bank note stack P and the blank 28 is included in a length of the bundling tape T capable of being wound round the bank note stack P by two turns.

When necessary, the leading end of the bundling tape T may be moved backward from the position corresponding to the sensor $S_1$ to a position corresponding to the impression cylinder 27 before starting a printing operation to start printing the succeeding color lines L from the leading end of the bundling tape T indicated by the line Z shown in FIG. 5.

In the bundling process, the very long blank 28 is formed behind the line Z (FIG. 5) before the bundling tape T is cut. The length of the blank 28 is reduced before starting printing for the next bundling process when the bundling tape T is pulled back, i.e., is pulled to the left as viewed in FIG. 5, to bundle fast the bank note stack P.

A plunger 29*a* included in a solenoid actuator 29 is connected to a middle part of the swing arm 26 to move the impression cylinder 27 toward and away from the bundling tape T. The solenoid of the solenoid actuator 29 is de-energized to advance the impression cylinder 27 is toward the bundling tape T by the resilience of an extension spring. The solenoid of the solenoid actuator 29 is energized to retract the impression cylinder 27.

The tape carrying system 17 includes rollers 18, 19, 19', 19", 30, 31, 32, 32', 33 and 34 arranged in that order in a direction in which the bundling tape T is fed.

The rollers 18, 19, 19', 19", 30 and 31 rotate at the same circumferential speed and are controlled for forward rotation or reverse rotation by a drive command signal. The rollers 32 and 32' are supported on shafts by one-way clutches, respectively, such that the those rollers rotate at a circumferential speed equal to that of the rest of the rollers only for forward rotation and those rollers are restrained from reverse rotation by the one-way clutches.

The rollers 33 and 34 are free tension rollers disposed between the rollers 30 and 31 and between the rollers 31 and 32, respectively. Those tension rollers 33 and 34 are movable in the directions of the arrows to take up a slack introduced into the bundling tape T when the bundling tape T is fed when the bundling tape T is moved backward and to take up the slack of the bundling tape T when the bundling tape T is moved backward after cutting.

The tension rollers 33 and 34 are supported by moving mechanisms, not shown, so as to take up a slack corresponding to a length of the bundling tape T moved backward by the rollers 18, 19, 19', 19" and 30 to tighten the bundling tape T. When the bundling tape T is fed for the next bundling process, the tension rollers 33 and 34 are returned to positions indicated by continuous lines in FIG. 2.

The rollers 18, 19, 19', 19", 30 31, 32 and 32' are driven by motors $M_x$ (FIG. 15), respectively, in the following mode.

The rollers 18, 19 and 19' are interlocked through first electromagnetic clutches, not shown, with the motors $M_x$, respectively. The rollers 19", 30, 31, 32 and 32' are interlocked through second electromagnetic clutches, not shown, with the motors $M_x$, respectively. The rollers 18, 19, 19', 19", 30, 31, 32 and 32' are driven in a printing mode. When the motors $M_x$ operate for forward driving and reverse driving in a nonprinting mode, the first and second electromagnetic clutches are engaged simultaneously.

When the printing mechanism 21 is in the printing operation in the printing mode, the impression cylinder 27 bends a part, corresponding to the impression cylinder 27, of the bundling tape T, the rollers 19", 30, 31, 32 and 32' need to feed a predetermined length of the bundling tape T to slacken the bundling tape T with the rollers 18, 19 and 19' stopped.

Therefore, when the impression cylinder 27 presses the bundling tape T against the color stamping roller 24, the motors $M_x$ are driven and the second electromagnetic clutches are engaged to make the rollers 19", 30, 31, 32 and 32' feed a predetermined length of the bundling tape T and the impression cylinder 27 presses the bundling tape T against the color stamping roller 24.

Subsequently, the first electromagnetic clutches are engaged to drive the rollers 18, 19 and 19' for forward rotation at a circumferential speed equal to that of the rollers 19", 30 31, 32 and 32' to feed the bundling tape T. After a length of the bundling tape T for bundling one bank note stack has been printed with color lines and the impression cylinder 27 has been separated from the bundling tape T, the slack of the bundling tape T must be taken up to tighten the bundling tape T.

Therefore, the second electromagnetic clutches are disengaged temporarily simultaneously with the separation of the impression cylinder 27 from the bundling tape T to stop temporarily the rollers 19", 30, 31, 32 and 32' while the motors $M_x$ are driven and the first electromagnetic clutches are engaged to drive the rollers 18, 19 and 19' for forward rotation.

Consequently, a slack introduced into the bundling tape T by separating the impression cylinder 27 from the bundling tape T is taken up and the bundling tape T is tightened. Upon the tightening of the bundling tape T, the second electromagnetic clutches are engaged drive the rollers 19", 30, 31, 32 and 32' for forward rotation at a circumferential speed equal to that of the rollers 18, 19 and 19' to continue feeding the bundling tape T.

The feed of the bundling tape T is stopped temporarily upon the insertion of the leading end of the bundling tape T in the opened gripper 3 to make the gripper 3 grip the leading end of the bundling tape T. The motors $M_x$ are driven continuously and the first and second electromagnetic clutches are disengaged temporarily to stop temporarily the rollers 18, 19, 19', 19", 30, 31, 32 and 32'.

At the same time, the impression cylinder 27 is separated from the bundling tape T to prevent the spread of the ink on the bundling tape T because the ink will spread if the impression cylinder 27 keeps pressing the bundling tape T against the color stamping roller 24 while the bundling tape T is stopped.

Upon the separation of the impression cylinder 27 from the bundling tape T, a part, corresponding to the impression cylinder 27, of the bundling tape T slackens. When the impression cylinder 27 is advanced subsequently toward the bundling tape T and the first and second electromagnetic clutches are engaged, the rollers 18, 19, 19', 19", 30, 31, 32 and 32' are driven for forward rotation because the motors $M_x$ are operating continuously.

The first and second electromagnetic clutches may be simultaneously disengaged when the gripper 3 grips the leading end of the bundling tape T and may be simultaneously engaged when the bundling tape T is fed after the gripper has gripped the leading end of the bundling tape T.

The following description will be made on an assumption that the printing operation is started upon the start of the forward rotation of the rollers 18 and the pressing of the bundling tape T against the color stamping roller 24 by the impression cylinder 27, and the printing operation is ended upon the separation of the impression cylinder 27 from the bundling tape T.

The tape carrying system 17 corresponds to the tape feed unit and the tape carrying mechanism of the present invention.

A guide structure 20A is extended along the tape feed passage between a position behind the rollers 30 and a position right behind the rollers 18, namely, a position right in front of the first pressing member 11. Only a part of the guide structure 20A between a position right behind the rollers 19 and the position right behind the rollers 18 is shown in FIG. 2. The tape carrying system 17 includes tape feed passage 20 defined by the guide structure 20A and the first pressing member 11, and provided with the sensor $S_1$. The terminal end of the tape feed passage 20 corresponds to the right side surface, as viewed in FIG. 2, along which the tape cutter 10 slides, of the first pressing member 1.

The sensor $S_1$ is disposed between the rollers 19' and the rollers 19 to detect the bundling tape T.

Figure 6:
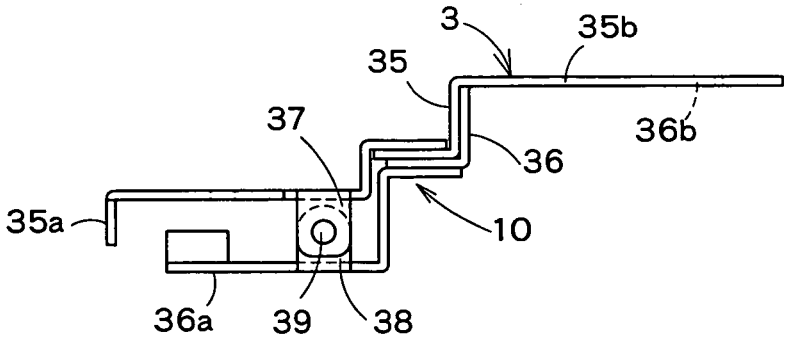
FIG. 6 is a side elevation of a tape gripper shown in FIG. 2.
Figure 7:
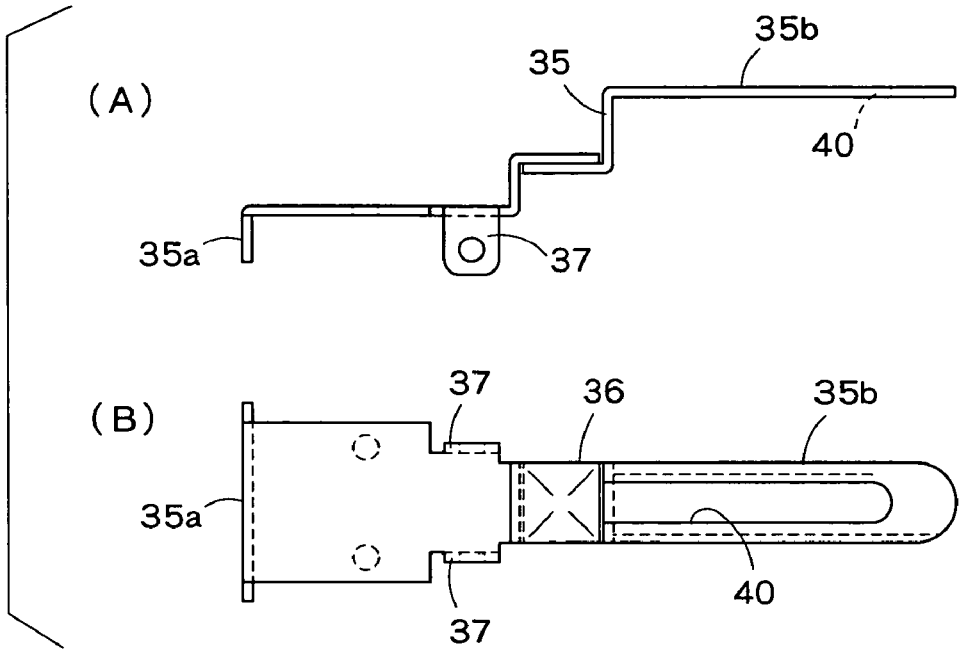
FIG. 7 shows a side elevation (A) and a plan view (B), respectively, of a first gripping member included in the tape gripper shown in FIG. 6.
Figure 8:
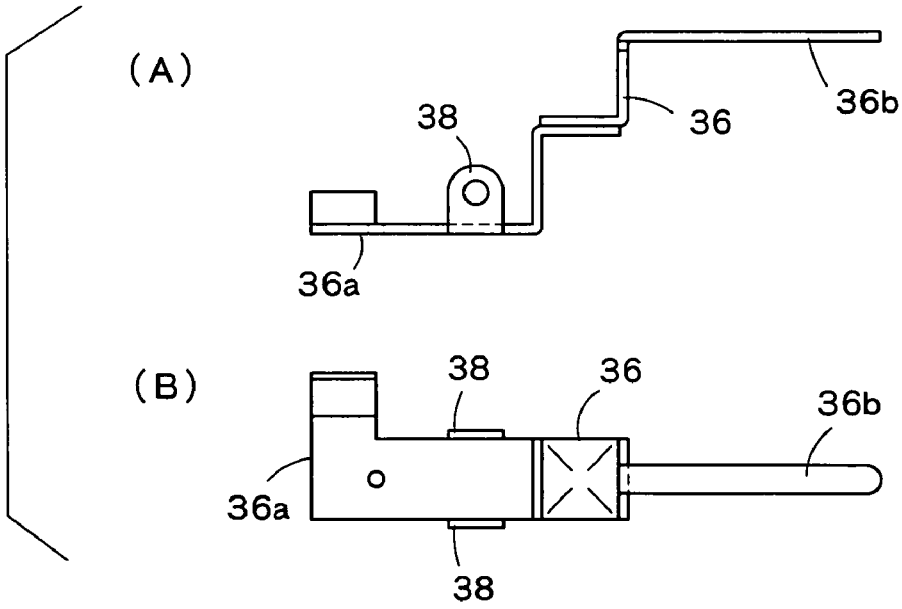
FIG. 8 shows a side elevation (A) and a plan view (B), respectively, of a second gripping member included in the tape gripper shown in FIG. 6.

Referring to FIGS. 6 to 8, the gripper 3 resembling a pair of scissors includes a first gripping member 35 and a second gripping member 36 respectively having support parts 37 and 38, a pivot 39 inserted in holes formed in the support parts 37 and 38 and pivotally supporting the support parts 37 and 38. The first gripping member 35 has a base part 35*a* fastened to the endless belt 4. The first gripping member 35 and the second gripping member 36 have gripping parts 35*b* and 36*b*, respectively. The gripping parts 35*b* and 36*b* project into the bundling space 1A perpendicularly to the endless belt 4.

The gripping part 35*b* of the first gripping member 35 is provided with a longitudinal slot 40 as shown in FIG. 7. The gripping part 36*b* of the second gripping member 36 is formed in a long, narrow shape as shown in FIG. 8 so as to be fitted as closely as possible in the slot 40. A gripped part of the bundling tape T gripped between the gripping parts 35*b* and 36*b* is bent in a U-shape so that the gripped part may not slip off the gripping parts 35*b* and 36*b*. Opposite ends of a spring, not shown, are engaged with the first gripping member 35 and the second gripping member 36 to keep the gripper 3 closed with the first gripping member 35 and the second gripping member 36 joined together.

Figure 9:
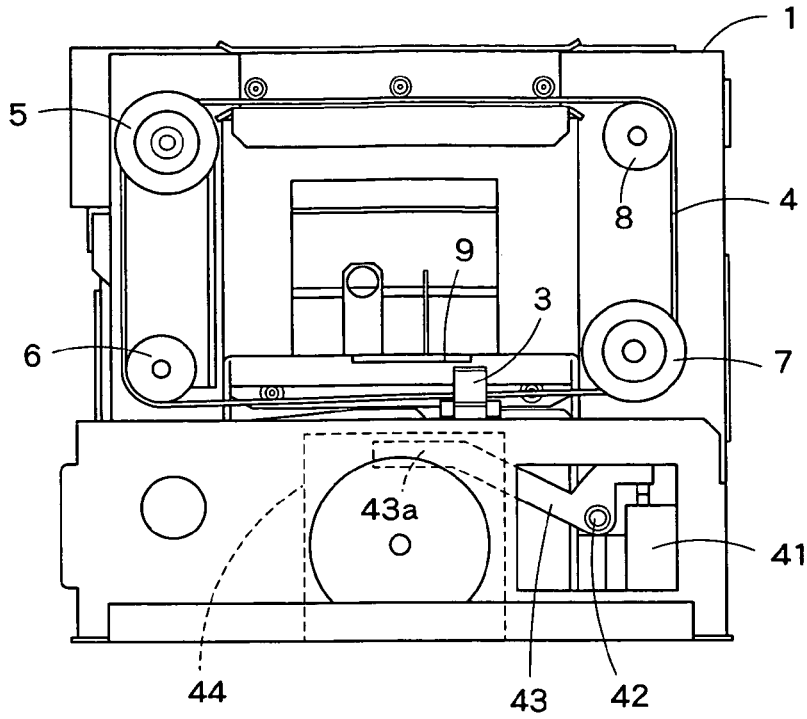
FIG. 9 is a front elevation of the actual mechanisms of the functional structure shown in FIG. 2.
Figure 10:
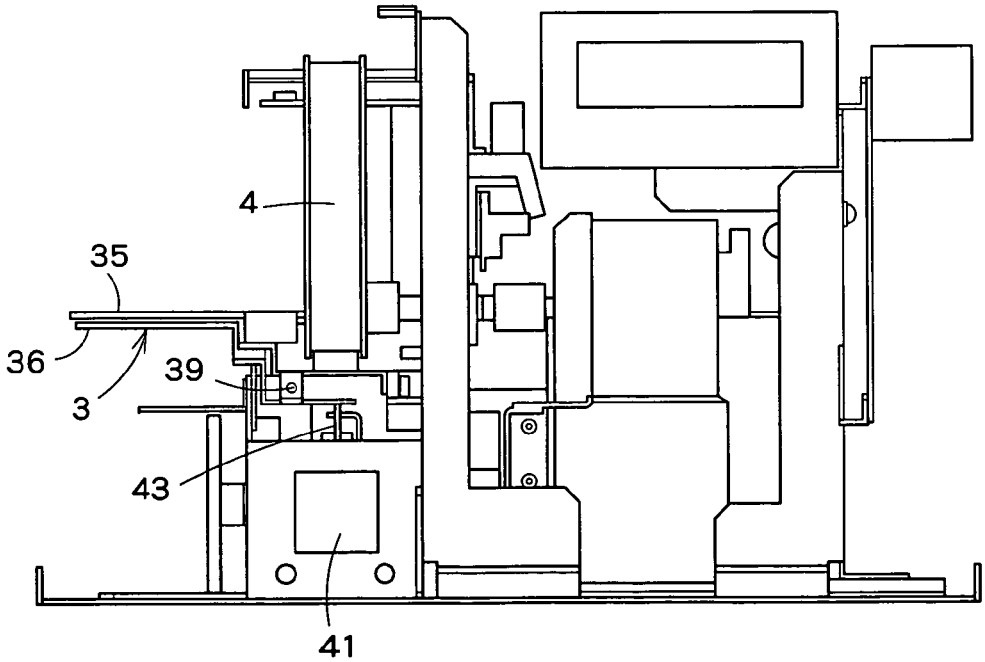
FIG. 10 is a side elevation of the actual mechanisms of the functional structure shown in FIG. 2.

Referring to FIG. 9, a gripper operating mechanism for operating the gripper 3 includes a solenoid actuator 41, a swing lever 43 having a horizontal end part 43*a*, and a shaft 43 supporting the swing lever 43. When the solenoid of the solenoid actuator 41 is energized, the end part 43*a* of the swing lever 43 comes into contact with the lower surface of a base part 36*a* of the second gripping member 36 of the gripper 3 to push the base part 36*a*. Consequently, the gripping part 36*b* turns downward away from the gripping part 35*b* to open the gripper 3. When the solenoid of the solenoid actuator 41 is de-energized, the gripping part 36*b* of the second gripping member 36 is turned upward by the spring so that the gripping part 36*b* engages with the gripping part 35*b* of the first gripping member 35 to grip the bundling tape T between the gripping parts 35*b* and 36*b*.

The gripper 3 is closed when the gripper 3 is at its home position A, namely, a position shown in FIG. 2, and the gripper 3 is opened when the gripper 3 is at a stopping position E, namely, a position shown in FIG. 3.

Figure 11:
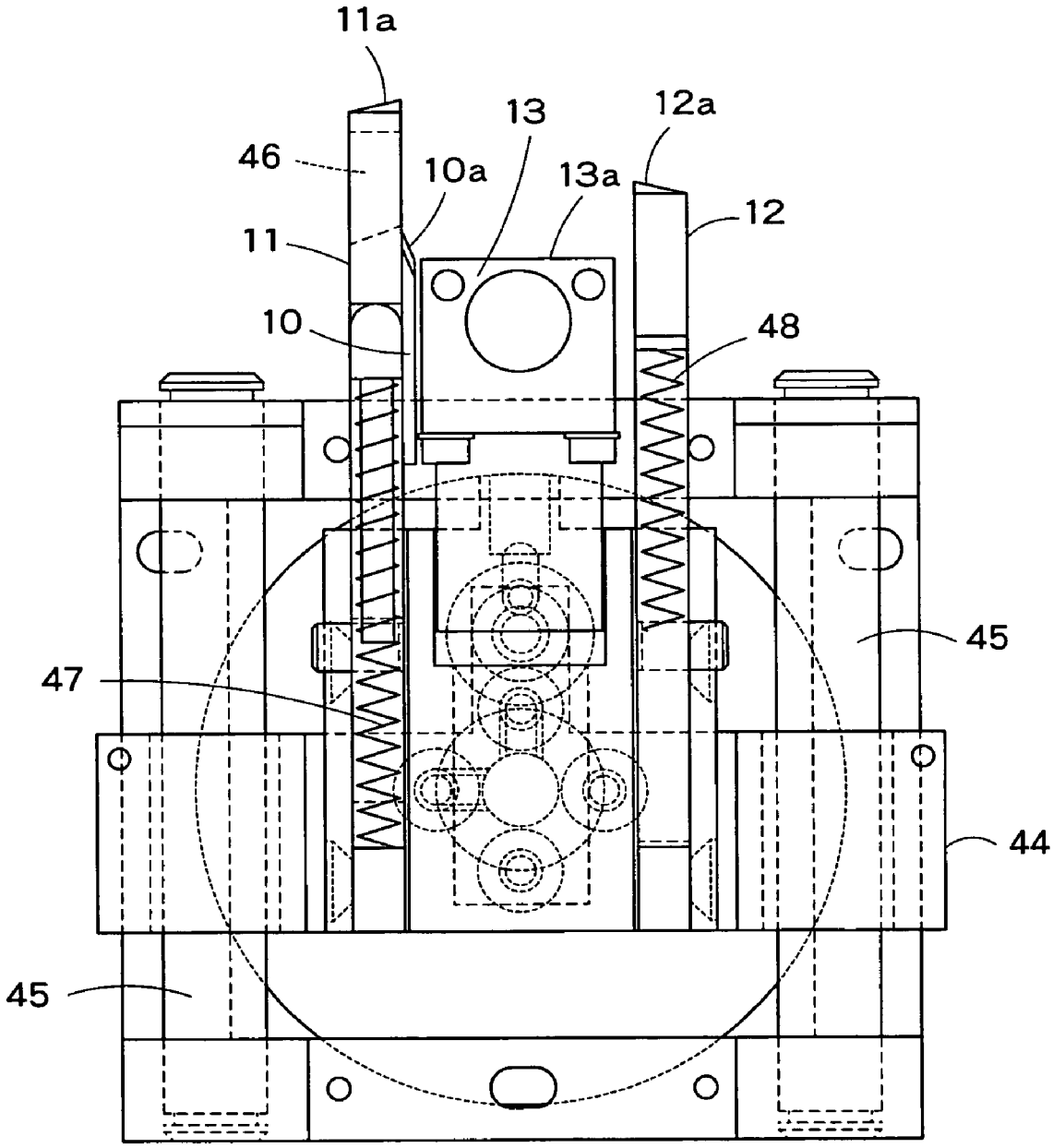
FIG. 11 is a front elevation of a moving frame shown in FIG. 9.

As shown in FIG. 11, the first pressing member 11, the second pressing member 12, the tape cutter 10 and the heat-bonding member 13 are mounted individually movably on a moving frame 44 capable of moving toward and away from the back surface of the support table 9.

The moving frame 44 is guided for vertical movement by two guide rods 45 set upright in the case 1. The moving frame 44 is moved vertically in a predetermined range by a lifting mechanism, not shown, including a cam and driven by one of the motors $M_x$ shown in FIG. 15.

The first pressing member 11 is on the left side of the gripper 3 at the home position A, and the second pressing member 12 is on the right side of the gripper 3 at the home position A. As shown in FIG. 11, the upper end 11*a* of the first pressing member 11 is at a height slightly higher than that of the upper end 12*a* of the second pushing member 12. The first pushing member 11 is provided with an opening 46 in a part near the upper end 11*a*. The bundling tape T is passed through the opening 46. Compression springs 47 and 48 in contact with the lower ends of the first pushing member 11 and the second pushing member 12 push the first pushing member 11 and the second pushing member 12 resiliently upward such that the compression springs 47 and 48 are compressed so as to allow the first pushing member 11 and the second pushing member 12 to be moved downward in a state where the upper ends 11*a* and 12*a* are in contact with the bundling tape T extending under the support table 9.

Figure 13:
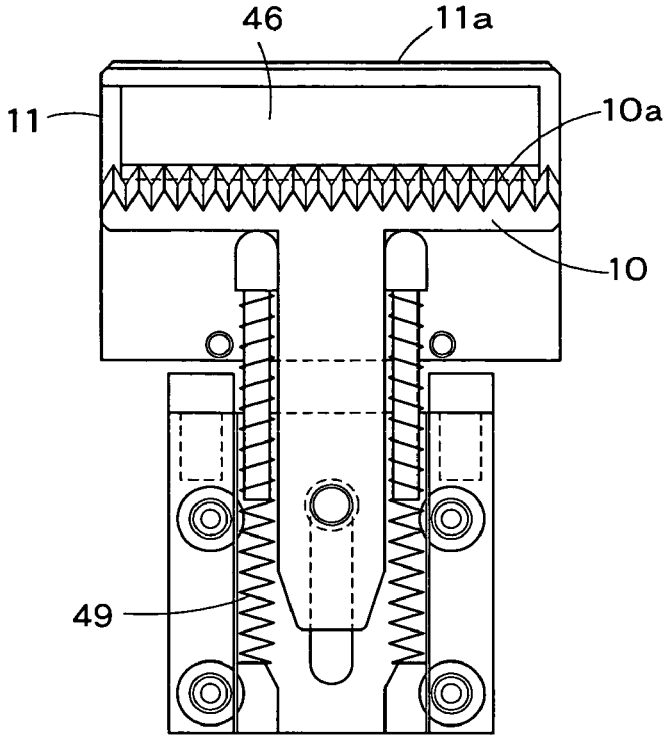
FIG. 13 is a side elevation of a first pressing member and a cutting device shown in FIGS. 11 and 12.
Figure 14:
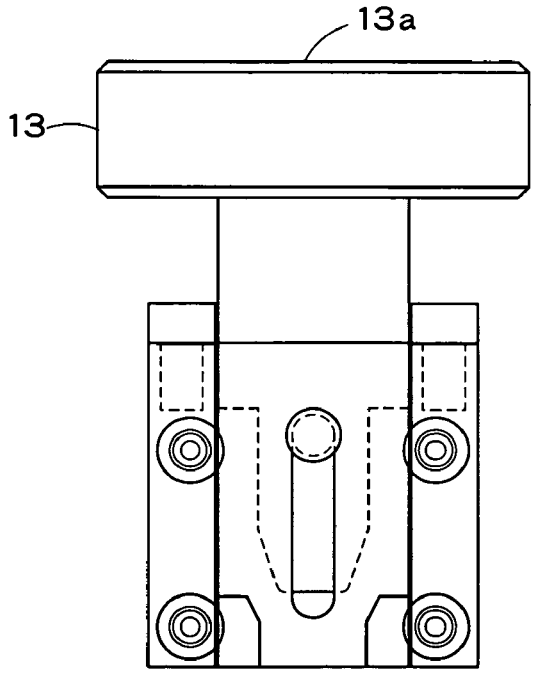
FIG. 14 is a front elevation of a cutting-and-bonding device.

The tape cutter 10 is able to slide vertically along the right side surface, as viewed in FIG. 2, of the first pressing member 11. As shown in FIG. 13, the tape cutter 10 has a saw-toothed edge 10*a* on the side of the first pushing member 11. When the tape cutter 10 is retracted, the edge 10*a* is positioned near the lower side of the opening 46. The tape cutter 10, similarly to the pushing members 11 and 12, is pushed resiliently upward by compression springs 49 so as to be vertically movable.

The heat-bonding member 13 has a built-in heater in its part near its pressing surface 13*a* to heat the pressing surface 13*a*. The heat-bonding member 13 is held with the pressing surface 13*a* slightly below the level of the cutting edge 10*a* of the tape cutter 10. The heat-bonding member 13, similarly to the tape cutter 10, is pushed upward by a compression spring, not shown.

The respective strokes of the pressing members 11 and 12*m*, the tape cutter 10 and the heat-bonding member 13 are determined by slots and pins engaged in the slots, respectively.

As the moving frame 44 shown in FIGS. 9 and 11 is raised by the lifting mechanism for a heat-bonding cycle, first the upper end 11*a* of the first pressing member 11 comes into contact with the bundling tape T extending under the support table 9. As the moving frame 44 is raised further, the compression springs 47 are compressed and the first pressing member 11 lowers relative to the moving frame 44. Secondly the upper end 12*a* of the second pressing member 12 comes into contact with the bundling tape T. Consequently, parts of the bundling tape T at the opposite ends of a predetermined bonding range in which parts, to be bonded together by heat-bonding, of the bundling tape T are superposed in two layers, are pressed against the lower surface of the support table 9. Thirdly the cutting edge 10*a* of the tape cutter 10 is pressed into the bundling tape T and then the heat-bonding member 13 is pressed against the bonding range. After the heat-bonding cycle has been thus completed, the moving frame 44 is lowered to its home position. Consequently, the pressing members 11 and 12, the tape cutter 10 and the heat-bonding member 13 are returned to their home positions by the compression springs, respectively.

Referring to FIGS. 2 and 3, a bank note stack sensor $S_2$ is disposed under to the lower surface of the support table 9 opposite to a through hole, not shown, formed in the support table 9. The bank note stack sensor $S_2$ detects a bank note stack P set at a predetermined position defined by the stopper and the positioning plate on the support table 9 through the through hole. The bank not stack sensor $S_2$ is capable of finding the denomination of the bank notes of the bank note stack P supported in place on the support table 9.

Figure 15:
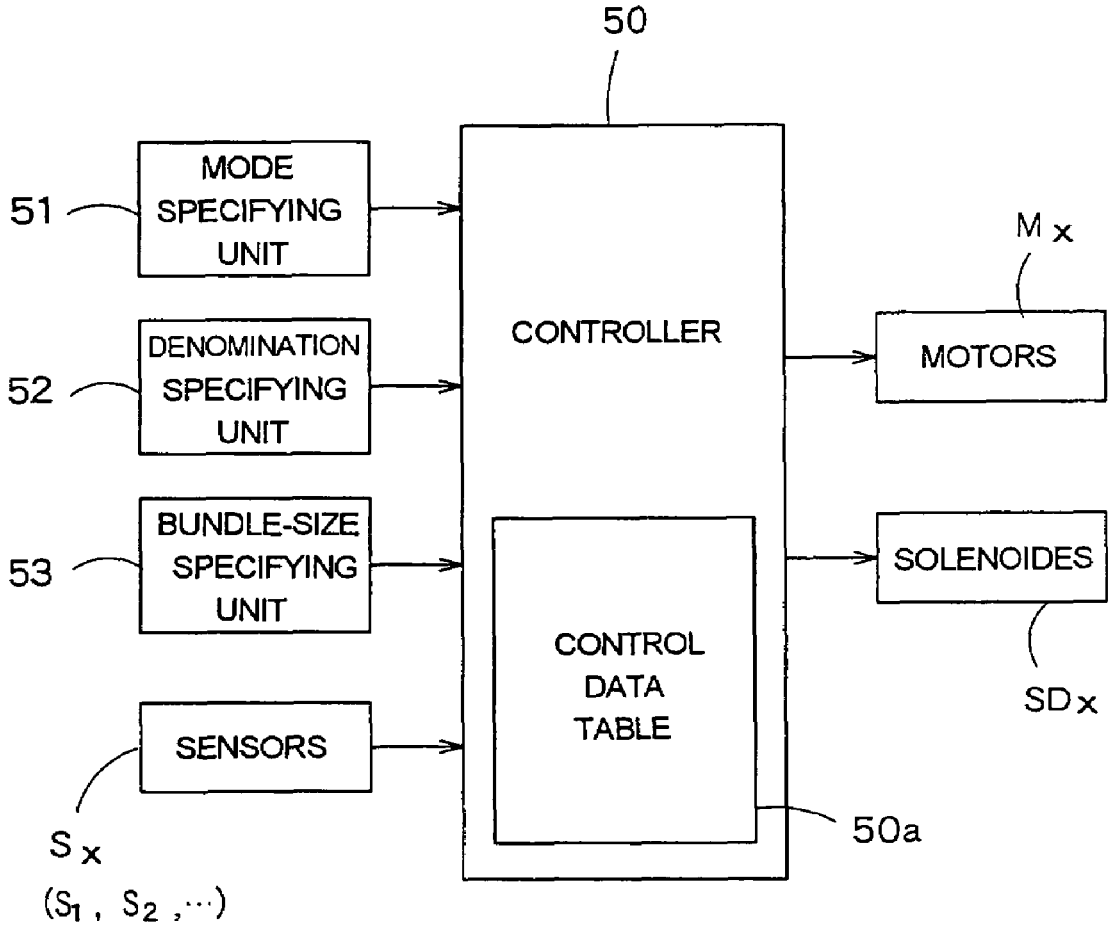
FIG. 15 is a block diagram of the bank note bundling machine shown in FIG. 1.

FIG. 15 is a block diagram of the bank note bundling machine. A controller 50 controls the operations of the bank note bundling machine. The controller 50 receives signals provided by a print mode specifying unit 51, a denomination specifying (input) unit 52, a bank note bundle size (stack size) specifying (input) unit 53 and the sensors $S_x$. The motors $M_x$ and the solenoid actuators $SD_x$ for driving the bundling unit and the tape feed passage 20 are connected to the controller 50.

The controller 50 is provided with a control data table 50*a*. Control data is input into the control data table 50*a*. The control data includes the time when the impression cylinder 27 of the printing mechanism 21 is to be pressed against the bundling tape T, a period for which the impression cylinder 27 is to be pressed against the bundling tape T and driving pulses to be given to the motors $M_x$ to drive the rollers 18, 19, 19', 19", 30, 31, 32 and 32' for forward rotation and reverse rotation. The control data will be described specifically in connection with the description of the operation of the controller 50.

The print mode specifying unit 51 is able to specify one of an automatic print mode A-1, a specified denomination print mode A-2, a denomination and bank note bundle size print mode A-3 and a nonprint mode B.

When the automatic print mode A-1 is specified, the controller 50 is set for the automatic print mode A-1. The controller 50 controls the bundling unit $G_1$, the motors $M_x$ of the tape feed passage 20 and the solenoid actuators $SD_x$ on the basis of three condition signals, namely, a print mode setting signal and two signals provided by the sensor $S_2$, namely, a bank note stack detection signal and a denomination signal.

The number of the bank notes of one bank note stack is one hundred for the automatic print mode A-1, the specified denomination print mode A-2 and the nonprint mode B.

When the specified denomination print mode A-2 is specified by the print mode specifying unit 51, the controller 50 is set for the specified denomination print mode A-2. The controller 50 sets a denomination specified by the denomination specifying unit 52. In the specified denomination print mode A-2, the same denomination is set unless the denomination setting unit 52 changes the denomination. The denomination specifying unit 52 may specify a denomination for each bank note bundle.

The controller 50 controls the bundling unit $G_1$, the motors $M_x$ of the tape feed passage 20 and the solenoid actuators $SD_x$ on the basis of three condition signals, namely, a mode setting signal specifying the specified denomination print mode A-2, a denomination specifying signal and a bank note stack detection signal provided by the bank note stack sensor $S_2$ (the denomination detection signal provided by the bank note stack sensor $S_2$ is nullified).

When the denomination and bank note bundle size print mode A-3 is specified by the print mode specifying unit 51, the controller 50 is set for the denomination and bank note bundle size print mode A-3. The controller 50 sets a denomination set by the denomination specifying unit 52 and the number of bank notes in each bank note stack to be bundled specified by the bank note bundle size specifying unit 53.

The controller 50 controls the bundling unit $G_1$, the motors $M_x$ of the tape feed passage 20 and the solenoid actuators $SD_x$ on the basis of condition signals, namely, a mode setting signal specifying the denomination and bank note bundle size print mode A-3, a denomination specifying signal and a bank note stack detection signal provided by the bank note stack sensor $S_2$ (the denomination detection signal provided by the bank note stack sensor $S_2$ is nullified).

In the denomination and bank note bundle size print mode A-3, the denomination of bank notes and the number of bank notes in each bank note bundle are the same for all bank note bundles unless the denomination specified by the denomination specifying unit 52 and the number of bank notes of each bank note stack specified by the bank note bundle size specifying unit 53 are changed. A denomination and the number of bank notes of each bank note bundle may be specified for each bank note bundle.

When the nonprint mode B is specified by the print mode specifying unit 51, the controller 50 is set for the nonprint mode B. The controller 50 controls the bundling unit $G_1$, the motors $M_x$ of the tape feed passage 20 and the solenoid actuators $SD_x$ on the basis of condition signals, namely, a mode setting signal specifying the nonprint mode B, a denomination specifying signal and a bank note stack detection signal provided by the bank note stack sensor $S_2$.

After the controller 50 has been set for one of the modes A-1, A-2, A-3 and B, a bank note bundling operation in the specified mode is started automatically upon the reception of the bank note stack detection signal provided by the bank note stack sensor $S_2$ by the controller 50. The bank note bundling operation may be started by operating a start button. When the start button is used to start the bank note bundling operation, the start button needs to be operated for every bundling process.

The position of the leading end of the bundling tape T needs to be adjusted when the mode is changed. The positional adjustment of the leading end of the bundling tape T will be described later.

1) Nonprint Mode B

A bundling operation in the nonprint mode B only bundles a bank note stack P. In a waiting state, the gripper 3 is held at its home position, the bundling tape T is passed through the opening 46 of the first pressing member 11 and the leading end of the bundling tape T is positioned at a position corresponding to the tape cutter 10, namely, a position corresponding to the right side surface of the first pressing member 11. The impression cylinder 27 of the printing mechanism 21 is separated from the bundling tape T and is held at its home position.

If the last bundling operation on the preceding day is performed in the nonprint mode B, i.e., if the controller 50 is set for the nonprint mode B when the main switch is turned off, the leading end of the bundling tape T is at the position corresponding to the tape cutter 10, namely, the position corresponding to the right side surface of the first pressing member 11, when the main switch is turned on on the succeeding day.

If the nonprint mode B is specified by the print mode specifying unit 51, the position of the leading end of the bundling tape T remains unchanged. At this stage, the controller 50 is ready for a control operation in the nonprint mode B.

When the print mode specifying unit 51 specifies the nonprint mode B to change the automatic print mode A-1, the specified denomination print mode A-2 or the denomination and bank note bundle size print mode A-3 for the nonprint mode B, a predetermined length of the bundling tape T is fed.

When the bundling operation in the automatic print mode A-1, the specified denomination print mode A-2 or the denomination and bank note bundle size print mode A-3 is ended, the leading end of the bundling tape T is at a position corresponding to the sensor $S_1$. When the print mode specifying unit 51 specifies the nonprint mode B, the controller 50 is set for the nonprint mode B, the number of drive pulses for forward rotation to adjust the position of the leading end of the bundling tape T is input into the control data table 50*a*, the rollers 18, 19 and 19' are driven for forward rotation by a number of turns corresponding to a set number of drive pulses to position the leading end of the bundling tape T at the position corresponding to the tape cutter 10 to prepare for the bundling operation in the nonprint mode B.

When the exhaustion of the bundling tape T of the tape reel 16 is detected by a sensor, not shown, the empty tape reel is replaced with a new tape reel 16 regardless of the mode in a state before the main switch is turned on or the mode in a state where the main switch is turned on. Then, a bundling tape T pulled out from the new tape reel 16 is extended manually on the tape feed passage 20 and the leading end of the bundling tape T is placed at the position corresponding to the tape cutter 10 fore preparation for the bundling operation in the nonprint mode B.

The rollers 18 to 32' are driven according to the control data set in the control data table 50*a* for the nonprint mode B. The controller 50 sets the number of forward drive pulses and the number of reverse drive pulses to be applied to the motors $M_x$. In the nonprint mode B, the impression cylinder 27 is kept separated from the bundling tape T and, as a matter of course, nothing is printed on the bundling tape T.

The solenoid of the solenoid actuator 41 is energized to push up the base part 36*a* of the second gripping member 36 of the gripper 3 held at the home position A by the end part 43*a* of the swing lever 43. Consequently, the gripping part 36*b* is turned on the pivot 39 downward to a tape receiving position to define an open space between the respective gripping ends 35*b* and 36*b* of the gripping members 35 and 36 in preparation for gripping the bundling tape T.

A bank note stack P is inserted through the opening 2 of the case 1 into the bank note bundling machine and is supported in place on the support table 9 in contact with the stopper and the positioning plate.

The sensor $S_2$ detects the bank note stack P supported on the support table 9. Then, the rollers including the rollers 18 are driven for forward rotation by the number of turns corresponding to the forward drive pulses to move the leading end of the bundling tape T form the position corresponding to the sensor $S_1$ into the open space between the respective gripping ends 35*b* and 36*b* of the gripping members 35 and 36 formed by turning the second gripping member 36 on the pivot 39 by the solenoid actuator 41. The rollers including the rollers 18 are stopped upon the arrival of the leading end of the bundling tape T at a predetermined position.

The controller 50 de-energizes the solenoid of the solenoid actuator 41 (one of the solenoids $SD_x$ shown in FIG. 15). Consequently, the gripping part 36*b* of the second gripping member 36 is turned on the pivot 39 in a gripping direction to grip the leading end of the bundling tape T between the first gripping member 35 and the second gripping member 36.

Subsequently, the motor $M_1$ (one of the motors $M_x$ shown in FIG. 15) for driving the endless belt 4 is actuated to turn the endless belt 4 in the direction of the arrow shown in FIG. 2. At the same time, the tape carrying system 17 including the rollers 18 to 32 feeds the bundling tape T for a predetermined period to slacken the bundling tape T.

As the endless belt 4 is thus turned, the gripper 3 moves from the home position A via positions B, C and D to a position E as shown in FIG. 3. Upon the detection of the arrival of the gripper 3 at the position E by a sensor, not shown, (one of the sensors $S_x$ shown in FIG. 15), the motor $M_1$ (one of the motors $M_x$ shown in FIG. 15) is stopped. Thus the bundling tape T is wound round predetermined parts of the bank note stack P and the support table 9.

Figure 12:
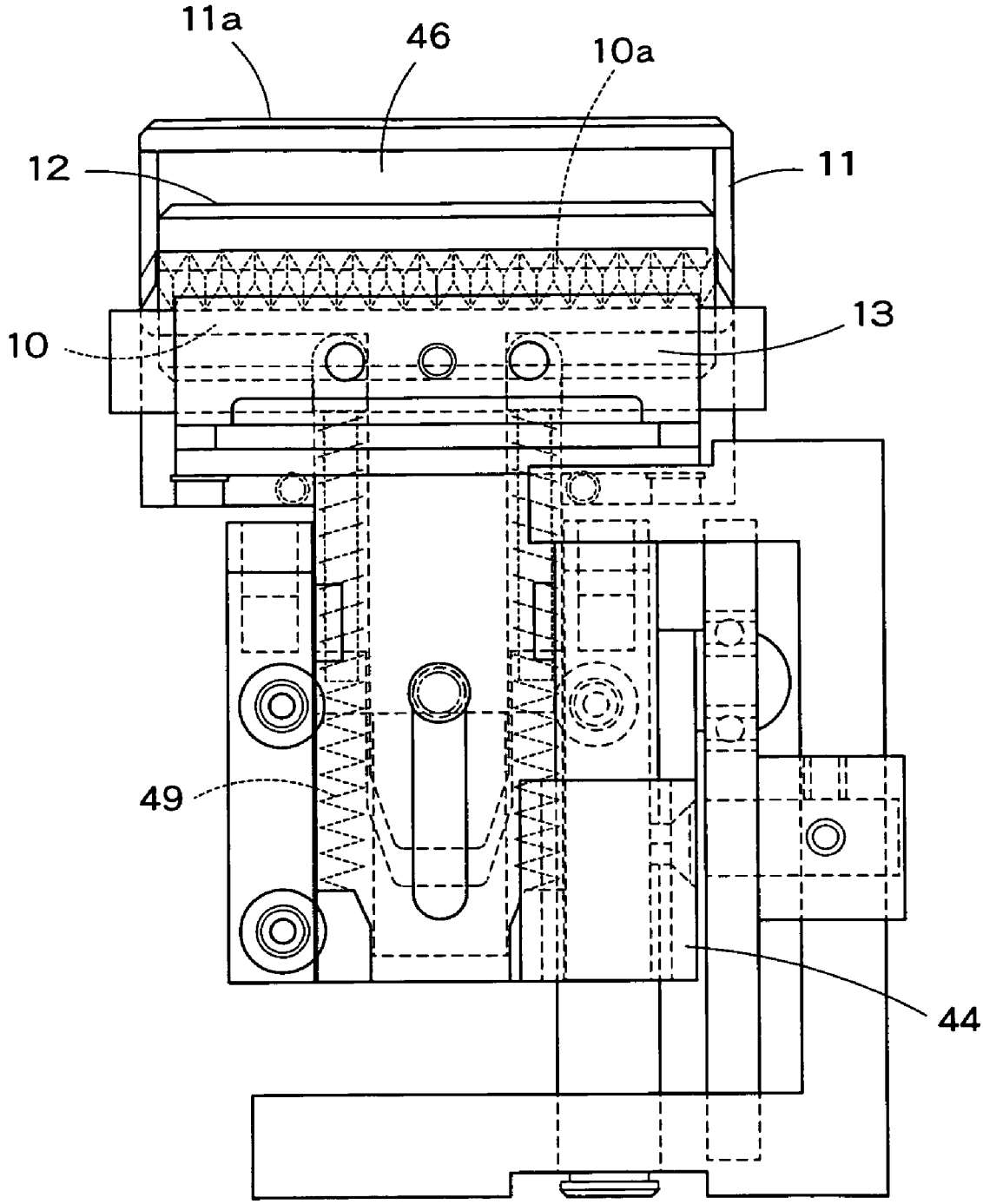
FIG. 12 is a side elevation of the moving frame shown in FIG. 9.

After the upper end 11*a* of the first pressing member 11 has been pressed against the bundling tape T extending under the support table 9 by raising the moving frame 44 shown in FIGS. 9, 11 and 12, the rollers including the rollers 18 of the tape carrying system 17 are driven for reverse rotation by a number of turns corresponding to a predetermined number of drive pulses to pull back the bundling tape T so that the bundling tape T is tightened and is wound tightly round the support table 9 and the bank note stack P. While the bundling tape T is being pulled back, the tension rollers 33 and 34 are moved in directions intersecting a tape path along which the bundling tape T is fed as shown in FIG. 3 to take up a slack in the bundling tape T so that the bundling tape T may be stretched.

After the bundling tape T has been wound tightly round the support table 9 and the bank note stack P, the moving frame 44 is raised further so that the compression springs 47 are compressed to keep pressing the bundling tape T by the first pressing member 11. Then, the upper end 122*a* of the second pressing member 12 comes into contact with the bundling tape T to hold the bundling tape T on the support table 9 by pressing two parts of the bundling tape T by the first pressing member and the second pressing member 12.

As the moving frame 44 is raised further, the tape cutter 10 shown in FIG. 3 is raised along the side surface of the first pressing member 11 to cut the bundling tape T at the opening 46 of the first pressing member 11 with the cutting edge 10*a*. At the same time, pressing surface 13*a* of the heat-bonding member 13 is pressed against a two-layered part of the bundling tape T formed by superposing a leading end part and a trailing end part of the bundling tape T to heat-bond the superposed parts of the bundling tape T. In this state, the leading end of the bundling tape T is at a position corresponding to the tape cutter 10.

During a cutting operation for cutting off the bundling tape T, the solenoid of the solenoid actuator 41 shown in FIG. 9 is energized and hence the gripping part 36*b* of the second gripping member 36 is urged in a direction away from the gripping part 35*b* of the first gripping member 35. However, the gripping part 36*b* is not separated from the gripping part 35*a* because the gripping part 36*b* is restrained from moving by the bundling tape T. Then, an outer end part of the bundled bank note stack P is pulled by hand. The looped bundling tape T bundling the bank note stack P comes off the support table 9 and a bank note bundle thus formed is taken out through the opening 2 from the bank note bundling machine.

Upon the detection of the removal of the bank note bundle from the support table 9 by the sensor $S_2$, the endless belt 4 is reversed to return the gripper from the position E to the home position A. Thus the bundling process is completed and the bank note bundling machine is prepared for the next bundling process.

In the nonprint mode B, the starting position of the leading end of the bundling tape T at the start of the bundling process corresponds to the tape cutter 10. The leading end of the bundling tape T may be positioned between the respective gripping parts 35*b* and 36*b* of the gripping members 35 and 36, and this position of the leading end of the bundling tape T may be the starting position.

In such a case, the endless belt 4 is reversed to return the gripper 3 from the position E to the home position A upon the removal of the bank note bundle from the support table 9. The respective gripping parts 35*b* and 36*b* of the gripping members 35 and 36 are separated from each other when the gripper 3 is placed at the home position A. The rollers including the rollers 18 are driven for forward rotation by a number of turns corresponding to a predetermined number of drive pulses to move the leading end of the bundling tape T from the position corresponding to the tape cutter 10 to the space defined by the gripping parts 35*b* and 36*b* to prepare for a bundling process. The leading end of the bundling tape T is held between the gripping parts 35*b* and 36*b* at the start of the bundling process.

When the print mode specifying unit 51 specifies the nonprint mode B to change the mode A-1, A-2 or A-3 for the nonprint mode B, the rollers 18, 19 and 19' are driven for forward rotation by a number of turns corresponding to a predetermined number of drive pulses to advance the leading end of the bundling tape T from the position corresponding to the sensor $S_1$ to the space defined by the respective gripping parts 35*b* and 36*b* of the gripping members 35 and 36 to prepare for starting the bundling process.

If the nonprint mode B is set when the main switch is turned off, the leading end of the bundling tape T is held between the respective gripping parts 35*b* and 36*b* of the gripping members 35 and 36. Therefore, the first gripping member 35 and the second gripping members 36 are turned on the pivot 39 away from each other and the bundling tape T is set ready to start a bundling process when the nonprint mode B is specified after the main switch has been turned on.

If the tape reel 14 is empty when the main switch is turned on, a tape reel 16 is loaded into the tape reel 14, the leading end of the bundling tape T is advanced into the space between the respective gripping parts 25*b* and 36*b* of the gripping members 35 and 36 separated from each other of the gripper 3 placed at the home position A. Thus the leading end of the bundling tape T is positioned ready for a bundling process.

Thus the starting position of the leading end of the bundling tape T is set at the gripping position between the gripping parts 35*b* and 36*b*.

2) Print Modes

Print modes will be explained.

There are three print modes, namely, the automatic print mode A-1, the specified denomination print mode A-2 and the denomination and bank note bundle size print mode A-3.

2-1) Automatic Print Mode A-1

Operations to be performed when the automatic print mode A-1 is specified will be described.

When the print mode specifying unit 51 specifies the automatic print mode A-1 in a state where the automatic print mode A-1 has been set before the main switch is turned on or in a state where the mode A-2 or the mode A-3 is set, the leading end of the bundling tape T is at the position corresponding to the sensor $S_1$, and the bundling tape T is set ready for starting a bundling process.

If the nonprint mode B has been set before the print mode specifying unit 51 specifies the mode A-1, the rollers 18, 19 and 19' are driven for reverse rotation by a number of turns corresponding to a predetermined number of drive pulses according to the control data held in the control data table 50*a* of the controller 50. The bank note bundling machine is set ready for a bundling process when the leading end of the bundling tape T is positioned at a print starting position F corresponding to the sensor $S_1$.

The leading end of the bundling tape T is thus positioned when the mode is changed.

In a state where the bank note bundling machine is set ready for a bundling process in the mode A-1, the sensor $S_2$ detects the bundling tape stack P placed at the predetermined position on the support table 9 and the denomination of the bank notes of the bank note stack P. Then, the rotating disk 23 of the printing mechanism 21 is turned to locate the color stamping roller 24 for stamping a color indicating the denomination of the bank notes of the bank note stack P at a printing position.

Then, the impression cylinder 27 is advanced, forward drive pulses set by the controller 50 on the basis of the control data held in the control data table 50*a* are applied to the motors $M_x$ of the tape carrying system 17 to drive the rollers for forward rotation to feed the bundling tape T. A pulse counter, not shown, counts pulses generated as the rollers 18 of the tape carrying system 17 rotate and indicating the number of rotation of the rollers 18. The motors $M_x$ are stopped temporarily upon the advancement of the leading end of the bundling tape T by a distance corresponding to a predetermined length of the bundling tape T from the print starting position F to stop temporarily driving the rollers including the rollers 18 for forward rotation.

At this stage, the leading end of the bundling tape T is at the gripping position where the gripper 3 is able to grip the leading end of the bundling tape T. After the rollers 18 and 19 have been stopped, the controller 50 provides a command signal for actuating the gripper 3 to grip the leading end of the bundling tape T. Subsequently, the endless belt 4 is driven for forward turning and the rollers 18 and 19 are driven for forward rotation.

Consequently, the leading end of the bundling tape T gripped by the gripper 3 is moved from the home position A of the gripper 3 via the positions B, C and D to the position E. The gripper 3 is stopped temporarily at the position E. At this stage, the leading end of the bundling tape T has been moved forward from a position $T_1$ shown in FIGS. 2 and 3 corresponding to the home position A of the gripper 3 to a position $T_3$ shown in FIG. 3 corresponding to the position E of the gripper 3 by the forward rotation of the rollers including the rollers 18 and the bundling tape T is slack.

During the forward feed of the bundling tape T including the temporary stop of the gripper 3 at the home position A, the impression cylinder 27 is retracted from the working position upon the advancement of the leading end of the bundling tape T by a distance corresponding to a predetermined length of the bundling tape T from the position F corresponding to the sensor $S_1$. The time when the impression cylinder 27 is to be advanced and a working period of the impression cylinder 27 are determined on the basis of the control data held in the control data table 50*a* for the specified mode. More specifically, predetermined numbers of forward drive pulses to be applied to the motors $M_x$ are determined.

The color is printed on the bundling tape T for a period corresponding to a length of the bundling tape T to be wound round the bank note stack P and to be cut off and the following part of the bundling tape T is not printed with the color.

In a state shown in FIG. 3, a bundling part of a length necessary for bundling one bank note bundle of the bundling tape T loosely wound round the bank note stack P is printed with the color and other part following the bundling part is not printed with the color.

Then, the rollers 18 to 31 are driven for reversed rotation by applying predetermined numbers of reverse drive pulses to the motors $M_x$, respectively, to tighten the bundling tape T wound round the bank note stack P. The rollers of the tape carrying system are stopped after a part of the bundling tape T to be the leading end of the bundling tape T to be used for the next bundling process has been pulled backward from a position $T_3$. The motors $M_x$ is stopped to stop the rollers 18 of the tape carrying system 17 after predetermined reverse drive pulses have been counted.

The tension rollers 33 and 34 are moved by the springs to keep the bundling tape T moved backward taut. When the bundling tape T is moved backward, the rollers 18 to 30 are rotated at the same circumferential speed, the rollers 32 is kept stationary, the rollers 31 are stopped temporarily for a period in which the tension roller 33 takes up a slack in the bundling tape T, and the rollers 31 are rotated at a circumferential speed equal to that at which the rollers 30 are rotated after the slack has been taken up. Then, the tension roller 34 moves to a tightening position with the rollers 32 kept stationary. Thus the tension rollers 33 and 34 are moved individually to tightening positions, respectively.

Subsequently, the tape cutter 10 cuts the bundling tape T and the heat-bonding member 13 heat-bonds superposed parts of the bundling tape T. Although the solenoid of the solenoid actuator 44 is energized to separate the first gripping member 35 and the second gripping member 36 of the gripper 3 located at the position E from each other when the tape cutter 10 cuts the bundling tape T, the gripping members 35 and 36 are kept joined because the bundling tape T is wound round the gripping members 35 and 36.

The leading end of the bundling tape T cut off the bundling tape T wound round the bank note stack P is moved backward to the print starting position F where the sensor $S_1$ detects the end of the bundling tape T by applying predetermined numbers of reverse drive pulses to the motors $M_x$ to drive the rollers 18 to 31 for reversed rotation and by moving the tension rollers 33 and 34 to set the bundling tape T ready for the next bundling process.

A bank note bundle formed by bundling the bank note stack P with the bundling tape T is removed from the support table 9. Upon the detection of the removal of the bank note bundle from the support table 9 by the sensor $S_2$, the endless belt 4 is driven for reverse turning to return the gripper 3 from the position E to the home position A to complete the bundling process.

Subsequently, a bank note stack P to be bundled in the next bundling process is put in place on the support table 9, and then the next bundling process is started. The sensor $S_2$ detects the bank note stack P on the support table 9 and the denomination of the bank notes of the bank note stack P. The sensor $S_2$ provides a denomination signal indicating the denomination of the bank notes. Then, the rotating disk 23 of the printing mechanism 21 is turned according to the denomination signal to position the color stamping roller 24 for printing a color representing the denomination indicated by the denomination signal at the printing position, the impression cylinder 27 is advanced, the impression cylinder 27 is held at the working position for a period in which a length of the bundling tape T necessary for bundling the bank note stack P is fed, the leading end of the bundling tape T is advanced from the print starting position F corresponding to the sensor $S_1$ by driving the rollers 18 to 32 for forward rotation and the length of the bundling tape T for bundling the bank note stack P is printed with the color representing the denomination.

The gripper 3 is held at the home position A is kept open until the leading end of the bundling tape T reaches the gripper 3. The rollers 18 to 32 are stopped temporarily and the impression cylinder 27 is retracted temporarily after the leading end of the bundling tape T has been advanced into the gripper 3. After the gripper 3 has gripped the leading end of the bundling tape T, the chuck 3 starts moving, the rollers 18 to 32 are started for forward rotation, and the impression cylinder 27 is advanced to the working position to resume printing the bundling tape T with the color.

The gripper 3 moves from the home position A via positions B, C and D to the position E and is stopped temporarily at the position E, and the rollers 18 to 32 are stopped temporarily. The impression cylinder 27 has completed printing before the rollers 18 to 32 are stopped and is separated from the bundling tape T.

Then, the rollers 18 to 31 are driven for reverse rotation (the rollers 31 are stopped temporarily) by the motors $M_x$, to tighten the bundling tape T so that the bundling tape T is wound tightly round the bank note stack P. Then, the bundling tape T is cut and superposed parts of the bundling tape T are heat-bonded. Then, the rollers 18 to 31 are driven for reverse rotation to return the leading end of the bundling tape T for the next bundling process to the print starting position F. The leading end of the bundling tape T is held at the print starting position F until the next bundling process is started.

2-2) Specified Denomination Print Mode A-2

The specified denomination print mode A-2 will be described.

The control data table 50*a* is set after the print mode specifying unit 51 has specified the specified denomination print mode A-2 and the denomination specifying unit 52 has specified a denomination.

When the specified denomination print mode A-2 is specified by the print mode specifying unit 51 and the denomination is specified by the denomination specifying unit 52, and the mode A-1, the mode A-2 or the mode A-3 is set before the main switch is turned on, the leading end of the bundling tape T is at the print start position F corresponding to the sensor $S_1$ and the bank note bundling machine is ready for a bundling process.

If the nonprint mode B is set before the specified denomination print mode A-2 is specified, predetermined numbers of reverse drive pulses set by the controller 50 according to control data for the mode A-2 set in the control data table 50*a* are applied to the motors $M_x$ for driving the rollers 18, 19 and 19' after the specified denomination print mode A-2 has been specified by the print mode specifying unit 51 and the denomination has been specified by the denomination specifying unit 52 to move the leading end of the bundling tape T from the position corresponding to the tape cutter 10 to the print starting position F corresponding to the sensor $S_1$ to prepare for a bundling process.

The controller 50 provides a denomination signal when the mode A-2 is specified to turn the rotating disk 23 of the printing mechanism 21 to locate the color stamping roller 24 for printing a color indicating the specified denomination on the bundling tape T at the printing position.

In the specified denomination print mode A-2, the sensor $S_2$ detects only a bank note stack P put in place on the support table 9 and, as mentioned above, does not detect the denomination of the bank notes of the bank note stack P.

When the specified denomination print mode A-2 is specified by the print mode specifying unit 51 and the denomination is specified by the denomination specifying unit 52, the controller 50 is set for the specified denomination print mode A-2 and the specified denomination, and starts a bundling process upon the detection of the bank note stack P put in place on the support table 9 by the sensor $S_2$.

Since the denomination is set when the specified denomination print mode A-2 is specified, the color stamping roller 24 for printing the color indicating the specified denomination is held at the printing position unless the denomination is changed. Therefore, the positional adjustment of the color stamping roller 24 for printing the bundling tape T with the color indicating the specified denomination to the printing position before starting the bundling process in the specified denomination print mode A-2 is omitted, the impression cylinder 27 is advanced, the rollers 18 to 32 of the tape carrying system 17 are driven for forward rotation to start the bank not bundling process. The rest of operations in the specified denomination print mode A-2 are the same as those in the mode A-1. If the denomination is changed during operation in the mode A-2, the positional adjustment of the relevant color stamping roller 24 to the printing position is necessary.

After the bundling tape T has been wound round the bank note stack P, the leading end of the bundling tape T for the next bundling process is returned to the print starting position F corresponding to the sensor $S_1$ to prepare for the next bundling process.

A bank note bundle formed by bundling the bank note stack P is removed from the support table 9. Upon the detection of the removal of the bank note bundle from the support table 9 by the sensor 52, the endless belt 4 is driven for reverse turning and the gripper is returned from the position E to the home position A to complete the bundling process.

The next bundling process (bundling operation) in the mode A-2 is started upon the detection of a bank note stack P put in place on the support table 9 by the sensor $S_2$.

If the set denomination is cleared upon the completion of each bundling process in the mode A-2, the denomination of the bank notes to be bundled needs to be specified before starting each bundling process and the proper color stamping roller 24 must be positioned at the printing position.

2-3) Denomination and Bank Note Bundle size Print Mode A-3

The denomination and bank note bundle size print mode A-3 will be described.

When the denomination and bank note bundle size print mode A-3 is specified by the print mode specifying unit 51, a denomination is specified by the denomination specifying unit 52 and a bank note bundle size, such as fifty bank notes, is specified by the bank note bundle size specifying unit 53, the controller 50 sets the specified mode A-3, the specified denomination and the specified number of bank notes. The controller 50 provides a command signal on the basis of those set data to turn the rotating disk 23 of the printing mechanism 21 so that the color stamping roller 24 for printing a color indicating the specified denomination is positioned at the printing position.

The mode A-3, similarly to the mode A-2, requires the detection of a bank note stack P put in place on the support table 9 by the sensor $S_2$ and does not require the detection of the denomination of the bank notes of the bank note stack P by the sensor $S_2$.

In the mode A-3, the number of forward drive pulses and that of reverse drive pulses respectively defining a forward drive period and reverse drive period for which the rollers 18 to 32 are driven for forward rotation and reverse rotation, respectively, are set according to the number of the bank notes of the bank note stack P, such as fifty, forty or twenty.

Since all kinds of bank notes of Japan have the same width regardless of denomination, the respective numbers of the forward drive pulses and the reverse drive pulses to be applied to the tape carrying system 17 are fixed, provided that the number of bank notes of every bank note stack, such as one hundred, is fixed like the number of bank notes of every bank note stack in the modes A-1, A-2 and B. However, the number of the forward drive pulses and that of the reverse drive pulses are different from each other, and the numbers of those pulses in the modes A-1 and A-2 are different from those in the mode B.

If bank notes of different denominations, like bank notes of foreign countries, have different widths, different numbers of forward drive pulses and different numbers of reverse drive pulses must be set for different denominations, respectively, in the modes A-1, A-2 and B. In the mode A-3, different numbers of forward drive pulses and reverse drive pulses are set for different denominations and different numbers of bank notes of bank note stacks, respectively.

In such a case, the number of forward drive pulses, the number of reverse drive pulses, and the number of pulses determining time and period for printing for the denominations of foreign bank notes and the number bank notes, such as one hundred, fifty, forty or twenty, of each bank note stack are stored in the control data table 50*a* of the controller 50 shown in FIG. 15. Then, the controller 50 may set the respective numbers of forward drive pulses and reverse drive pulses for the combination of the mode A-1 and denomination detecting condition, the mode A-2, and the combination of the mode B and denomination detecting condition, and the combination of the mode A-3 and denomination and bank note bundle size detecting condition.

A bundling operation for bundling bank notes of Japan having the same width regardless of denomination in the mode A-3 will be described. Although the mode A-3 is different from the mode A-2 in the respective set numbers of drive pulses dependent on the number of bank notes of a bank note stack specified by the bank note bundle size specifying unit 53, a bundling operation to be carried out in a bundling process to be performed in the mode A-3 is the same as that to be performed in the mode A-2.

If the preceding bundling process is set for the mode A-2 (at a stage before the main switch is turned on), the mode A-1 or the mode A-3, the leading end of the bundling tape T is at the print starting position F corresponding to the sensor $S_1$ and the tape is set ready for the bundling process in a state where the mode A-3, a denomination and the number of bank notes of a bank note stack have been set by the controller 50.

If the preceding bundling process is set for the nonprint mode B, a predetermined number of reverse drive pulses are applied to the motors $M_x$ for driving the rollers including the rollers 18 to move the leading end of the bundling tape T from the position corresponding to the tape cutter 10 to the print starting position F corresponding to the sensor $S_1$ when the mode A-3 is set to prepare for a bundling process.

When the mode A-3 is specified, the controller 50 inputs control data into the control data table 50*a*. The control data includes the numbers of forward drive pulses to be applied to the motors $M_x$ to drive the rollers including the rollers 18 for forward rotation, the numbers of reverse drive pulses to be applied to the motors $M_x$ to drive the rollers including the rollers 18 for reverse rotation, the numbers of pulses for determining printing time and printing period for which the solenoid of the solenoid actuator $SD_x$ for advancing the impression cylinder is energized for the mode A-3, the specified denomination and the specified number of bank notes of a bank note stack.

Since the denomination has been set for the mode A-3 by the controller 50, the bundling operation is started upon the detection of a bank note stack P put in place on the support table 9 by the sensor $S_2$. In this case, the sensor $S_2$ does not detect the denomination of the bank notes of the bank note stack R The mode A-3, similarly to the mode A-2, positions the color stamping roller 24 for printing a color indicating the set denomination at the printing position when the denomination is set. Therefore, an operation for positioning the color stamping roller 24 at the printing position at the start of a bundling process in the mode A-1 is omitted unless the denomination is changed and, similarly to operations in the mode A-2, the impression cylinder 27 is advanced to press the bundling tape T against the color stamping roller 24 and the rollers of the tape carrying system 17 are driven for forward rotation to start the bundling process. The rest of operations in the mode A-3 are the same as those in the modes A-1 and A-2. If the denomination is changed while the mode A-3 is set, an operation for positioning the color stamping roller 24 for printing a color indicating a denomination specified for the next bundling process at the printing position is necessary.

After the bundling tape T has been wound round the bank note stack P and the bank note stack P has been bundled, the leading end of the bundling tape T for bundling the next bank note stack P is moved backward from the position corresponding to the tape cutter 10 to the print starting position F to set the bundling tape T ready for the next bundling process.

A bank note bundle is removed from the support table 9. Upon the detection of the removal of the bank note bundle from the support table 9 by the sensor $S_2$, the endless belt 4 is driven for reverse turning, and the gripper 3 is returned from the position E to the home position A to complete the bundling process.

Upon the detection of a bank note stack P put in place on the support table 9 for the next bundling process by the sensor $S_2$, the next bundling process in the mode A-3 is started and the foregoing operations are carried out.

If the set denomination is cleared upon the completion of each bundling process in the mode A-3, the denomination and the number of the bank notes of the bank note stack to be bundled need to be specified before starting each bundling process and the proper color stamping roller 24 must be positioned at the printing position if the denomination of the bank notes to be bundled in the succeeding bundling process is different from that of the bank notes bundled in the preceding bundling process.

Figure 16:
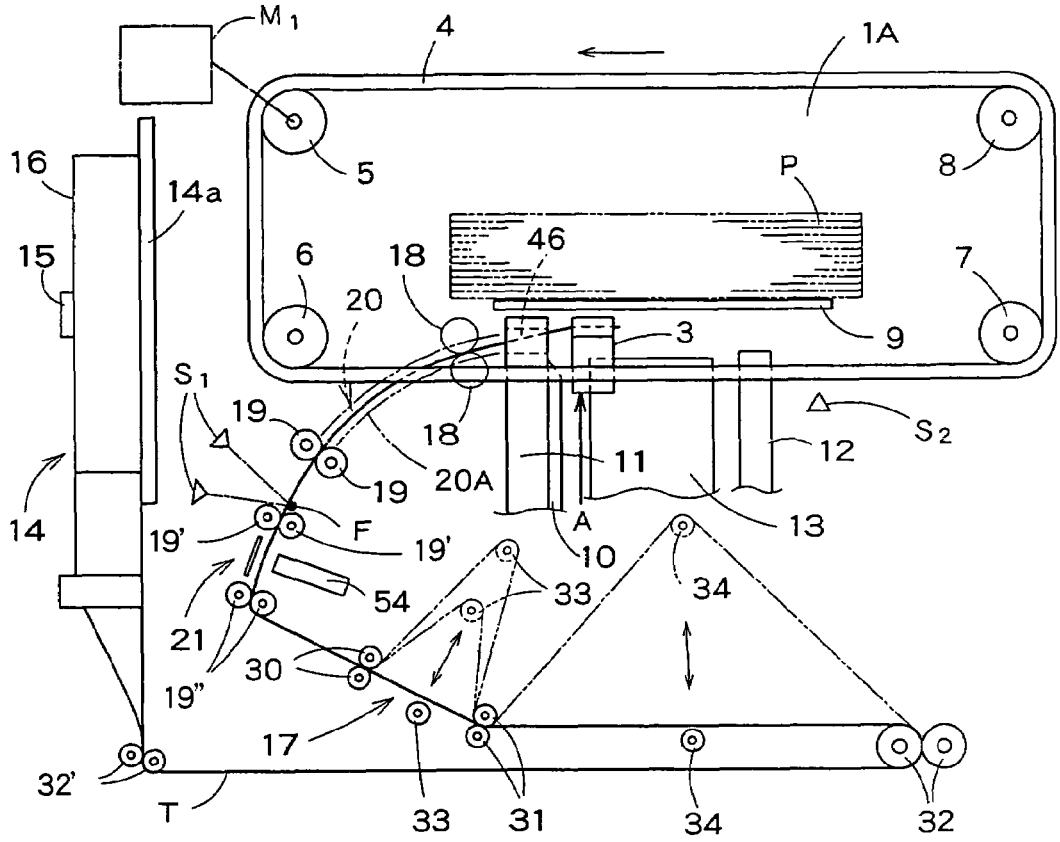
FIG. 16 is a front elevation, similar to FIG. 2, of the functional structure provided with an ink-jet printer as a printing mechanism.

FIG. 16 is a view, similar to FIG. 2, showing a printing mechanism 21 provided with an ink-jet printer 54. FIGS. 17(A) and 17(B) are a plan view of a bundling tape printed with characters and a plan view of a bundling tape printed with a color line, respectively.

Figure 17:
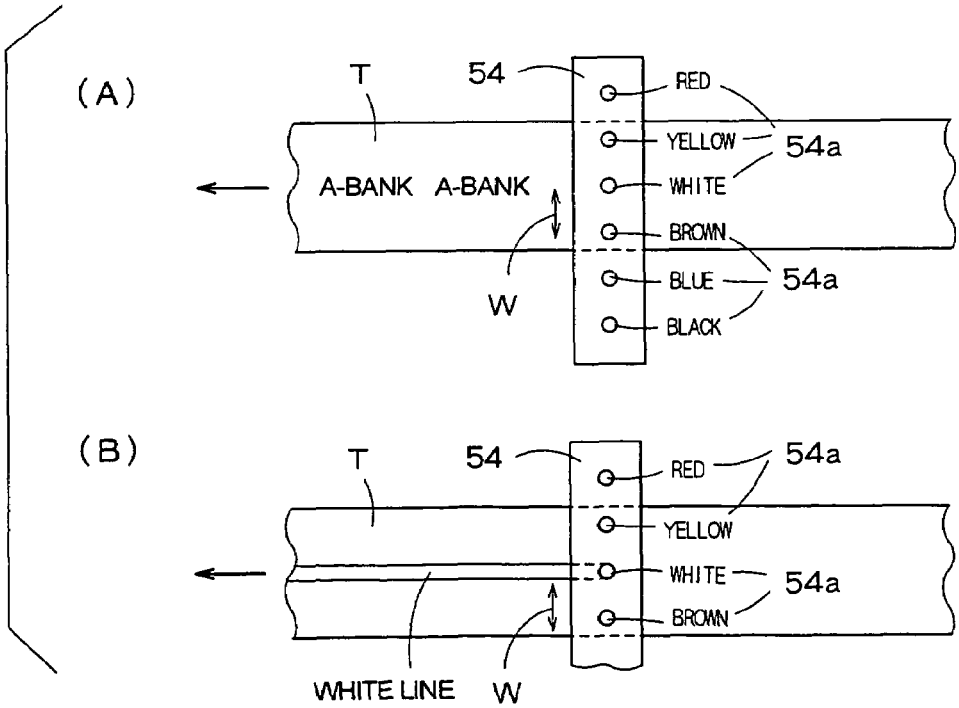
FIG. 17 is a plan view of examples of denomination marks printed on a bundling tape by an ink-jet printer.

As shown in FIG. 17, the ink-jet printer 54 is provided with nozzles 54*a* respectively for jetting red, yellow, white, brown, blue and black inks. When the denomination is changed, the ink-jet printer 54 is moved along the width of the bundling tape T, i.e., in the direction of the arrow W, to position the nozzle 54*a* for jetting the color ink indicating a newly specified denomination at a position corresponding to the center, with respect to the width, of the bundling tape T. The bundling tape T is colored in gray to make printed denomination marks of any one of red, yellow, white, brown, blue and black appear clearly. In FIG. 17, the nozzle 54*a* for jetting the white ink is positioned at a printing position.

A printing operation will be described.

When characters are to be printed as shown in FIG. 17(A), the bundling tape T is fed intermittently, the ink-jet printer 54 is moved intermittently in directions along the width of the bundling tape T and the ink is jetted intermittently through the nozzle 54*a* in coordination to print the characters.

When a line is to be printed as shown in FIG. 17(B), the ink-jet printer 54 is held at a fixed position after the nozzle 54*a* for jetting the color ink indicating the specified denomination has been positioned and the color ink is jetted as the bundling tape T is fed.

The time for starting moving the ink-jet printer 54 to position the ink-jet printer 54 for the denomination, i.e., the time for starting moving the ink-jet printer 54 in the direction along the width of the bundling tape T to position the proper nozzle 54 for jetting the color indicating the set desired denomination at the center, with respect to the width, of the bundling tape T, coincides with the time for starting turning the rotating disk 23 of the printing mechanism shown in FIG. 2. A signal corresponding to the command signal for rotating the rotating disk 23 is provided to start moving the ink-jet printer 54 in the direction along the width of the bundling tape T.

When the rotating disk 23 is used, the turning rotating disk 23 is stopped upon the detection of the arrival of the color stamping roller 24 for printing the color indicating the specified denomination at the printing position by a sensor, not shown, to complete a denomination setting operation. When the ink-jet printer 54 is used, the laterally moving ink-jet printer 54 is stopped upon the detection of the arrival of the nozzle 54*a* for jetting the color ink indicating the specified denomination at the printing position by a sensor, not shown, to complete a denomination setting operation.

The print starting time for the printing mechanism 21 shown in FIG. 2 coincides with the time when the impression cylinder 27 presses the bundling tape T. At the print starting time for the ink-jet printer 54 shown in FIG. 17, the nozzle 54*a* starts jetting the color ink.

The print ceasing time for the printing mechanism 21 shown in FIG. 2 coincides with time when the impression cylinder 27 is separated from the bundling tape T. The print ceasing time for the ink-jet printer 54 shown in FIG. 17 is time when the nozzle 54*a* stops jetting the color ink. When the characters are to be printed as shown in FIG. 17(A), it is desirable to cease the printing operation after completely printing the last character adjacent to the trailing end of the bundling tape T. The printing period is dependent on the number of drive pulses to be applied to the motors for driving the rollers including the rollers 18. Where as the bundling tape T needs to be slackened when the printing mechanism 21 provided with the impression cylinder 27 is used, the bundling tape T does not need to be slackened when the printing mechanism 21 provided with the ink-jet printer 54 is used. Therefore, the rollers 18, 19, 19', 19" 30, 31, 32 and 32' may be directly driven by the motors $M_x$.

When a bank note stack P is to be bundled by the foregoing bank note bundling machine in the first embodiment, the bank note stack P is loaded in a horizontal position into the bundling unit $G_1$. When it is desired to load a bank note stack P in a vertical position into the bundling unit $G_1$, the bundling unit $G_1$ is able to deal with the change of the position of the bank note bundle P by changing the respective positions of the components of the bundling unit $G_1$ by an angle of 90°.

Basically, a bank note bundling machine in a second embodiment according to the present invention shown in FIGS. 18 to 22 is an application of the present invention to a sheet bundling machine mentioned in Jpn. Pat. No. 2848863. Since the constitution of the bank note bundling machine is described in detail in the specification of Jpn. Pat. No. 2848863, only principal parts of the bank note bundling machine in the second embodiment will be described with reference to FIG. 18, which corresponds to FIG. 3 of the specification of Jpn. Pat. No. 2848863, and the description of the rest will be omitted.

Bank notes successively fed out from a hopper, not shown, combined with a case 60 is carried by a bank note carrying mechanism 61. A predetermined number of the bank notes are stacked in a bank note stack P with their long sides aligned with a longitudinal direction, namely, a direction perpendicular to the paper in FIG. 18, in a stacker 62. A bank note stack carrying mechanism 63 provided with a pair of holding members 63*a* is disposed under the stacker 62. The bank note stack carrying mechanism 63 clamps the bank note stack P between the holding members 63*a* and carries the bank note stack P to a bundling position $G_2$ in a bank note bundling unit $G_1$. The bundling unit $G_1$ is provided with a clamping device 64 including a pair of clamping members 64*a* that clamp a part, longitudinally off from a part held between the holding members 63*a*, of the bank note stack P, a tape winding device 65 for winding a bundling tape T round the bank note stack P before the clamping device 64 clamps and compresses the bank note stack P, a tape cutter 66 for cutting off the bundling tape T and a heat-bonding member 67 for heat-bonding a two-layered part of the bundling tape T formed by superposing a leading end part and a trailing end part of the bundling tape T.

A bank note stack positioning member 64A for determining the lower surface of the bank note stack P placed at the bundling position $G_2$ is movable between a working position and a waiting position. The bank note stack positioning member 64A is disposed behind the tape winding device 65 with respect to a direction into the paper in FIG. 18 such that the bank note stack positioning member 64A will not interfere with the bank note stack carrying mechanism 63.

When the bank note stack carrying mechanism 63 carries the bank note stack P to the bundling position $G_2$, the bank note stack positioning member 64A is held at the working position where the bank note stack positioning member 64A supports the bank note stack P thereon. The bank note stack positioning member 64A supports the bank note stack P thereon until time immediately before the completion of a bundling operation. The bank note stack positioning member 64A is retracted to the waiting position before the clamping members 64*a* of the clamping device 64 releases the bank note stack P to prepare for releasing a bank note bundle formed by bundling the bank note stack P from the clamping members 64*a* to drop the bank note bundle. The bank note stack positioning member 64A is returned from the waiting position to the working position after the bank note bundle has been thus dropped into a bank note bundle storage unit under the bundling unit $G_1$ to prepare for receiving another bank note stack P carried by the bank note stack carrying mechanism 63.

A tape reel unit 68, a tape feed passage and a tape carrying mechanism will be described.

The tape reel unit 68 is disposed in an inclined position in a bottom part of the case 60. The tape reel unit 68 has a tape reel 69 holding a bundling tape T in a wound state, a reel table 70 and a shaft 71 supported on the reel table 70. The tape reel 69 is mounted on the shaft 71 fitted in the central hole of the tape reel 69. Thus the tape reel 69 is supported for rotation in an inclined plane on the reel table 70. The bundling tape T unwound from the tape reel 69 is guided by tape guides 72 and 73 to a tape carrying system 74. The tape reel unit 68 is provided with a braking device for tensioning the bundling tape T sent out from the tape reel 69.

The tape carrying system 74 includes rollers capable of nipping and feeding the bundling tape T. The tape carrying system 74 has an inclined upward feed section 74*a*, namely, a section between rollers 78 and rollers 19", and an inclined downward feed section 74*b*, namely a section between the rollers 19" and a roller 80*a*. The inclined upward feed section 74*a* extends perpendicularly to a direction in which the bundling tape T is pulled out from the tape reel unit 68. The inclined downward feed section 74*b* extends substantially perpendicularly to the inclined upward feed section 74*a*. An upper roller 75 and a lower roller 76 are disposed opposite to each other at the terminal end of the inclined downward feed section 74*b*. The upper roller 75 is driven for forward rotation to feed a predetermined length of the bundling tape T and for reverse rotation to retract the bundling tape T by a predetermined distance by a reversible motor $M_x$, not shown. The reversible motor $M_x$ is included in a bank note bundling and storing unit 93 shown in FIG. 19. Rollers 19', the rollers 19", and rollers 77 and 78 are driven for rotation in synchronism with the rotation of the upper roller 75.

A tension roller 79 is disposed between the upper rollers 77 and lower rollers 78 of the inclined upward feed section 74*a* to take up a slack in the bundling tape T and to tighten the bundling tape T when the bundling tape T is pulled backward. The tension roller 79 moves away from the inclined upward feed section 74*a* in synchronism with the reverse rotation of the rollers of the tape carrying system 74 to take up a slack corresponding to a length of the reversely fed bundling tape T.

The lower rollers 78 are driven for forward rotation in synchronism with the rollers 75 and 76, and are driven for reverse rotation as brake rollers to tighten the bundling tape T so that the bundling tape T may not slacken when the tape carrying system 74 feeds the bundling tape T.

Operations of pulse motors $M_x$ for driving the rollers 75, 76, 19' 19", 77 and 78 will be described. The motors $M_x$ drive the rollers 75, 76, 19', 19" and 77 for forward rotation and reverse rotation. The rollers 78 are interlocked with the motor $M_x$ by a one-way clutch such that the rollers 78 are driven only for forward rotation by the motor $M_x$.

The rollers 75, 76 and 19' are operatively connected to the motors $M_x$ by first electromagnetic clutches, not shown, respectively. The rollers 19", 77 and 78 are operatively connected to the motors $M_x$ by second electromagnetic clutches, not shown, respectively.

The rollers 75, 76, 19', 19", 77 and 78 are thus operatively connected to the motors $M_x$ to drive the rollers 75, 76, 19', 19", 77 and 78 properly in a print mode. In a nonprint mode, the first and second electromagnetic clutches are engaged simultaneously when the motors $M_x$ operate for forward driving and for reverse driving. The first and second electromagnetic clutches, as well as the motors $M_x$, are included in the bank note bundling and storing unit 93 shown in FIG. 19.

When a printing mechanism 21, which is the same in construction as that included in the bank note bundling machine in the first embodiment, operates for printing in the print mode, an impression cylinder 27 bends a part of the bundling tape T. Therefore, the rollers 19", 77 and 78 need to feed a length of the bundling tape T with the rollers 75, 76 and 19' stopped to enable the impression cylinder 27 to bend the part of the bundling tape T.

When the impression cylinder 27 of the printing mechanism 21 presses the bundling tape T against a color stamping roller 24, the motors $M_x$ are actuated and the second electromagnetic clutches are engaged to make the rollers 19", 77 and 78 feed a predetermined length of the bundling tape T, and then the impression cylinder 27 presses the bundling tape T against the color stamping roller 24.

Subsequently, the first electromagnetic clutches, not shown, are engaged to drive the rollers 75, 76 and 19' at a circumferential speed equal to that of the rollers 19", 77 and 78.

When the impression cylinder 27 is retracted after a length of the bundling tape T for bundling one bank note stack has been printed with a color, a slack in the bundling tape T caused by the impression cylinder 27 must be taken up to tighten the bundling tape T.

In a state where the motors $M_x$ are operating and the first electromagnetic clutches are engaged to drive the rollers 75, 76 and 19', the rollers 19", 77 and 78 are stopped temporarily by temporarily disengaging the clutches (2) in synchronism with the retraction of the impression cylinder 27. Consequently, the slack produced in the bundling tape T is taken up and the bundling tape T is tightened. the second electromagnetic clutches are engaged immediately after the slack has been taken up to drive the rollers 19", 77 and 78 for forward rotation synchronously with the rotation of the rollers 75, 76 and 19' to feed the bundling tape T.

After the leading end of the bundling tape T has been advanced from a position $a_1$ to a tape gripping position $a_1'$ shown in FIG. 20(A), a tape feed operation is stopped temporarily, i.e., the first and second electromagnetic clutches are disengaged temporarily to stop the rollers 75, 76, 19', 19", 77 and 78 temporarily, and the impression cylinder 27 is separated temporarily from the bundling tape T to prevent the spread of the ink on the bundling tape T. In this state, a part of the bundling tape T corresponding to the impression cylinder 27 is slack. Therefore, the motors $M_x$ may be actuated and the first and second electromagnetic clutches may be engaged in synchronism with the advancement of the impression cylinder 27 to its working position to start driving the rollers 75, 76, 19', 19", 77 and 78 simultaneously for forward rotation. More specifically, the rollers are driven is such a manner when the feed of the bundling tape T is resumed after the leading end of the bundling tape T has been temporarily stopped at the tape gripping position $a_1'$.

Description will be given on an assumption that the printing operation is started after starting the forward rotation of the rollers 75 and 76 and pressing the bundling tape T against the color stamping roller 24 by the impression cylinder 27, and the printing operation is terminated upon the separation of the impression cylinder 27 from the bundling tape T.

A tape feed passage 80 extends forward from the tape carrying system 74. A guide roller 80*a* and a tape guide 73' for properly guiding the bundling tape T are disposed near the exit of the tape feed passage 80. The leading end of the bundling tape T is held between the guide roller 80*a* and the tape guide 73'.

Figure 18:
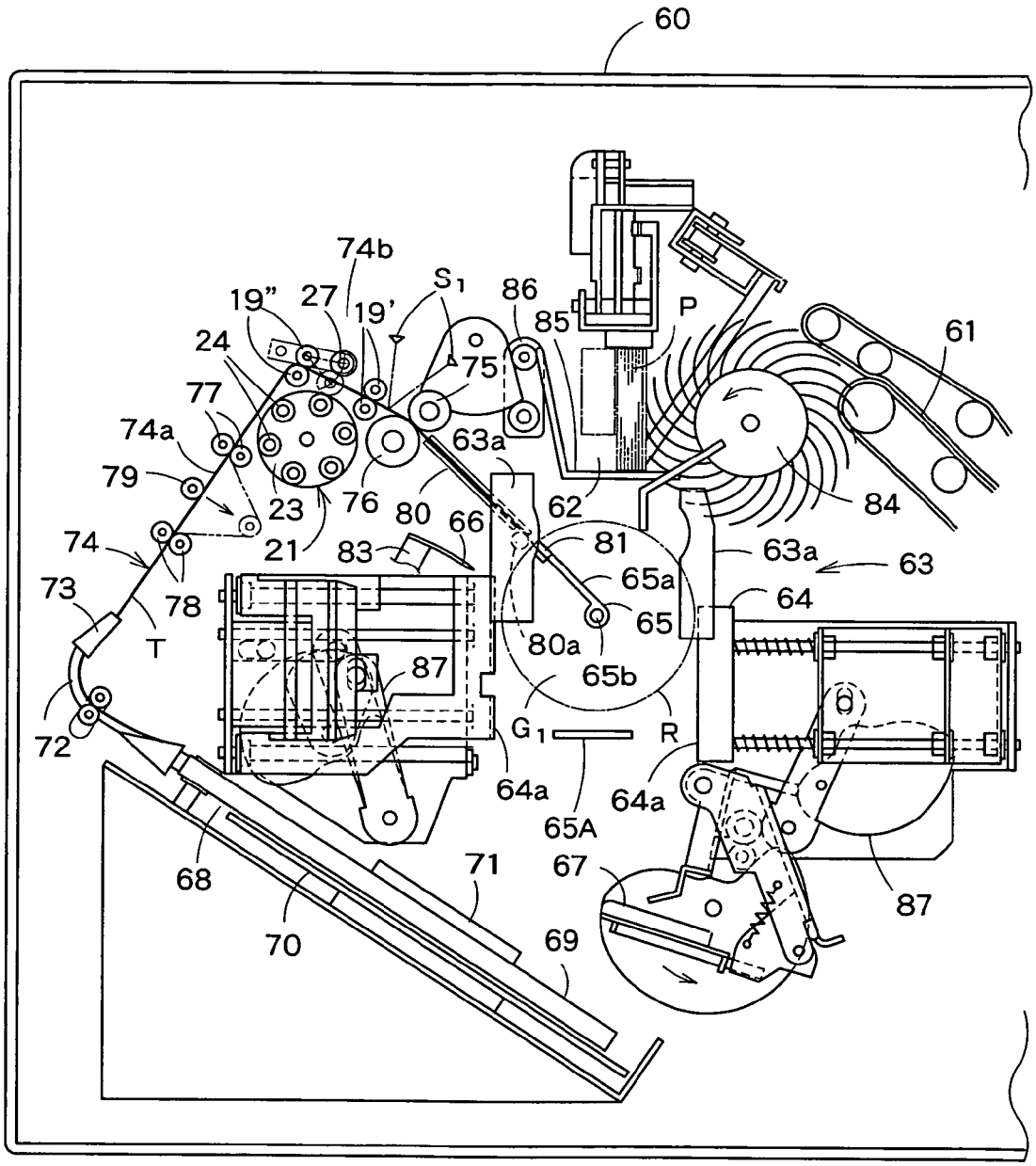
FIG. 18 is a front elevation of a bank note bundling machine in a second embodiment according to the present invention.

A gripper 81, namely, a tape winding means, is disposed at a predetermined position shown in FIG. 18 near the exit of the tape feed passage 80 with its gripping members 81*a* spaced apart from each other.

The cuter 66 is attached to the free end of a moving arm 83 so as to extend perpendicularly to the moving arm 83. The moving arm 83 is moved to the right, as viewed in FIG. 18 to cut the bundling tape T at a predetermined position.

The printing mechanism 21 is installed in a region corresponding to the inclined downward feed section 74*b* of the tape carrying system 74. A sensor $S_1$ capable of detecting the leading end of the bundling tape T is disposed below the rollers 19' disposed below the impression cylinder 27. Since the printing mechanism 21 is the same in construction as the printing mechanism of the bank note bundling machine in the first embodiment, the same parts are denoted by the same reference characters and the further description thereof will be omitted.

Shown also in FIG. 18 are a vane wheel 84 disposed at the exit of the bank note carrying passage 61 to deliver bank notes in a vertical position to the stacker 62, a support member 85 for supporting a bank note stack P thereon, and damper operating mechanisms 87. When the bank note stack P is transferred to the bundling unit $G_1$, the support member 85 is turned away from a support position on a shaft 86. The damper operating mechanisms 87 move the clamping members 64*a* of the clamping device 64 toward and away from each other.

The tape carrying system 74 including the rollers 78, 79, 77, 19", 19, 75 and 76, and the guide roller 80*a* of the tape feed passage 80 are the tape feed means of the present invention. The tape feed passage 80 may be provided with rollers corresponding to the rollers 75 and 76 and capable of being driven for forward rotation and reverse rotation, and those rollers may be included in the tape feed means.

Figure 19:
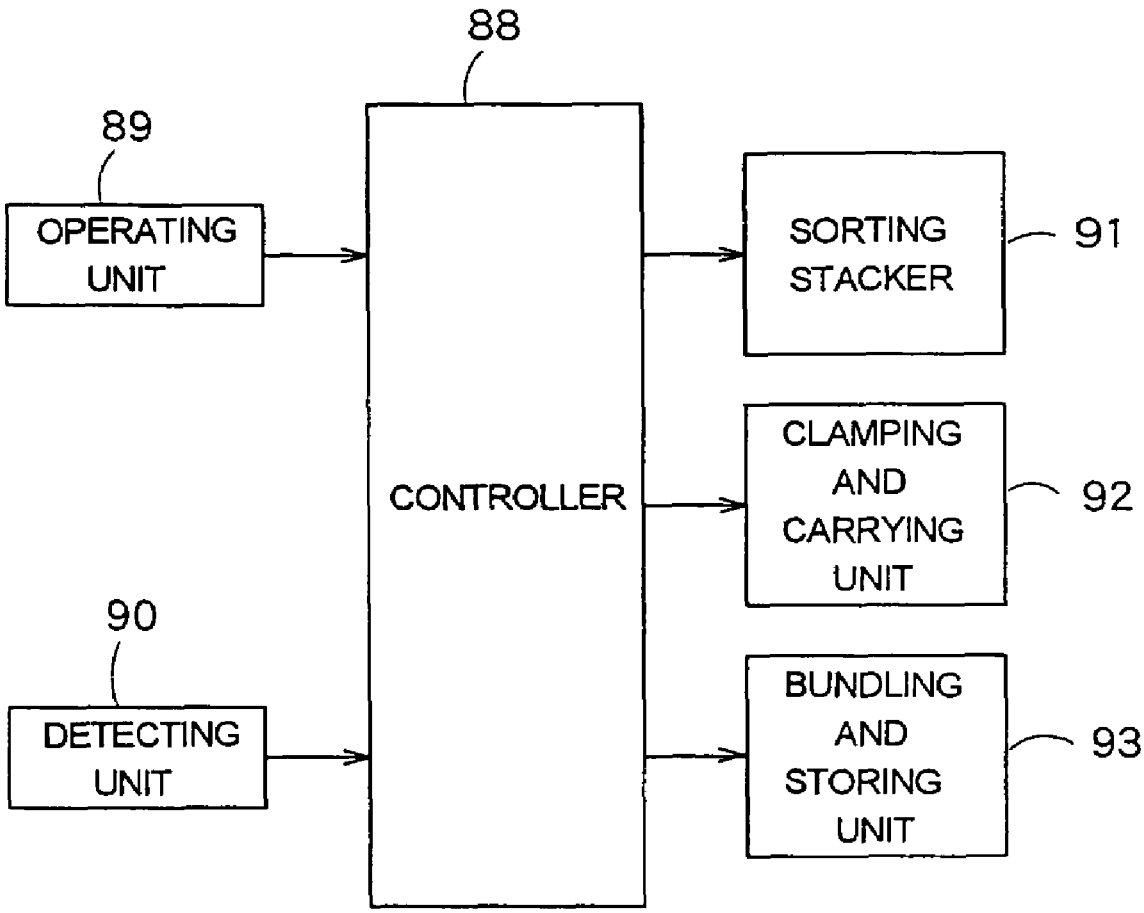
FIG. 19 is a block diagram of the bank note bundling machine shown in FIG. 18.
Figure 20:
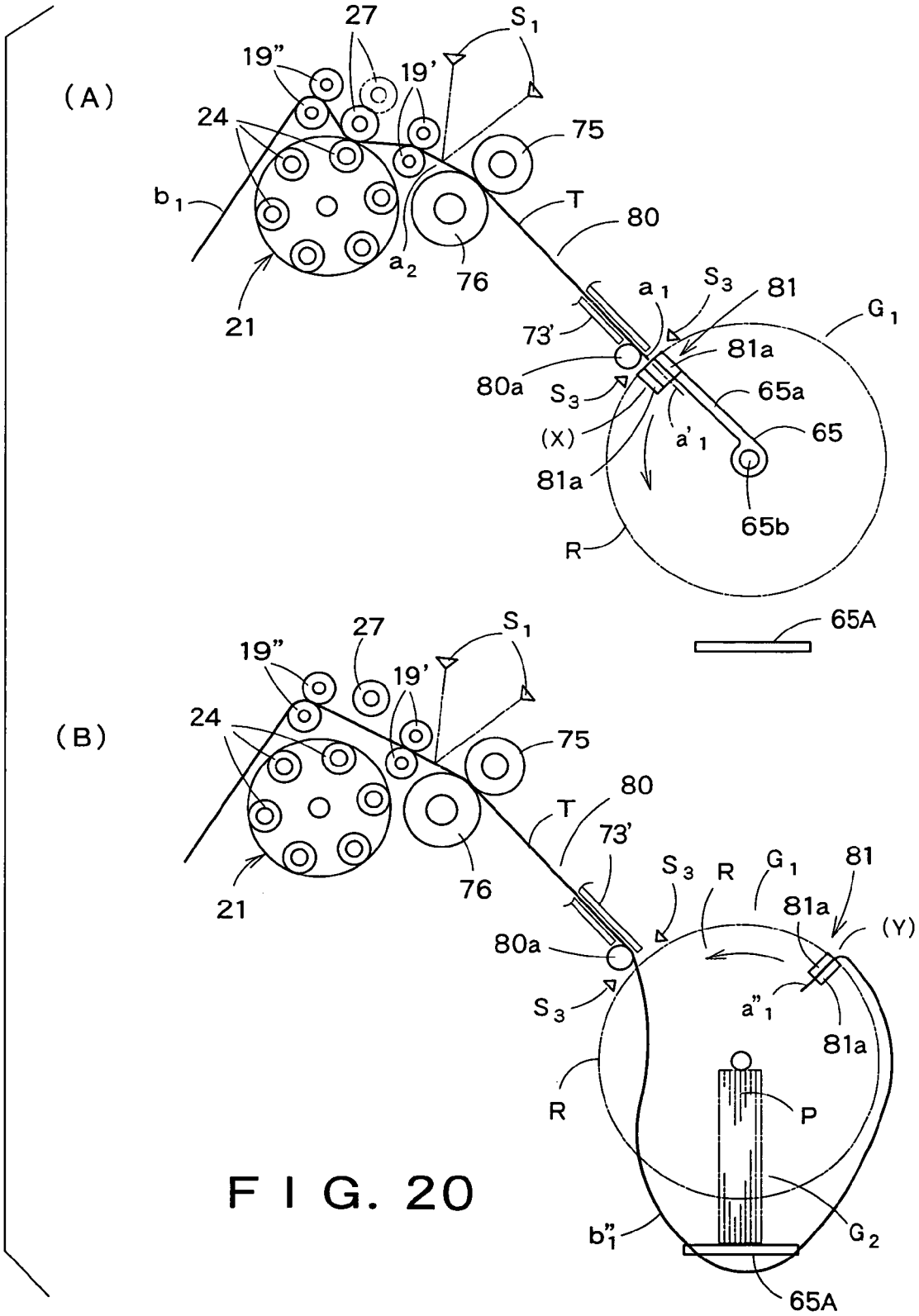
FIG. 20 is a view of assistance in explaining a bank note bundling operation to be performed by the bank note bundling machine shown in FIG. 18.
Figure 21:
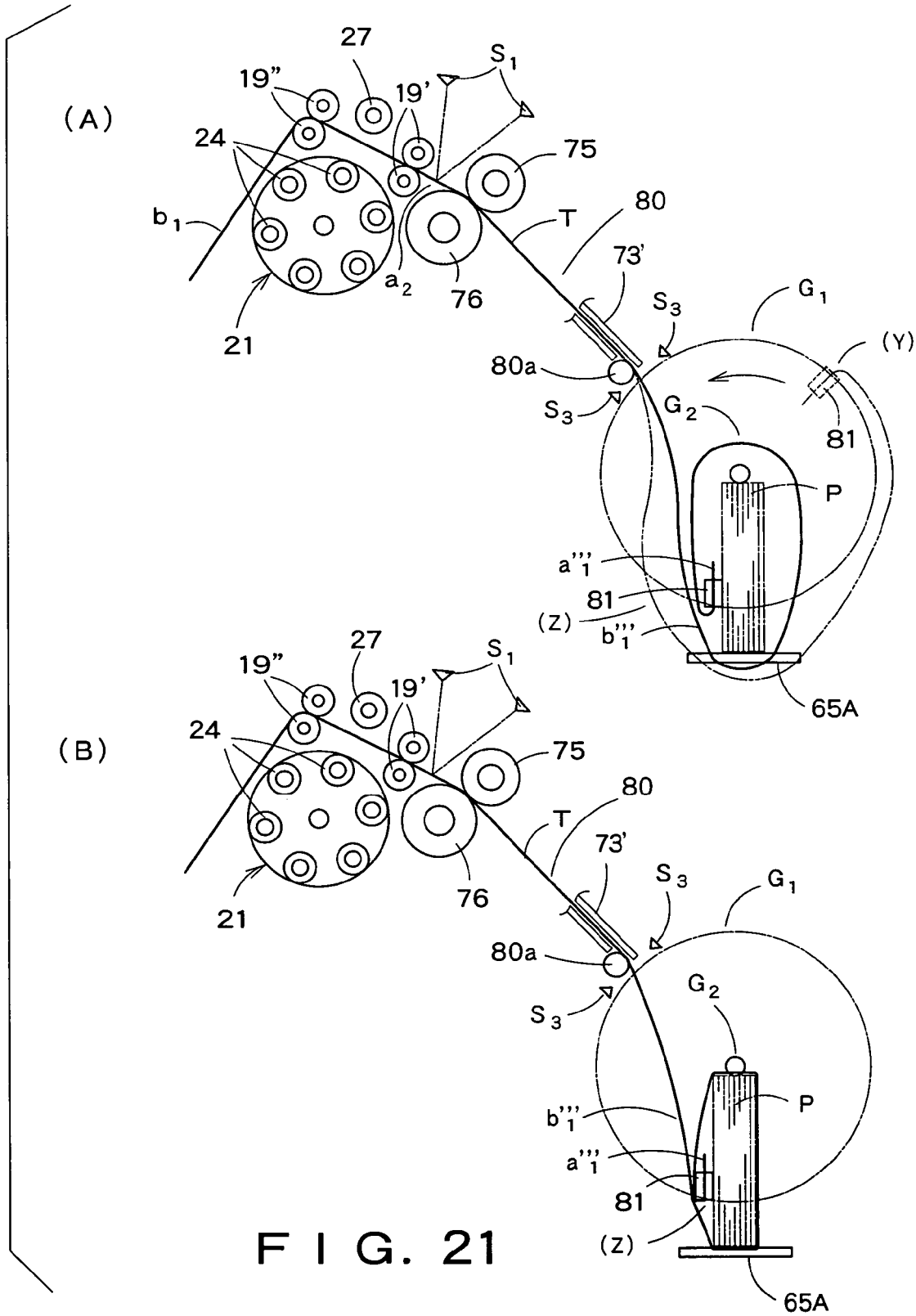
FIG. 21 is a view of assistance in explaining a bank note bundling operation to be performed by the bank note bundling machine shown in FIG. 18.

The tape carrying system 74, the tape guide plate of the tape carrying system 74, the tape guide 72 disposed above the tape guide plate, the tape feed passage 80 including the tape guide 73' and the guide roller 80*a*, the sensor $S_1$, and a sensor $S_3$ for detecting the leading end of the bundling tape T arrived at the exit of the tape feed passage 80 constitute the tape feed passage of the present invention. In FIG. 19, the sensors $S_1$ and $S_3$ are included in a detecting unit for convenience. A space bounded by a circle R (FIG. 18) along which the outer end of the gripper 81 turns is a bundling space in the bundling unit $G_1$.

FIG. 19 is a block diagram of the bank note bundling machine shown in FIG. 18. Shown in FIG. 19 are a controller 88, and an operating unit 89. The operating unit 89 specifies the denomination and the number of bank notes to be stacked in the stacker 62, and either of a print mode and a nonprint mode.

The controller 88 controls a bank note sorting stacker 91, a bank note stack clamping and carrying unit 92 and the bank note bundling and storing unit 93. A detecting unit 90 includes the sensors $S_1$ and $S_3$ placed in the bank-note sorting stacker 91, the bank note stack clamping and carrying unit 92 and the bank note bundling and storing unit 93.

The bank note sorting stacker 91 shown in FIG. 19 includes the feed passage 61, the vane wheel 84, the stacker 62, the support member 85 and the shaft 86 shown in FIG. 18. The bank note stack clamping and carrying unit 92 shown in FIG. 19 includes the bank note stack carrying mechanism 63 including the holding members 63*a*, and a vertical/horizontal moving mechanism shown in FIG. 18.

The bank note bundling and storing unit 93 shown in FIG. 19 includes the tape reel unit 68, the tape feed passage, the printing mechanism 21, the bundling unit $G_1$ and a bank note bundle container, not shown.

The bank note stack bundling operation in a nonprint mode of the bank note bundling machine in the second embodiment will be described with reference to FIGS. 18 to 22. During the bank note stack bundling operation in the nonprint mode, the impression cylinder 27 is held at the waiting position as shown in FIG. 18.

The leading end of the bundling tape T pulled out from the tape reel 69 held in the tape reel unit 68 is positioned at the position $a_1$ at the exit of the tape feed passage 80 and the trailing end of a length of the bundling tape T for bundling one bank note stack is at a position $b_1$ as shown in FIG. 20(A). The leading end of the bundling tape T is held between the guide roller 80*a* and the tape guide 73'. The feed of the bundling tape T is stopped upon the detection of the leading end arrived at the position $a_1$ by the sensor $S_3$.

The gripper 81 of the tape winding device 65 is placed at a position X opposite the exit of the tape feed passage 80 as shown in FIG. 20(A). At this stage, the gripping members 81*a* are spaced apart from each other. In FIG. 20(A), the bank note bundling and storing unit 93 is set ready for a bundling operation.

The operating unit 89 shown in FIG. 19 sets the nonprint mode and determines the number and denomination of bank notes of a bank note stack. The controller 88 starts the bank note bundling and storing unit 93 immediately following the accumulation of a set number of bank notes of the set denomination in the stacker 62.

The motors $M_x$ drive the rollers 75, 76, 19', 19", 77 and 78 of the tape carrying system 74 through the first and second electromagnetic clutches for forward rotation by predetermined numbers of turns, respectively. Consequently, the leading end of the bundling tape T is advanced by a predetermined distance from the position $a_1$ corresponding to the guide roller 80*a* into the bundling space bounded by the circle R such that an end part of the bundling tape T projects into a space between the separated gripping members 81*a* and the leading end is positioned at the tape gripping position $a_1'$ shown in FIG. 20(A).

Then, the leading end of the bundling tape T is held between the gripping members 81*a*. Then, an arm 65*a* holding the gripper 81 turns counterclockwise on a shaft 65*b*.

As the arm 65*a* turns, the rollers 75, 76, 19', 19", 77 and 78 of the tape carrying system 74 are driven for forward rotation so that the bundling tape T extends slack between the gripper 81 and the exit of the tape feed passage 80.

The gripper 81 turns counterclockwise along a circular path and is stopped at a position Y shown in FIG. 20(B). In this state, the leading end of the bundling tape T is at a position $a_1''$ shown in FIG. 20(B). The trailing end of a length of the bundling tape T necessary for bundling one bank note stack is at a position $b_1''$ shown in FIG. 20(B).

The rollers 75, 76, 19', 19", 77 and 79 (hereinafter, these rollers are referred to as "the rollers including the rollers 75 and 76") of the tape carrying system 74 are stopped upon the arrival of the gripper 81 at the position Y shown in FIG. 20(B).

The sensor of the detecting unit 90 detects the gripper 81 arrived at the position Y (FIG. 20(B)). Then, the controller 88 drives the bank note stack clamping and carrying unit 92. Consequently, the holding members 63*a* are raised as shown in FIG. 18, hold a bank note stack P formed by stacking a set number of bank notes in the stacker 62, the holding members 63*a* holding the bank note stack P are lowered to place the bank note stack P to place the bank note stack P at the bundling position $G_2$ as shown in FIG. 20(B). A positioning member 65A supports the bank note stack P thereon at the bundling position $G_2$.

The holding members 63 keep holding the bank note stack P at the bundling position $G_2$ until time immediately before the completion of the bundling operation shown in FIG. 22(A). The holding members 63*a* are raised to positions shown in FIG. 18 to prepare for clamping and carrying the next bank note stack P after releasing the bank note stack P.

After the detecting unit 90 shown in FIG. 19 has detected the bank note stack P arrived at the bundling position $G_2$, the counterclockwise turning of the gripper 81 from the position Y shown in FIG. 20(B) is resumed. The counterclockwise turning of the gripper 81 is stopped immediately after the gripper 81 has come into contact with the left side surface, as viewed in FIG. 21(A), of the bank note stack P at a position Z shown in FIG. 21(A). In this state, the leading end of the bundling tape T is at a position $a_1'''$, and the trailing end of the bundling tape T for bundling one bank note stack is at a position $b_1'''$.

At a stage when the gripper 81 has arrived at the position Z shown in FIG. 21(A), the clamping device 64 shown in FIG. 18 clamps the bank note stack P. The paired clamping members 64*a* of the clamping device 64 come into contact with parts on the opposite sides of the bundling tape T with respect to the width of the bundling tape T of the opposite side surfaces of the bank note stack P to clamp the bank note stack P. The clamping members 64*a* guide the opposite side edges of the bundling tape T so that the bundling tape T may be at a proper position on the bank note stack P when the bundling tape T is pulled back for bundling.

When the gripper 81 is positioned at the position Z shown in FIG. 21(A) and the bank note stack P is clamped between the clamping members 64*a*, the rollers 75, 76, 19', 19" and 77 are driven for reverse rotation by numbers of turning corresponding to predetermined numbers of reverse drive pulses, respectively, and the rollers 78 are kept stationary to pull back the bundling tape T to fasten the bundling tape T. At the same time the tension roller 79 is pressed against the bundling tape T and is moved away from the inclined upward feed section 74*a*.

After the bundling tape T wound round the bank note stack P has been tightened as shown in FIG. 21(B) by pulling the bundling tape T backward, the rollers including the rollers 75 and 76 of the tape carrying system 74 are stopped. In the state shown in FIG. 21(B), the leading end of the bundling tape T is at the position $a_1'''$ and the trailing end of a length of the bundling tape T for bundling one bank note stack is at the position $b_1'''$.

Subsequently, the heat-bonding member 67 is advanced and is pressed against a two-layered part of the bundling tape T formed by superposing a leading end part and a trailing end part of the bundling tape T to heat-bond the superposed parts of the bundling tape T and, at the same time, the tape cutter 66 is advanced to cut the bundling tape T. The heat-bonding member 67 and the tape cutter 66 are returned to their home positions as shown in FIG. 22(A) after the two-layered part of the bundling tape T has been bonded together. In the state shown in FIG. 22(A), the leading end of the bundling tape T for the next bundling process is at a position $a_1''''$.

Sensors of the detecting unit 90 shown in FIG. 19 detect the heat-bonding member 67 and the tape cutter 66 returned to their home positions. Then, the rollers 75, 76, 19', 19" and 77 are driven for reverse rotation, the rollers 78 is kept stationary and the roller 79 moves away from the inclined upward feed section 74*a* so as to take up a slack in the bundling tape T.

Upon the detection the leading end of the bundling tape T retracted from the position $a_1''''$ to the position $a_1$ by the sensor $S_3$, namely, one of the sensors of the detecting unit 90 shown in FIG. 19), the rollers 75, 76, 19', 19' and 77 are stopped. Then, the holding members 63*a* release the bank note stack P and are raised to their home positions.

Then, force applied to the gripping members 81*a* to grip the leading end of the bundling tape T is removed. The gripping members 81*a* are unable to separate from each other because the gripping members 81*a* are restrained from separation by the bundling tape T. Then, the gripping members 81*a* at the position Z are moved into the paper in FIG. 22(B) to pull off the gripping members 81*a* from the bank note bundle.

Then, the bank note stack positioning member 64A supporting the bank note bundle is moved away from the supporting position so that the bank note stack positioning member 64A may not obstruct dropping the bank note bundle. Then, the clamping members 64*a* are separated from the bank note bundle to release the bank note bundle. The bank note bundle drops into a container, not shown.

At this stage, the gripping members 81*a* of the gripper 81 are at a position at a distance into the paper from the position Z in FIG. 22(B) and are separated from each other. Then, the gripper 81 is turned clockwise to the position X in FIG. 22(B), the gripper 81 is moved in a direction out of the paper to its home position corresponding to the position X to prepare for the next bundling process.

Figure 22:
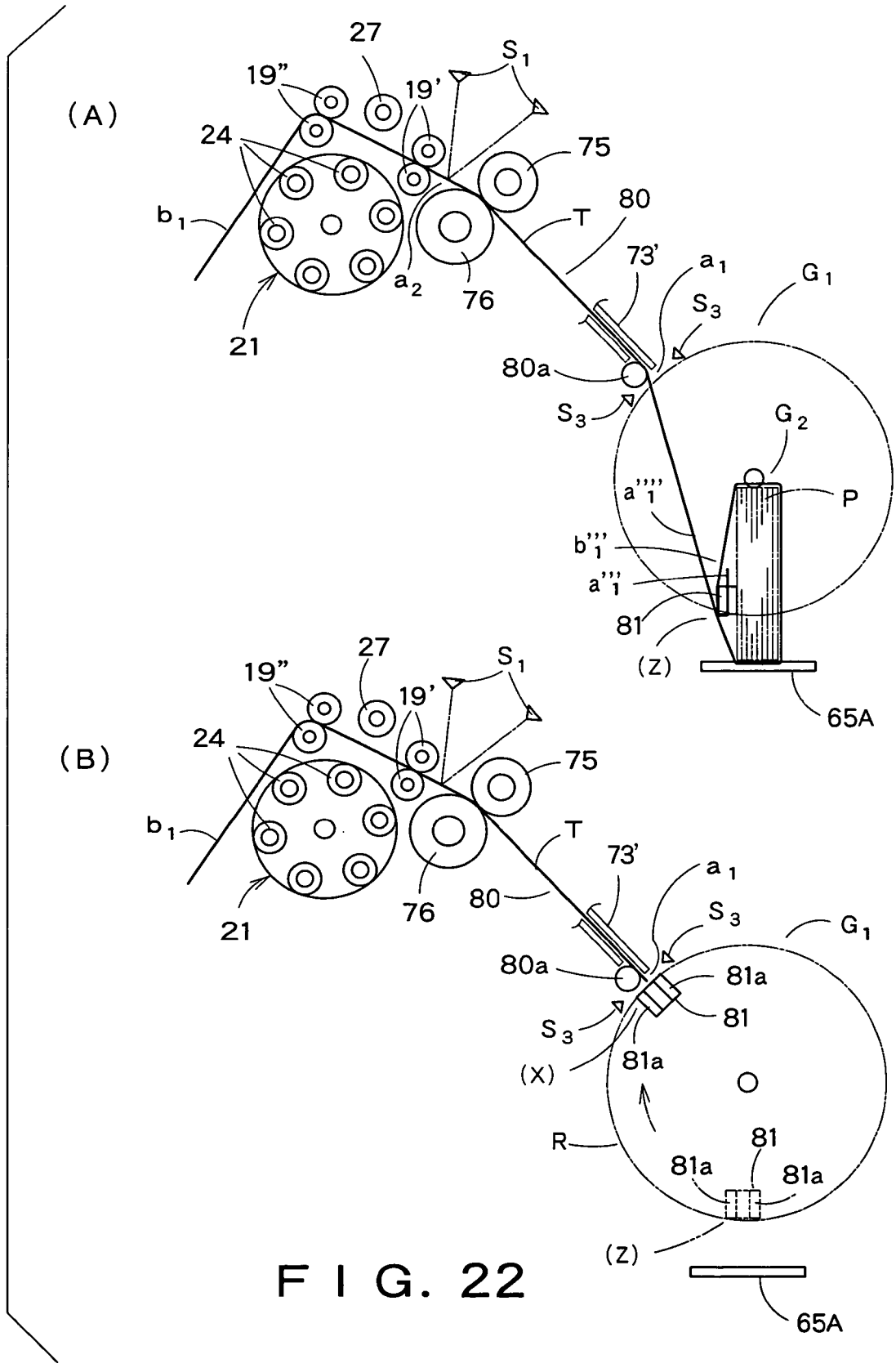
FIG. 22 is a view of assistance in explaining a bank note bundling operation to be performed by the bank note bundling machine shown in FIG. 18.

In this state, a set number of bank notes of a set denomination are stacked in a bank note stack in the stacker 62, and then the bank note stack carrying mechanism 63 carries the bank note stack to the bundling unit $G_1$. If the number of the bank notes stacked in the stacker 62 is less than the set number, the bank note stack carrying mechanism 63 starts the bank note stack carrying operation mentioned in connection with FIGS. 20(A) to 22(B) after a set number of bank notes have been stacked in the stacker 62. The condition of the bank note bundling machine shown in FIG. 22(B) is the same as that shown in FIG. 20(A).

The bundling operation in the print mode of the bank note bundling machine in the second embodiment will be described. In the bundling operation in the print mode, the impression cylinder 27 shown in FIG. 20 presses the bundling tape T intermittently to print the bundling tape T.

The operating unit 89 shown in FIG. 19 sets the print mode and the number and denomination of bank notes to be bundled.

Then, the rotating disk 23 is turned on the shaft 22 to set the color stamping roller 24 for printing a color indicating the set denomination at the printing position as shown in FIG. 20(A). At this stage, the impression cylinder 27 is at its home position indicated by chain lines in FIG. 20(A).

Upon the detection of the color stamping roller 24 for the set denomination positioned at the printing position by the sensor of the detecting unit 90 shown in FIG. 19, the controller 88 drives the rollers 75, 76, 19', 19" and 77 for reverse rotation and keeps the rollers 78 stationary. Consequently, the tension roller 79 moves to take up a slack in the bundling tape T.

Thus the leading end of the bundling tape T is positioned at a print starting position $a_2$ corresponding to the sensor $S_1$ as shown in FIG. 20(A) for the print mode.

Then, the start button of the operating unit 89 shown in FIG. 19 is operated to stack a set number of bank notes of the set denomination in the stacker 62. A detection signal provided by the detecting unit 90 upon the detection of a bank note stack of a set number of bank notes is given through the controller 88 to the bank note bundling and storing unit 93. Then, the rollers including the rollers 75 and 76 are driven for forward rotation to feed the bundling tape T and, at the same time, the impression cylinder 27 presses the bundling tape T against the color stamping roller 24 as indicated by continuous lines in FIG. 20(A) to print the color on the bundling tape T.

Upon the detection of the leading end of the bundling tape T at the position $a_1$ between the guide roller 80*a* disposed at the exit of the tape feed passage 80 and the tape guide 73' opposed to the guide roller 80*a* as shown in FIG. 20(A) (the trailing end of the length of the bundling tape T for bundling one bank note stack is at the position $b_1$) by the sensor $S_3$, the motors $M_x$ stop driving the rollers including the rollers 75 and 76 for forward rotation temporarily in a state shown in FIG. 20(A).

When the rollers including the rollers 75 and 76 are stopped temporarily, the impression cylinder 27 is retracted temporarily from a position where the impression cylinder 27 presses the bundling tape T against the color stamping roller 24 to prevent the spread of the ink on the bundling tape T. Subsequently, the forward driving of the rollers including the rollers 75 and 76 is resumed to advance the leading end of the bundling tape T to the position $a_1'$ shown in FIG. 20(A) and the gripper 81 grips the leading end of the bundling tape T between the gripping members 81*a*.

Subsequently, the gripper 81 gripping the leading end of the bundling tape T turns from the position X shown in FIG. 20(A) to the position Y shown in FIG. 20(B). The rollers including the rollers 75 and 76 are driven for forward rotation to feed the bundling tape T while the gripper 81 is turning from the position X to the position Y and are stopped when the gripper 81 arrives at the position Y shown in FIG. 20(B).

Upon the start of the gripper 81 for turning from the position X shown in FIG. 20(A), the impression cylinder 27 presses the bundling tape T against the color stamping roller 24 to resume printing the bundling tape T with the color. The impression cylinder 27 is retracted from the working position upon the completion of printing the color on a length of the bundling tape T for bundling one bank note stack. The impression cylinder 27 is retracted from the working position during the turning of the gripper 81 from the position X shown in FIG. 20(A) to the position Y shown in FIG. 20(B).

In a state where the gripper 81 is at the position Y and the rollers including the rollers 75 and 76 are stopped as shown in FIG. 20(B), the sensor of the detecting unit 90 shown in FIG. 19 detects the gripper 81. Then, the controller 88 provides a control signal to drive the bank note stack clamping and carrying unit 92.

Consequently, the holding members 63*a* are raised from the position shown in FIG. 18 to clamp a bank note stack P of a set number of bank notes stacked in the stacker 62. Then, the holding members 63*a* holding the bank note stack P are lowered to place the bank note stack P at the bundling position $G_2$ shown in FIG. 20(B) in the bundling unit $G_1$. The bank note stack P is supported on the positioning member 65A at the bundling position $G_2$.

The holding members 63*a* continue to hold the bank note stack P at the bundling position $G_2$ until time immediately before the completion of a bundling process for bundling the bank note stack P as shown in FIG. 22(A). The holding members 63*a* are raised to their home positions shown in FIG. 18 to prepare for carrying the next bank note stack P after releasing the bank note stack P at the bundling position $G_2$.

The counterclockwise turning of the gripper 81 from the position Y shown in FIG. 20(B) is resumed. The counterclockwise turning of the gripper 81 is stopped immediately after the gripper 81 has come into contact with the left side surface, as viewed in FIG. 20(B), of the bank note stack P at the position Z shown in FIG. 21(A).

Although the rollers including the rollers 75 and 76 of the tape carrying system 74 are kept stationary during the turning of the gripper 81 from the position Y shown in FIG. 20(B) to the position Z shown in FIG. 21(A), a length of the bundling tape T sufficient to wind the bundling tape T loosely round the bank note stack P has been previously fed by the forward rotation of the rollers including the rollers 75 and 76.

The clamping members 64*a* of the clamping device 64 shown in FIG. 18 bank note stack P when the gripper 81 arrives at the position Z shown in FIG. 21(A). The clamping device 64 shown in FIG. 18 clamps the bank note stack P. The paired clamping members 64*a* of the clamping device 64 come into contact with parts on the opposite sides of the bundling tape T with respect to the width of the bundling tape T of the opposite side surfaces of the bank note stack P to clamp the bank note stack P. The clamping members 64*a* guide the opposite side edges of the bundling tape T so that the bundling tape T may be at a proper position on the bank note stack P when the bundling tape T is pulled back for bundling.

After the gripper 81 has been positioned at the position Z shown in FIG. 21(A) and the clamping members 64*a* have clamped the bank note stack P, the rollers 75, 76, 19', 19" and 77 of the tape carrying system 74 are driven for reverse rotation by numbers of turning corresponding to predetermined numbers of reverse drive pulses with the rollers 78 kept stationary to pull back the bundling tape T to tighten the bundling tape T wound round the bank note stack P. The tension roller 79 pressing the bundling tape T takes up a slack in the bundling tape T.

The bundling tape T wound round the bank note stack P is tightened as shown in FIG. 21(B) by thus pulling back the bundling tape T. The rollers including the rollers 75 and 76 of the tape carrying system 74 are stopped after the bundling tape T wound round the bank note stack P has been thus tightened.

Subsequently, the heat-bonding member 67 is advanced and is pressed against a two-layered part of the bundling tape T formed by superposing a leading end part and a trailing end part of the bundling tape T to heat-bond the superposed parts of the bundling tape T and, at the same time, the tape cutter 66 is advanced to cut the bundling tape T. The heat-bonding member 67 and the tape cutter 66 are returned to their home positions as shown in FIG. 22(A) after the two-layered part of the bundling tape T has been bonded together.

Sensors of the detecting unit 90 shown in FIG. 19 detect the heat-bonding member 67 and the tape cutter 66 returned to their home positions. Then, the rollers 75, 76, 19', 19" and 77 are driven for reverse rotation, the rollers 78 is kept stationary and the tension roller 79 moves so as to take up a slack in the bundling tape T. Thus the leading end of the bundling tape T is retracted from the position $a_1''''$ to the print starting position $a_2$ shown in FIG. 22(A) corresponding to the sensor $S_1$.

Upon the detection the leading end of the bundling tape T retracted from the position $a_1''''$ to the print starting position $a_2$ corresponding to the sensor $S_1$ by the sensor $S_1$, the controller 88 provides a control signal to stop the motors $M_x$ of the bank note bundling and storing unit 93. Thus the rollers including the rollers 75 and 76 are stopped. Then, the holding members 63*a* release the bank note stack P and are raised to their home positions shown in FIG. 18.

Then, force applied to the gripping members 81*a* to grip the leading end of the bundling tape T is removed. Then, the gripping members 81*a* are moved into the paper in FIG. 22(A) to pull off the gripping members 81*a* from the bank note bundle.

Then, the bank note stack positioning member 64A supporting the bank note bundle is moved away from the supporting position so that the bank note stack positioning member 64A may not obstruct dropping the bank note bundle. Then, the clamping members 64*a* are separated from the bank note bundle to release the bank note bundle. The bank note bundle drops into the container.

At this stage, the gripping members 81*a* of the gripper 81 are at the position Z indicated by chain lines in FIG. 22(B) and are separated from each other. Then, the gripper 81 is turned clockwise to the position X in FIG. 22(B), the gripper 81 is moved in a direction out of the paper to its home position shown in FIG. 20(A) to prepare for the next bundling process. At this stage, the leading end of the bundling tape T is at the print starting position $a_2$ corresponding to the sensor $S_1$.

In this state, a set number of bank notes of a set denomination are stacked in a bank note stack in the stacker 62, and then the next bundling process is started. If the number of the bank notes stacked in the stacker 62 is less than the set number, the next bundling process is started after the number of the stacked bank notes has coincided with the set number. The bundling operation mentioned in connection with FIGS. 20(A) to 22(B) is carried out.

When the denomination needs to be changed while the print mode is set, the operating unit 89 is operated to set a desired denomination and a desired number of bank notes. Then, the color stamping roller 24 for printing a color indicating the newly set denomination is positioned at the printing position. All the bank notes remaining in the stacker 62 are removed to empty the stacker 62 and are returned to the storage unit. Then, the start button of the operating unit 89 is pushed to bundle the bank notes of the set denomination in the print mode.

When the operating unit 89 sets the nonprint mode, the leading end of the bundling tape T is shifted from the position $a_2$ to the position $a_1$ to prepare for a bundling process. The start button of the operating unit 89 is operated to start stacking bank notes. The bundling operation is started after a set number of bank notes have been stacked.

Naturally, the printing mechanism 21 of the bank note bundling machine in the second embodiment may be provided with the ink-jet printer shown in FIGS. 16 and 17, and the bank note bundling machine in the second embodiment performs the same operations as the bank note bundling machine in the first embodiment.

When the operating unit 89 changes the print mode for the nonprint mode, the leading end of the bundling tape T is shifted from the position $a_2$ to the position $a_1$ as shown in FIG. 20(A) to prepare for a bundling process. The start button of the operating unit 89 is operated to start stacking bank notes in the stacker 62. After a set number of bank notes have been stacked, the foregoing bundling operation is started.

Naturally, the printing mechanism 21 of the bank note bundling machine in the second embodiment may be provided with the ink-jet printer shown in FIGS. 16 and 17, and the bank note bundling machine in the second embodiment performs the same operations as the bank note bundling machine in the first embodiment.

A bank note bundling machine in a third embodiment according to the present invention will be described with reference to FIGS. 23 to 25.

Figure 23:
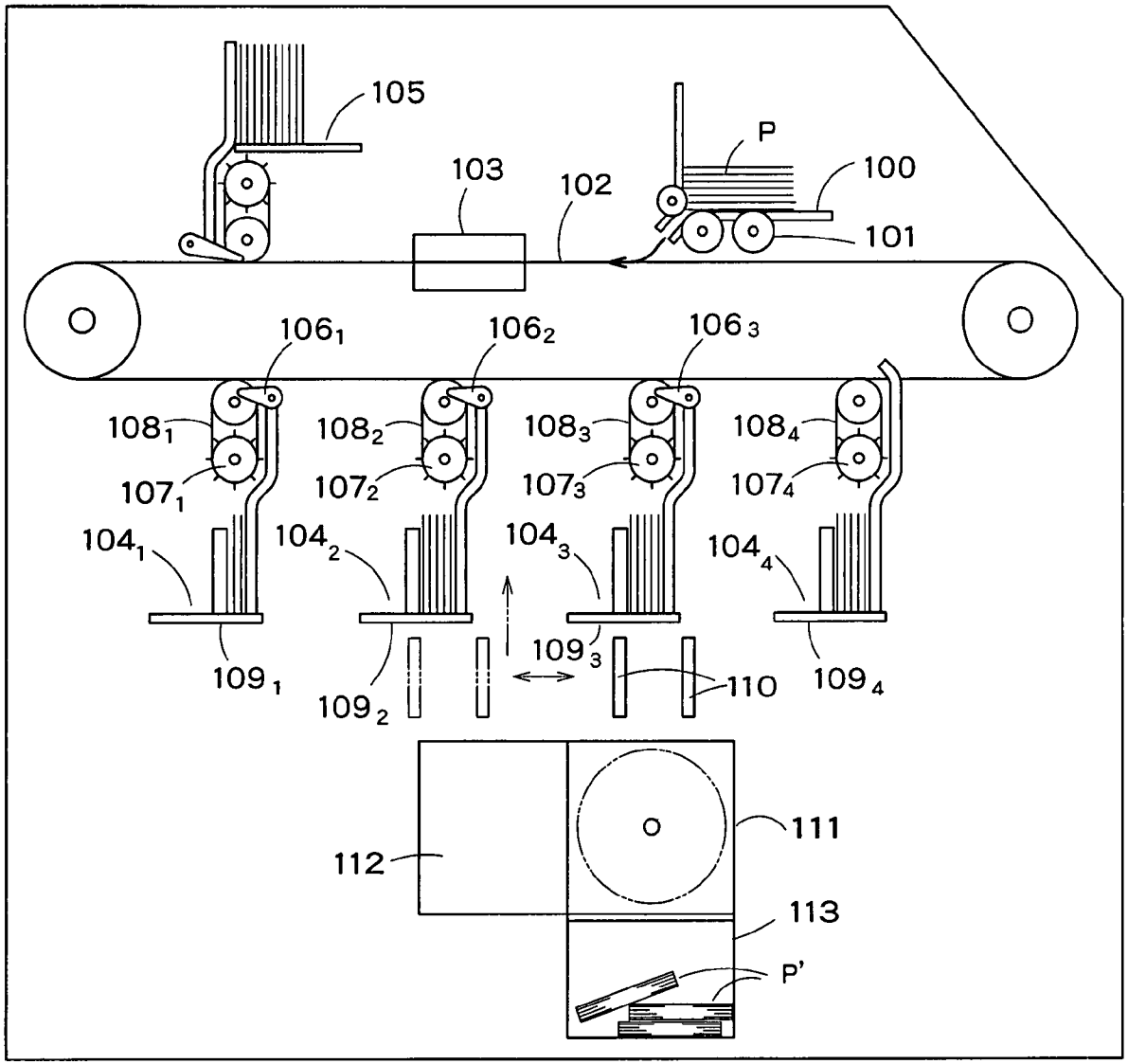
FIG. 23 is a schematic view of a bank note bundling machine in a third embodiment according to the present invention.

FIG. 23 is a view of assistance in explaining a stacking operation for stacking bank notes in a stacker. Bank notes of a bank note stack P loaded into a bank note feed unit 100 are fed one by one by a feed mechanism 101. A carrying device 102 carries the bank notes fed by the bank note feed unit 100 successively. An identification unit 103 disposed near the carrying device 102 identifies the bank notes by denomination. The bank notes are sorted by denomination and the sorted bank notes are distributed to bank note stackers $\mathbf{104}_1$, $\mathbf{104}_2$, $\mathbf{104}_3$ and $\mathbf{104}_4$ respectively for stacking sorted bank notes of different denominations according to denominations read by the identification unit 103. Rejected bank notes are stacked in a rejection unit 105.

The bank notes are stacked in a vertical position in the sorted bank note stackers $\mathbf{104}_1$ to $\mathbf{104}_4$. Pickup members $\mathbf{106}_1$ to $\mathbf{106}_3$ are disposed at the entrances of the stackers $\mathbf{104}_1$, $\mathbf{104}_2$ and $\mathbf{104}_3$, respectively. Any pickup member is not disposed at the entrance of the stacker $\mathbf{104}_4$. The pickup members $\mathbf{106}_1$ to $\mathbf{106}_3$ are actuated according to the denominations of the bank notes recognized by the identification unit 103 to take the bank notes into the corresponding sorted bank note stackers $\mathbf{104}_1$ to $\mathbf{104}_4$.

The bank notes picked up by the pickup members $\mathbf{106}_1$ to $\mathbf{106}_3$ are delivered to support tables $\mathbf{109}_1$ to $\mathbf{109}_4$ by vane wheels 107, to $\mathbf{107}_4$ and belts $\mathbf{108}_1$ to $\mathbf{108}_4$. The bank notes are stacked in a vertical position on the support tables $\mathbf{109}_1$ to $\mathbf{109}_4$.

A bank note stack carrying device including a pair of holding members 110 is placed under the sorted bank note stackers $\mathbf{104}_1$ to $\mathbf{104}_4$. The bank note stack carrying device is capable of moving in the directions of the arrows, of stopping right under each of the sorted bank note stackers 104$_1$ to 104$_4$ and of rising toward each of the sorted bank note stackers 104$_1$ to 104$_4$ to hold a bank note stack P between the holding members 110. The bank note stack carrying device holding a bank note stack P descends from a position right above a bank note bundling unit 111 toward the bundling unit 111 and hands over the bank note stack P to clamping members, similar to those of the second embodiment, included in the bundling unit 111. The bundling unit 111 bundles the bank note stack P. A tape feed unit 112 includes a tape reel, a tape reel, a tape feed passage and a printing mechanism respectively corresponding to those of the first or the second embodiment. Shown also in FIG. 13 are a bank note bundle storing unit 113 and a bank note bundle P'. The bundling unit 111 and the tape feed unit 112 are entirely the same as those of the second embodiment shown in FIG. 18.

Figure 24:
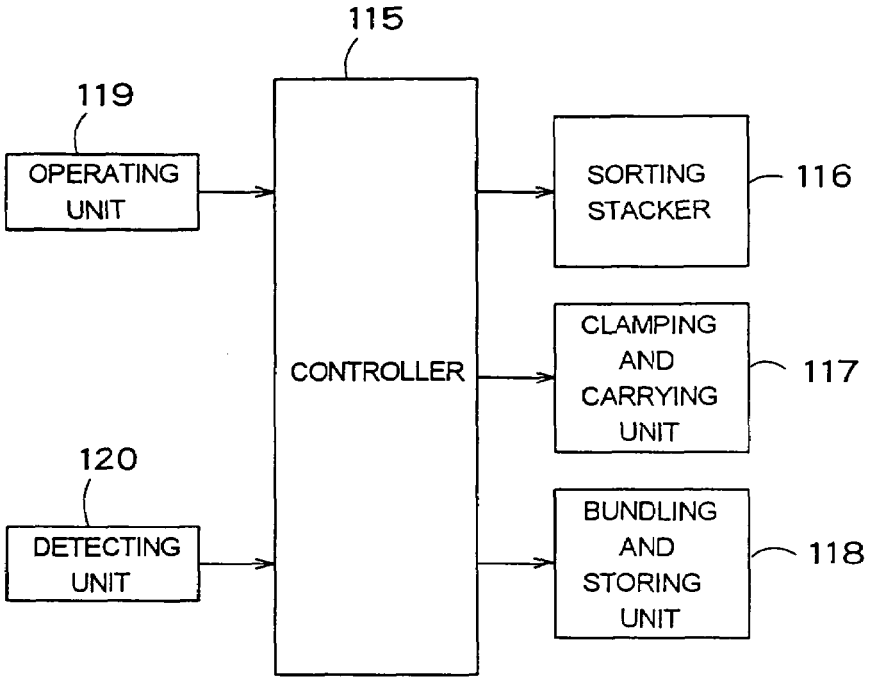
FIG. 24 is a block diagram of the bank note bundling machine shown in FIG. 23.

FIG. 24 is a block diagram of the bank note bundling machine shown in FIG. 23. Indicated at 115 in FIG. 24 is a controller.

A bank note sorting stacker 116 shown in FIG. 24 includes the bank note feed unit 100, the feed mechanism 101, the carrying device 102, the identification unit 103, the sorted bank note stackers 104$_1$ to 104$_4$, the rejection unit 105, the pickup members 106, to 106$_3$, the vane wheels 107$_1$ to 107$_4$, the belts 108$_1$ to 108$_4$, and the support tables 109$_1$ top 109$_4$ shown in FIG. 23.

A bank note stack holding and carrying unit 117 shown in FIG. 24 includes mechanisms for horizontally and vertically moving the holding members 110 shown in FIG. 23 and for moving the holding members 110 to hold a bank note stack and carrying a bank note stack to the bundling unit 111, and mechanisms for retracting the support tables 109$_1$ to 109$_4$. Each of the support tables 109$_1$ to 109$_4$ is retracted from a support position after a bank note stack supported thereon has been held between the holding members 110. The holding members 110 correspond to the holding members 63*a* shown in FIG. 18.

A bank note bundling and storing unit 118 shown in FIG. 24 includes the bundling unit 111, the tape feed unit 112 and the bank note bundle storing unit 113 shown in FIG. 23. The bundling unit 111 and the tape feed unit 112 are the same in construction as those of the second embodiment shown in FIG. 18.

An operating unit 119 shown in FIG. 24 selects a bundling operation in a print mode or a bundling operation in a nonprint mode and sets the number of bank notes to be bundled.

A detecting unit 120 shown in FIG. 24 includes the identification unit 103 shown in FIG. 23 and sensors included in the bank note sorting stacker 116, the bank note stack holding and carrying unit 117 and the bank note bundling and storing unit 118.

Modes of operation of the bank note bundling machine in the third embodiment will be described.

Denomination-sorted Batching Mode

Usually, the denomination-sorted batching mode uses the four bank note stackers 104$_1$ to 104$_4$ to stack set numbers of bank notes of different denominations respectively in the stackers 104$_1$ to 104$_4$. The operating unit 119 shown in FIG. 24 sets the denomination-sorted batching mode.

The identification unit 103 identifies bank notes respectively of four specified denominations fed by the bank note feed unit 100 by denomination. The bank notes of the specified denominations are sorted by denomination and the sorted bank notes are taken into the stackers 104$_1$ to 104$_4$, respectively. Bank notes of denominations other than the specified denominations are stacked in the rejection unit 105. The controller 115 counts the respective numbers of the sorted bank notes on the basis of the number of the denominations read by the identification unit 103. Upon the coincidence of the number of the sorted bank notes stacked in one of the stackers 104$_1$ to 104$_4$ with a set number, the controller 115 stops the bank note feed operation of the bank note feed unit 100. Thus the bank note feed unit 100 interrupts the bank note feed operation after the number of the sorted bank notes stacked in one of the 104$_1$ to 104$_4$ has coincided with the set number.

Suppose that the set number of the sorted bank notes have been stacked in the stacker 104$_1$. The bank note bundling and storing unit 118 starts its operation provided that the bundling unit 111 has been set at a predetermined bundling position (FIG. 20(A)) and the leading end of the bundling tape T has been positioned at the position $a_1$ for the nonprint mode or at the position $a_2$ for the print mode to prepare for a bundling process.

The bundling unit of the second embodiment shown in FIG. 18 operates as mentioned in connection with FIGS. 20(A) and 20(B) to wind the bundling tape T round the bank note stack. The leading end of the bundling tape T starts from the position $a_2$ in the print mode or from the position $a_1$ in the nonprint mode. A length of a part, necessary for bundling one bank note stack, of the bundling tape T extending backward from the position $a_2$ is printed in the print mode. The bundling tape T is not printed in the nonprint mode. When the number of the sorted bank notes stacked in one of the stackers 104$_1$ to 104$_4$ has coincided with the set number in the print mode, the controller 115 shown in FIG. 24 sets the printing mechanism 21 of the bank note bundling and storing unit 118 for printing a mark indicating the denomination of the bank notes stacked in the stacker before the set number of the bank notes is delivered from the stacker to the bundling unit 111.

After the gripper 81 of the bundling unit $G_1$, namely, the bundling unit 111, have been moved to and has been stopped at the position Y shown in FIG. 20(B) and, in the print mode, the bundling tape T for bundling the bank note stack of bank notes of the denomination has been printed, the pair of holding members 110 carry the bank note stack of a set number of bank notes of the set denomination to the bundling unit 111.

The pair of holding members 110 are moved horizontally from a position right above the bundling unit 111 to the stacker, holding a set number of bank notes, among the stackers 104$_1$ to 104$_4$, is raised toward the stacker to hold the bank note stack, is lowered, and is moved horizontally to the position indicated by continuous lines in FIG. 23. Actually, the holding members 110 holding the bank note stack are closer to each other than those shown in FIG. 23.

The controller 115 gives a control signal to the bank note stack holding and carrying unit 117 to start the foregoing operation upon the detection of the bank note stack of bank notes of one of the four set denominations.

The bank note feed unit 100 resumes the bank note feed operation after the bank note stack held by the pair of holding members 110 has been carried to a position indicated by continuous lines on FIG. 23. The bank notes of the specified denominations are stacked in the stackers 104$_1$ to 104$_4$, respectively, and the bank note feed unit 100 stops the bank note feed operation upon the coincidence of the number of bank notes stacked in one of the stackers 104$_1$ to 104$_4$ with a set number of bank notes.

On the other hand, the controller 115 decides whether or not the gripper 81 of the bundling unit $G_1$ is at the position Y shown in FIG. 20(B). The pair of holding members 110 place the bank note stack P at the bundling position $G_2$ shown in FIG. 20(B) and hold the bank note stack P at the bundling position $G_2$ when the gripper 81 is positioned at the position Y shown in FIG. 20(B) or, if the gripper 81 is not positioned yet at the position Y shown in FIG. 20(B), after moving the bank note stack P to and placing the same at the position Y. This operation of the pair of holding members 110 is the same as that of the holding members 63*a* shown in FIG. 18. Time of returning the holding members 101 to their upper positions is the same as that of returning the holding members 63*a* to their upper positions.

In a phase, shown in FIG. 22(A), of the bundling process, the pair of holding members 110 release the bank note stack P and return to positions indicated by continuous lines in FIG. 23. When a set number of bank notes are stacked in one of the stackers $\mathbf{104}_1$ to $\mathbf{104}_4$ at this stage or after a set number of bank notes have been stacked in one of the stackers $\mathbf{104}_1$ to $\mathbf{104}_4$ if a set number of bank notes are not stacked in none of the stackers $\mathbf{104}_1$ to $\mathbf{104}_4$, the pair of holding members 110 are moved horizontally, are stopped at a position directly below the stacker in which a set number of bank notes have been stacked, are raised, hold the bank note stack are lowered and are moved horizontally to the position indicated by continuous lines in FIG. 23. The holding members 110 keep holding the bank note stack at this position.

When a set number of bank notes of the set denomination are stacked in one of the stackers $\mathbf{104}_1$ to $\mathbf{104}_4$ while the bank note bundling machine is set for the print mode, the printing mechanism 21 is set for printing a mark indicating the denomination, provided that the bundling unit 111 is positioned at the predetermined position shown in FIG. 20(A) and the leading end of the bundling tape T is set at the predetermined position $a_2$ in preparation for starting a bundling process.

A printing mechanism setting operation is executed to set the printing mechanism 21 for printing the mark indicating the denomination of the bank notes of a bank note stack when the bank note stack of a set number of bank notes stacked in one of the stackers $\mathbf{104}_1$ to $\mathbf{104}_4$ is detected through the operations of the identification unit 103 and the controller 115, the gripper 81 positioned at the position X in FIG. 20(A) is detected by a sensor, not shown, included in the detecting unit 90 shown in FIG. 19 and the leading end of the bundling tape T positioned at the position $a_2$ is detected by the sensor $S_1$. This printing mechanism setting operation for setting the printing mechanism 21 for printing the mark indicating the denomination is executed only in the print mode and is not executed in the nonprint mode.

After the printing mechanism 21 has been set for printing the mark indicating the denomination in the print mode or after a set number of bank notes have been stacked in one of the stackers $\mathbf{104}_1$ to $\mathbf{104}_4$, the bundling unit 111 and the leading end of the bundling tape T have been set at the predetermined positions for starting a bundling process with the gripper 81 positioned at the position X shown in FIG. 20(A) and the leading end of the bundling tape T at the position $a_1$ detected by the sensor $S_1$ in the nonprint mode, the bundling operation of the bundling unit 111, namely, the bundling unit $G_1$ shown in FIG. 20(A), starts the bundling process.

At the start of feeding the bundling tape T, the leading end of the bundling tape T is at the position $a_1$ shown in FIG. 20(A) in the nonprint mode, or at the print starting position $a_2$ shown in FIG. 20(A) in the print mode. The gripper 81 is moved to the position Y shown in FIG. 20(B) through the same steps as those performed by the second embodiment.

When the gripper 81 arrives at the position Y shown in FIG. 20(B) at a stage when the pair of holding members 110 holding the bank note stack are positioned at the positions indicated by continuous lines in FIG. 23, or in a state where the gripper 81 has previously arrived at the position Y, the holding members 110 holding the bank note stack are lowered to place the bank note stack at the bundling position $G_2$ indicated by chain lines in FIG. 20(B). Then, the holding members 110 are returned to the positions indicated by continuous lines in FIG. 23 along the path shown in FIGS. 21(A) to 22(B). The holding members 110 are returned to the positions indicated by con tenuous lines in FIG. 23 at a stage shown in FIG. 22(A). A bank note bundle is sent out from the bundling unit $G_1$ and is contained in the bank note bundle storing unit 113 shown in FIG. 23 at the stage shown in FIG. 22(A). The operating unit 119 shown in FIG. 24 of the bank note bundling machine in the third embodiment is able to make all the stackers $\mathbf{104}_1$ to $\mathbf{104}_4$ stack a set number of bank notes of the same denomination in a single-denomination batching mode.

Single-denomination Batching Mode

Suppose that the stackers $\mathbf{104}_1$ to $\mathbf{104}_4$ stack one hundred 10,000-yen bank notes sequentially in that order and bank notes of denominations other than 10,000 yen are collected in the reject unit 105.

When the operating unit 119 shown in FIG. 24 sets a single-denomination batching mode, the print mode and a denomination, the color stamping roller 24, for printing a color indicating the set denomination, of the printing mechanism 21 shown in FIG. 20(A) is placed at the printing position. When the nonprint mode is set, none of the color stamping rollers 24 is placed at the printing position. The position $a_1$ shown in FIG. 20(A) is a set position for the leading end of the bundling tape T when the operating unit 119 sets the nonprint mode. The print starting position $a_2$ shown in FIG. 20(A) is a set position for the leading end of the bundling tape T when the operating unit 119 sets the print mode. The rollers including the rollers 75 and 76 are driven for forward rotation or reverse rotation to set the leading end of the bundling tape T at the set position.

The operation of the bank note bundling machine in the single-denomination batching mode will be described.

The operating unit 119 shown in FIG. 24 sets the single-denomination batching mode, the print or the nonprint mode, and the denomination. The leading end of the bundling tape T is placed at the position $a_1$ or $a_2$, and, when the print mode is set, the printing mechanism 21 is set for the denomination.

Then, bank notes are loaded into the bank note feed unit 100 and the start button of the operating unit shown in FIG. 24 is pushed. When a batch of the bank notes, namely, one hundred bank notes, are stacked in the stacker $\mathbf{104}_1$, the pickup member 106, is set at an inoperative position to make the following bank notes are carried past the stacker $\mathbf{104}_1$. Then, the bank notes are stacked in the stacker $\mathbf{104}_2$. After one hundred bank notes have been stacked in the stacker $\mathbf{104}_2$, the bank notes are stacked in the stacker $\mathbf{104}_3$ and then in the stacker $\mathbf{104}_4$. Thus the stackers $\mathbf{104}_1$ to $\mathbf{104}_4$ stack one hundred bank notes sequentially.

When the one hundred bank notes stacked in the stacker $\mathbf{104}_1$ is held and carried by the pair of holding members 110 to the bundling device of the bundling unit 111 and one hundred bank notes are stacked in each of the stackers $\mathbf{104}_2$ to $\mathbf{104}_4$, the bank note feed unit 100 stops the bank note feed operation temporarily, and resumes the bank note feed operation to stack the bank notes in the stacker $\mathbf{104}_1$ after the one hundred bank notes have been held by the holding members 110 and are taken out of the stacker $\mathbf{104}_1$.

In a state where one hundred bank notes have been stacked in each of the stackers $\mathbf{104}_1$, $\mathbf{104}_2$ and $\mathbf{104}_3$, the bank notes stacked in the stacker $\mathbf{104}_1$ has been bundled, and a batch of the bank notes stacked in the stacker $\mathbf{104}_3$ and held between the holding members 110 is ready to be sent to the bundling unit 111 or is about to be sent to the bundling unit 111, the operation for stacking the bank notes in the stacker $\mathbf{104}_4$ is continued.

For example, when a batch of one hundred bank notes have been stacked in the stacker $\mathbf{104}_1$, the pair of holding members 110 are moved horizontally to positions right below the stacker $\mathbf{104}_1$, are raided to hold the one hundred bank notes between the holding members 110, and the holding members 110 holding the one hundred bank notes are lowered. Then, the holding members 110 holding the one hundred bank notes are returned to the positions indicated by continuous lines in FIG. 23.

Upon the completion of stacking one hundred bank notes in the stacker $\mathbf{104}_1$, the detecting unit 120 gives a signal to the controller 115, and a bundling process is started provided that the leading end of the bundling tape T is positioned at the proper position and the bundling unit $G_1$ is ready for the bundling process.

After the leading end of the bundling tape T has been moved from the position $a_1$ or $a_2$ to the position $a_1$41 shown in FIG. 20(B), the holding members 110 hand over the one hundred bank notes to the bundling unit 111 shown in FIG. 23. The one hundred bank notes are placed at the bundling position $G_2$ shown in FIG. 20(B).

The holding members 110 release the bank notes in a state shown in FIG. 22(A), and then return to the positions indicated by continuous lines in FIG. 23. If one hundred bank notes have been stacked in the stacker $\mathbf{104}_2$, the holding members 110 are moved horizontally to positions right below the stacker $\mathbf{104}_2$, are raised toward the stacker $\mathbf{104}_2$, hold a batch of the bank notes, are lowered, and are returned to the positions indicated by continuous lines in FIG. 23 to prepare for sending the batch of the bank notes to the bundling position shown in FIG. 20(B).

The one hundred bank notes stacked in the stacker $\mathbf{104}_1$ are bundled by steps shown in FIGS. 21(A), 21(B) and 22(A) in a bank note bundle, and the bank note bundle is released into the bank note bundle storing unit. The bundling unit $G_1$ is changed from the condition shown in FIG. 22(B) to the condition shown in FIG. 20(A).

After one hundred bank notes have been stacked in the stacker $\mathbf{104}_2$, the same operation as that performed for the stacker $\mathbf{104}_1$ is executed to move the leading end of the bundling tape T from the position $a_1$ or $a_2$ shown in FIG. 20(A) to the position $a_1$" shown in FIG. 20(B). At time when the holding members 110 holding one hundred bank notes are set at the waiting positions indicated by continuous lines in FIG. 23, or after the holding members holding one hundred bank notes have been moved to the waiting positions when the holding members 110 are not in a waiting condition at that time, the holding members 110 place the one hundred bank notes at the bundling position $G_2$ shown in FIG. 20(B) of the bundling unit 111. Then, the bank notes are bundled in a bank note bundle, the bank note bundle is released, and the holding members 110 are returned to the positions indicated by continuous lines in FIG. 23.

Those operations are the same as those for bundling the bank notes stacked in the stacker $\mathbf{104}_1$. The foregoing operations are performed for bundling bank notes stacked in the stackers $\mathbf{104}_3$ and $\mathbf{104}_4$, and bundling batches of bank notes after the operation for stacking bank notes in the stacker $\mathbf{104}_1$ has been resumed.

In the print mode, the bank note bundling machine in the third embodiment, similarly to those in the first and the second embodiment, prints a length of the bundling tape T for bundling one bank note stack after the leading end of the bundling tape T has been advanced from the position $a_2$.

Although the printing operation has been explained on an assumption that the substantially whole length of the bundling tape T for bundling one bank note stack is printed, the bundling tape T may be printed by a printing operation that does not print a reading part of a length $L_2$ (FIG. 25(B) of a bundling tape T of a length $L_1$ to be covered with a trailing part of the bundling tape T, and prints a part of a length ($L_1$-$L_2$) that is not covered as shown in FIG. 25(A).

Figure 25:
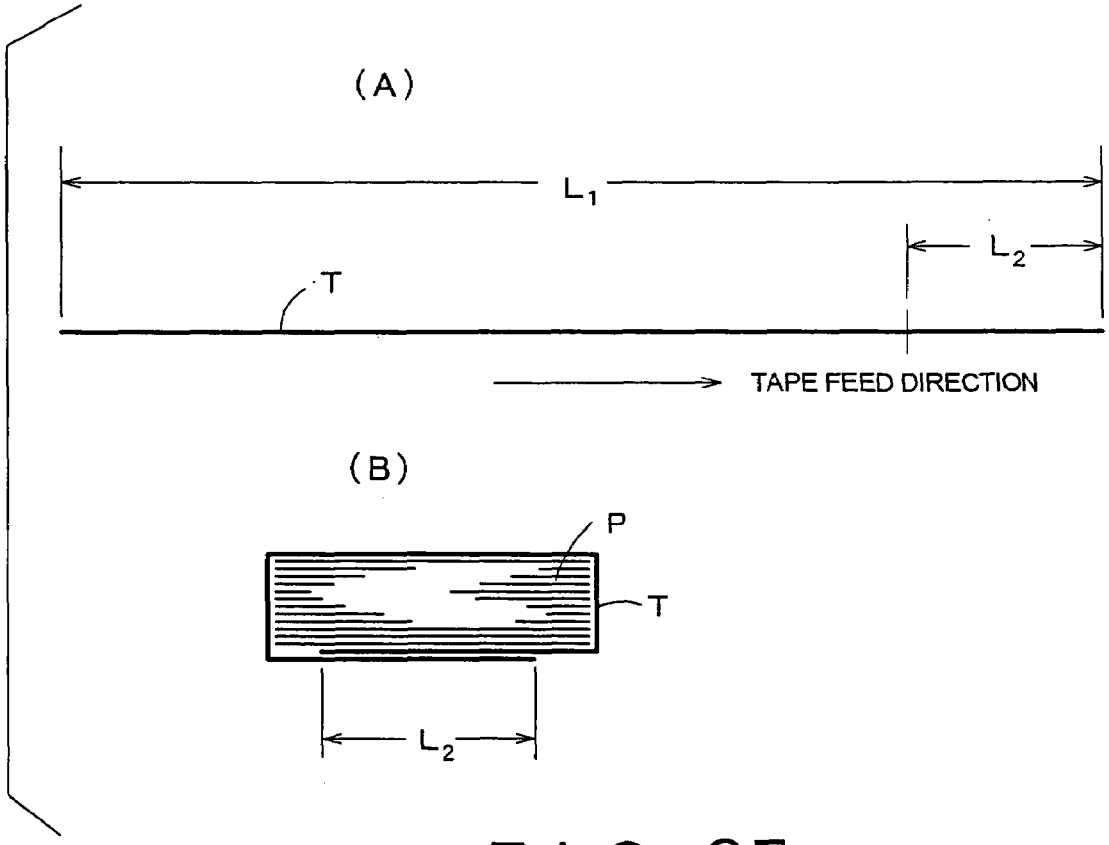
FIG. 25 is a view of assistance in explaining the relation between the length of a bundling tape and the length of a printed part of a bundling tape and the relation between a bundled bank notes and an unprinted part of a bundling tape.

When the bundling tape T is printed as shown in FIG. 25, the bundling tape T may be printed by a printing method that starts the leading end of the bundling tape T from a position corresponding to the sensor $S_1$ (FIG. 2) for printing, does not print a leading part of the length $L_2$ of the bundling tape T, and starts pressing the bundling tape T against the color stamping roller 24 by the impression cylinder 27 after a part of the length $L_2$ of the bundling tape T has been fed.

Another possible printing method sets a print starting position, from which the leading end of the bundling tape T is started for printing, at a position at a distance corresponding to the length $L_2$ below the impression cylinder 27, namely, a position on the side of the sensor $S_1$ with respect to the impression cylinder 27.

The position of the sensor $S_1$ in each of the first to the third embodiment is the position of the leading end of the bundling tape T. The sensor $S_1$ may be disposed at a distance corresponding to the length $L_2$ below from the impression cylinder 27, the stating position of the leading end of the bundling tape T may correspond to the position of the sensor $S_1$; that is, the sensor $S_1$ is disposed opposite to a section between the rollers 75 (76) and the roller 80*a* of the tape feed passage 20 in FIG. 20(A).

In the first to the third embodiment, the stating position of the leading end of the bundling tape T in the nonprint mode is above a position where the gripper 3 (81) grips the leading end of the bundling tape T. The stating position of the leading end of the bundling tape T in the nonprint mode may be a position where the gripper 3 (81) grips the leading end of the bundling tape T.

The invention claimed is:

1. A bank note bundling machine comprising:

a bank note bundling unit including a bundling space into which a bank note stack is loaded, the bundling unit being configured to bundle the bank note stack loaded into the bundling space with a bundling tape;

a tape reel for holding the bundling tape in a wound state;

a tape feed unit having a tape feed passage, the tape feed unit being configured to feed the bundling tape pulled out from the tape reel to the bundling unit and to extend a part, pulled out at a predetermined time in a tape feed process, of the bundling tape with a leading end part of the bundling tape projecting into the bundling space of the bundling unit;

a tape winding unit provided with a movable tape gripper for gripping the leading end part of the bundling tape projecting from the terminal end of the tape feed passage into the bundling space at a tape gripping position, the tape winding unit being configured to wind the bundling tape round the bank note stack by moving the tape gripper around the bank note stack with the leading end part of the bundling tape gripped by the tape gripper;

a tape carrying mechanism placed on the tape feed passage to perform a forward feed operation to feed the bundling tape forward such that the bundling tape wound round the bank note stack by the tape gripper has a predetermined slack and a reverse feed operation to reverse the bundling tape so that the slack in the bundling tape is taken up and the bundling tape is tightened; and a cutting-and-bonding unit placed in the bundling unit to cut off a trailing end of the tightened bundling tape and heat-bonding the leading end and the trailing end of the bundling tape, characterized in that the tape reel holds a common bundling tape to be used for bundling bank notes of different denominations, the bank note bundling machine further comprising:

a printing mechanism placed in the tape feed passage to print the bundling tape with a plurality of colors, each of said colors indicating a denomination of a corresponding one of the bank note stacks to be bundled; and a controller controlling the tape carrying mechanism and the printing mechanism, and the controller executes: (a) a first operation for setting the leading end of the bundling tape at a print starting position upstream of a terminal end of the tape feed passage in preparation for bundling the bank note stack loaded into the bundling space and advancing the leading end of the bundling tape upon a start of a bundling process from the print starting position to the tape gripping position in the bundling unit; (b) a second operation for printing the bundling tape with the color indicating the denomination by the printing mechanism in a tape feed period in which the leading end of the bundling tape is advanced and!or the tape carrying mechanism is in the forward feed operation so that an outermost layer of the bundling tape bundling the bank notes is substantially wholly printable with the color; and (c) a third operation for moving the leading end of the following bundling tape, after cutting off the bundling tape, to the print starting position by the reverse feed operation of the tape carrying mechanism to prepare for the next bundling process.

2. The bank note bundling machine according to claim 1, further comprising a mode specifying unit for instructing the controller to select either of a print mode and a nonprint mode; wherein the controller executes, at the start of the bundling process, an operation for setting the leading end of the bundling tape at the print starting position when the mode specifying unit specifies the print mode, and setting the leading end of the bundling tape at the print starting position or at the tape gripping position when the mode specifying unit specifies the nonprint mode.

3. The bank note bundling machine according to claim 1, further comprising a denomination input unit for inputting the denomination of bank notes to be bundled into the controller, wherein the controller controls the tape carrying mechanism and the printing mechanism to adjust a length of the bundling tape necessary for bundling each bank note stack and a length of a part to be printed of the bundling tape on the basis of the denomination input by the denomination input unit.

4. The bank note bundling machine according to claim 1, further comprising a bank note bundle size input unit for inputting the number of bank notes in each bank note stack to be bundled into the controller, wherein the controller controls the tape carrying mechanism and the printing mechanism to adjust a length of the bundling tape necessary for bundling each bank note stack and a length of a part to be printed of the bundling tape on the basis of the number of bank notes input by the bank note bundle size input unit.

5. The bank note bundling machine according to claim 1, further comprising a denomination input unit and a bank note bundle size input unit respectively for inputting the denomination and the number of bank notes in each bank note stack to be bundled, wherein the controller controls the tape carrying mechanism and the printing mechanism to adjust a length of the bundling tape necessary for bundling each bank note stack and a length of a part to be printed of the bundling tape on the basis of the denomination and the number of bank notes input by the denomination input unit and the bank note bundle size input unit, respectively.

6. The bank note bundling machine according to claim 1, wherein the printing mechanism comprises:

a rotating disk rotatably supported opposite to one of opposite surfaces of the bundling tape extended along the tape feed passage;

a plurality of color stamping rollers, respectively for printing the bundling tape with different colors, arranged on a common circle on and rotatably supported on the rotating disk; and an impression cylinder supported for movement toward and away from the tape feed passage, the impression cylinder being configured to press the bundling tape against one of the color stamping rollers disposed opposite to one of the surfaces of the bundling tape extended along the tape feed passage.

7. The bank note bundling machine according to claim 1, wherein the tape winding unit further comprises an endless belt for moving the tape gripper.

8. A bank note bundling machine comprising:

a bank note bundling unit including a bundling space into which a bank note stack is manually loaded, the bundling unit being configured to bundle the bank note stack loaded into the bundling space with a bundling tape;

a tape reel for holding the bundling tape in a wound state;

a tape feed unit having a tape feed passage, the tape feed unit being configured to feed the bundling tape pulled out from the tape reel to the bundling unit and to extend a part, pulled out at a predetermined time in a tape feed process, of the bundling tape with a leading end part of the bundling tape projecting into the bundling space of the bundling unit;

a tape winding unit provided with a movable tape gripper for gripping the leading end part of the bundling tape projecting from the terminal end of the tape feed passage into the bundling space at a tape gripping position, the tape winding unit being configured to wind the bundling tape round the bank note stack by moving the tape gripper around the bank note stack with the leading end part of the bundling tape gripped by the tape gripper;

a tape carrying mechanism placed on the tape feed passage to perform a forward feed operation to feed the bundling tape forward such that the bundling tape wound round the bank note stack by the tape gripper has a predetermined slack and a reverse feed operation to reverse the bundling tape so that the slack in the bundling tape is taken up and the bundling tape is tightened; and a cutting-and-bonding unit placed in the bundling unit to cut off a trailing end of the tightened bundling tape and heat-bonding the leading end and the trailing end of the bundling tape, characterized in that the tape reel holds a common bundling tape to be used for bundling bank notes of different denominations, the bank note bundling machine further comprising:

a printing mechanism placed in the tape feed passage to print the bundling tape with a plurality of colors, each of said colors indicating a denomination of a corresponding one of the bank note stacks to be bundled;

a denomination input unit for inputting automatically or manually the denomination of bank notes to be bundled; and a controller controlling the tape carrying mechanism and the printing mechanism on the basis of the denomination input by the denomination input unit, and the controller executes: (a) a first operation for placing the leading end of the bundling tape at a print starting position upstream of a terminal end of the tape feed passage in preparation for bundling the bank note stack loaded into the bundling space and advancing the leading end of the bundling tape upon a start of a bundling process from the print starting position to the tape gripping position in the bundling unit; (b) a second operation for printing the bundling tape with the color indicating the denomination by the printing mechanism in a tape feed period in which the leading end of the bundling tape is advanced and/or the tape carrying mechanism is in the forward feed operation so that an outermost layer of the bundling tape bundling the bank notes is substantially wholly printable with the color; and (c) a third operation for moving the leading end of the following bundling tape, after cutting off the bundling tape, to the print starting position by the reverse feed operation of the tape carrying mechanism to prepare for the next bundling process.

9. The bank note bundling machine according to claim 8, wherein the printing mechanism comprises:

a rotating disk rotatably supported opposite to one of opposite surfaces of the bundling tape extended along the tape feed passage;

a plurality of color stamping rollers, respectively for printing the bundling tape with different colors, arranged on a common circle on and rotatably supported on the rotating disk; and an impression cylinder supported for movement toward and away from the tape feed passage, the impression cylinder being configured to press the bundling tape against one of the color stamping rollers disposed opposite to one of the surfaces of the bundling tape extended along the tape feed passage.

10. The bank note bundling machine according to claim 8, wherein the tape winding unit further comprises an endless belt for moving the tape gripper.

11. A bank note bundling machine comprising:

a bank note stacker for stacking a predetermined number of bank notes of a specific denomination in a bank note stack;

a bank note bundling unit including a bundling space into which the bank note stack is loaded from the stacker, the bundling unit being configured to bundle the bank note stack loaded into the bundling space with a bundling tape;

a bank note stack carrying mechanism for carrying a bank note stack prepared by stacking a predetermined number of bank notes in the stacker from the stacker to the bundling unit after the bundling unit has been set ready for a bank note bundling operation;

a tape reel for holding the bundling tape in a wound state;

a tape feed unit having a tape feed passage, the tape feed unit being configured to feed the bundling tape pulled out from the tape reel to the bundling unit and to extend a part, pulled out at a predetermined time in a tape feed process, of the bundling tape with a leading end part of the bundling tape projecting into the bundling space of the bundling unit;

a tape winding unit provided with a tape gripper rotatable about an axis, the tape gripper being configured to grip the leading end part of the bundling tape projecting from the terminal end of the tape feed passage into the bundling space at a tape gripping position, the tape winding unit being configured to wind the bundling tape round the bank note stack by rotating the tape gripper toward and stopping at a bank note stack setting position for allowing the bank note stack to be loaded into the bundling space and rotating the tape gripper around the bank note stack with the leading end part of the bundling tape gripped by the tape gripper;

a tape carrying mechanism placed on the tape feed passage to perform a forward feed operation to feed the bundling tape forward such that the bundling tape wound round the bank note stack by the tape gripper has a predetermined slack and a reverse feed operation to reverse the bundling tape so that the slack in the bundling tape is taken up and the bundling tape is tightened;

a cutting-and-bonding unit placed in the bundling unit to cut off a trailing end of the tightened bundling tape and heat-bonding the leading end and the trailing end of the bundling tape, characterized in that the tape reel holds a common bundling tape to be used for bundling bank notes of different denominations, the bank note bundling machine further comprising:

a printing mechanism placed on the tape feed passage to print the bundling tape with a plurality of colors, each of said colors indicating a denomination of a corresponding one of the bank note stacks to be bundled; and a controller controlling the tape carrying mechanism, the printing mechanism, the winding unit and the cutting-and-bonding unit, and the controller executes: (a) a first operation for setting the leading end of the bundling tape at a print starting position upstream of a terminal end of the tape feed passage in preparation for bundling the bank note stack loaded into the bundling space and advancing the leading end of the bundling tape upon a start of a bundling process from the print starting position to the tape gripping position in the bundling unit; (b) a second operation for printing the bundling tape with the color indicating the denomination by the printing mechanism in when the leading end of the bundling tape is advanced and/or when the tape feed unit is in the forward feed operation so that an outermost layer of the bundling tape bundling the bank note stack is substantially wholly printable with the color; and (c') a third operation for moving the leading end of the following bundling tape to the print starting position by the reverse feed operation of the tape carrying mechanism to prepare for the next bundling process, after rotating the tape gripper from the tape gripping position to the bank note setting position, loading the bank note stack into the bundling space, bundling the bank note stack with the bundling tape by the tape winding unit, tightening the bundling tape bundling the bank note stack and cutting off the tightened bundling tape.

12. The bank note bundling machine according to claim 11, wherein the printing mechanism comprises:

a rotating disk rotatably supported opposite to one of opposite surfaces of the bundling tape extended along the tape feed passage;

a plurality of color stamping rollers, respectively for printing the bundling tape with different colors, arranged on a common circle on and rotatably supported on the rotating disk; and an impression cylinder supported for movement toward and away from the tape feed passage, the impression cylinder being configured to press the bundling tape against one of the color stamping rollers disposed opposite to one of the surfaces of the bundling tape extended along the tape feed passage.

13. The bank note bundling machine according to claim 11, wherein the tape winding unit further comprises an endless belt for rotating the tape gripper.

14. A bank note bundling machine comprising:

a plurality of bank note stackers each for stacking a predetermined number of bank notes of a specific denomination in a bank note stack;

a bank note bundling unit including a bundling space into which the bank note stack is loaded from one of the stackers, the bundling unit being configured to bundle the bank note stack loaded into the bundling space with a bundling tape;

a bank note stack carrying mechanism for holding a bank note stack prepared by stacking a predetermined number of bank notes by at least one of the stackers and carrying the bank note stack from the stacker to the bundling unit after the bundling unit has been set ready for a bank note bundling operation;

a tape reel for holding the bundling tape in a wound state;

a tape feed unit having a tape feed passage, the tape feed unit being configured to feed the bundling tape pulled out from the tape reel to the bundling unit and to extend a part, pulled out at a predetermined time in a tape feed process, of the bundling tape with a leading end part of the bundling tape projecting into the bundling space of the bundling unit;

a tape winding unit provided with a tape gripper rotatable about an axis, the tape gripper being configured to grip the leading end part of the bundling tape projecting from the terminal end of the tape feed passage into the bundling space at a tape gripping position, the tape winding unit being configured to wind the bundling tape round the bank note stack by rotating the tape gripper toward and stopping at a bank note stack setting position for allowing the bank note stack to be loaded into the bundling space and rotating the tape gripper around the bank note stack with the leading end part of the bundling tape gripped by the tape gripper;

a tape carrying mechanism placed on the tape feed passage to perform a forward feed operation to feed the bundling tape forward such that the bundling tape wound round the bank note stack by the tape gripper has a predetermined slack and a reverse feed operation to reverse the bundling tape so that the slack in the bundling tape is taken up and the bundling tape is tightened;

a cutting-and-bonding unit placed in the bundling unit to cut off a trailing end of the tightened bundling tape and heat-bonding the leading end and the trailing end of the bundling tape, characterized in that the tape reel holds a common bundling tape to be used for bundling bank notes of different denominations, the bank note bundling machine further comprising:

a printing mechanism placed in the tape feed passage to print the bundling tape with a plurality of colors, each of said colors indicating a denomination of a corresponding one of the bank note stacks to be bundled, and a controller controlling the tape carrying mechanism, the printing mechanism, the tape winding unit and the cutting-and-bonding unit, upon a completion of stacking a predetermined number of bank notes in at least one of the stackers and a setting of the bundling unit ready for bundling the bank note stack, and the controller executes: (a) a first operation for setting the leading end of the bundling tape at a print starting position upstream of a terminal end of the tape feed passage in preparation for bundling the bank note stack loaded into the bundling space and advancing the leading end of the bundling tape upon a start of a bundling process from the print starting position to the tape gripping position in the bundling unit; (b) a second operation for printing the bundling tape with the color indicating the denomination by the printing mechanism when the leading end of the bundling tape is advanced and/or when the tape feed unit is in the forward feed operation so that an outermost layer of the bundling tape bundling the bank note stack is substantially wholly printable with the color; and (c') a third operation for moving the leading end of the following bundling tape to the print starting position by the reverse feed operation of the tape carrying mechanism to prepare for the next bundling process, after rotating the tape gripper from the tape gripping position to the bank note setting position, loading the bank note stack into the bundling space, bundling the bank note stack with the bundling tape by the tape winding unit, tightening the bundling tape bundling the bank note stack and cutting off the tightened bundling tape.

15. The bank note bundling machine according to claim 14, wherein the printing mechanism comprises:

a rotating disk rotatably supported opposite to one of opposite surfaces of the bundling tape extended along the tape feed passage;

a plurality of color stamping rollers, respectively for printing the bundling tape with different colors, arranged on a common circle on and rotatably supported on the rotating disk; and an impression cylinder supported for movement toward and away from the tape feed passage, the impression cylinder being configured to press the bundling tape against one of the color stamping rollers disposed opposite to one of the surfaces of the bundling tape extended along the tape feed passage.

16. The bank note bundling machine according to claim 14, wherein the tape winding unit further comprises an endless belt for rotating the tape gripper.

* * * * *